US009802792B2

(12) United States Patent
Kwon et al.

(10) Patent No.: US 9,802,792 B2
(45) Date of Patent: Oct. 31, 2017

(54) TROLLEY

(71) Applicant: SAMSUNG HEAVY IND. CO., LTD., Seoul (KR)

(72) Inventors: Do-Hoon Kwon, Geoje-si (KR); Nicolas Pichon, Ternay (FR); Young-Duck An, Geoje-si (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 31 days.

(21) Appl. No.: 14/763,160

(22) PCT Filed: Jan. 24, 2014

(86) PCT No.: PCT/KR2014/000715
§ 371 (c)(1),
(2) Date: Jul. 23, 2015

(87) PCT Pub. No.: WO2014/116062
PCT Pub. Date: Jul. 31, 2014

(65) Prior Publication Data

US 2015/0321887 A1 Nov. 12, 2015

(30) Foreign Application Priority Data

Jan. 25, 2013 (KR) ..... 10-2013-0008942
Jan. 25, 2013 (KR) ..... 10-2013-0008945
(Continued)

(51) Int. Cl.
*B66C 9/00* (2006.01)
*B66C 9/14* (2006.01)
(Continued)

(52) U.S. Cl.
CPC ..... *B66C 9/14* (2013.01); *B66C 9/02* (2013.01); *B66C 9/18* (2013.01); *B66C 11/06* (2013.01)

(58) Field of Classification Search
CPC .... B66C 9/00; B66C 9/10; B66C 9/12; B66C 9/14; B66C 9/16; B66C 9/18; B66C 11/00; B66C 11/04; B66C 11/06; B66C 11/08
See application file for complete search history.

(56) References Cited

U.S. PATENT DOCUMENTS 4,248,157 A * 2/1981 Evans ..... B61B 1/005 104/246
4,343,240 A * 8/1982 Nishimura ..... F16B 21/12 105/54
2015/0321887 A1* 11/2015 Kwon ..... B66C 11/06 105/96

FOREIGN PATENT DOCUMENTS

CN 1288360 12/2006
JP 29-6196 6/1896
(Continued)

OTHER PUBLICATIONS

Office Action dated May 3, 2016 for Chinese Patent Application No. 201480004677.0 and its machine translation provided by Google Translate.
(Continued)

*Primary Examiner* — Jason C Smith
(74) *Attorney, Agent, or Firm* — Ladas & Parry, LLP

(57) ABSTRACT

Provided is a trolley which is easily driven or braked. The trolley includes a body unit which moves along a rail and a power transfer unit which transfers power for driving or braking of the body unit, in which the power transfer unit includes an input shaft, an output shaft which receives power of the input shaft and transfers the power to the body unit, and a locking unit which transfers the power from the input shaft to the output shaft but does not transfer power from the output shaft to the input shaft.

18 Claims, 46 Drawing Sheets

(30) Foreign Application Priority Data

| | | |
|---|---|---|
| Oct. 2, 2013 | (KR) | 10-2013-0117976 |
| Oct. 2, 2013 | (KR) | 10-2013-0118001 |
| Nov. 15, 2013 | (KR) | 10-2013-0139425 |
| Nov. 15, 2013 | (KR) | 10-2013-0139426 |

(51) Int. Cl.

| | |
|---|---|
| ***B66C 11/06*** | (2006.01) |
| ***B66C 9/02*** | (2006.01) |
| ***B66C 9/18*** | (2006.01) |

(56) References Cited

FOREIGN PATENT DOCUMENTS

| | | |
|---|---|---|
| JP | 6-340397 | 12/1994 |
| JP | 3014448 | 5/1995 |
| JP | 3017314 | 8/1995 |
| JP | 2002-106227 | 4/2002 |
| JP | 2002-128461 | 5/2002 |
| JP | 2002-174320 | 6/2002 |
| JP | 2002-266902 | 9/2002 |
| JP | 2004-97166 | 4/2004 |
| JP | 2007-263285 | 10/2007 |
| JP | 2008-30895 | 2/2008 |
| JP | 2013-107772 | 6/2013 |
| KR | 20-0337788 | 1/2004 |
| KR | 10-2012-0050095 | 5/2012 |

OTHER PUBLICATIONS

Office Action dated May 24, 2016 for Japanese Patent Application No. 2015-551630 and its machine translation provided by Applicant's foreign counsel.

International Preliminary Report on Patentability (Chapter II) for PCT/KR2014/000715 mailed on Jan. 5, 2015 and its English translation provided by WIPO.

Written Opinion of the International Searching Authority for PCT/KR2014/000715 mailed on Apr. 28, 2014 and its machine translation provided by Google Translate.

International Search Report for PCT/KR2014/000715 mailed on Apr. 28, 2014 and its English translation.

Extended European Search Report dated Jul. 29, 2016 for European Patent Application No. 14742726.4.

Office Action dated Oct. 17, 2016 for Chinese Patent Application No. 201480004677.0 and its machine English translation by Google Translate.

Notice of Allowance dated Oct. 4, 2016 for Japanese Patent Application No. 2015-551630 and its machine English translation by Google Translate.

* cited by examiner

TROLLEY

CROSS-REFERENCE TO RELATED APPLICATION(S)

This application is the U.S. National Stage of International Patent Application No. PCT/KR2014/000715 filed on Jan. 24, 2014, which claims priority to Korean Patent Application Nos. 10-2013-0008945 and 10-2013-0008942 filed on Jan. 25, 2013, 10-2013-0117976 and 10-2013-0118001 filed on Oct. 2, 2013, 10-2013-0139425 and 10-2013-0139426 filed on Nov. 15, 2013, the disclosures of which are incorporated in their entireties herein by reference.

TECHNICAL FIELD

The present invention relates to a trolley easy to drive or brake.

BACKGROUND ART

Trolleys are devices which may run along a rail installed on a ceiling while carrying an object to be transferred. Trolleys described above are generally used in places where transfer of a heavy weight is needed, such as various industrial settings, docks, and vessels.

General trolleys each include a plurality of wheels, a supporting plate unit which runs along a rail having the form of an H-beam or an I-beam, and a link unit provided in the supporting plate unit to carry an object to be transferred. The link unit may carry the object to be transferred through a winding device such as a chain block. Also, a worker may transfer a trolley on which an object hangs through pushing or pulling. As a cited reference, U.S. Pat. No. 4,343,240 (Aug. 10, 1982) and U.S. Pat. No. 4,248,157 (Feb. 3, 1981) may be referred to.

PRIOR ART DOCUMENT

Patent Document

Patent Document 1: U.S. Pat. No. 4,343,240 (Aug. 10, 1982)

Patent Document 2: U.S. Pat. No. 4,248,157 (Feb. 3, 1981)

DISCLOSURE

Technical Problem

Therefore, it is an aspect of the present invention to provide a trolley capable of being easily driven or braked and simultaneously with removing chains for driving or braking.

Also, it is another aspect of the present invention to provide a trolley capable of preventing a brake state from being randomly released when power for driving or braking of the trolley is not transferred.

It is still another aspect of the present invention to provide a trolley capable of using a separable handle unit.

It is yet another aspect of the present invention to provide a trolley which removes instability caused by an imbalance in weight of a power transfer unit connected to one side of a body unit.

It is a further aspect of the present invention to provide a trolley which increases in convenience of mounting.

Technical Solution

One aspect of the present invention provides a trolley including a body unit which moves along a rail and a power transfer unit which transfers power for driving or braking of the body unit, in which the power transfer unit includes an input shaft, an output shaft which receives power of the input shaft and transfers the power to the body unit, and a locking unit which transfers the power from the input shaft to the output shaft but does not transfer power from the output shaft to the input shaft.

The locking unit may include an active rotating body rotated by the input power and a passive rotating body which is coupled with the active rotating body to rotate in the same direction as a rotational direction of the active rotating body and may rotate the output shaft, and the passive rotating body may be rotatable due to the rotation of the active rotating body but may not rotate due to the rotation of the output shaft.

The locking unit may further include a housing which accommodates the passive rotating body therein and a locking member which is disposed between the housing and the passive rotating body, in which an insertion occurs in one rotational direction. When the active rotating body rotates, since the locking member is not inserted, the passive rotating body may rotate. Also, when the power is transferred from the output shaft to the passive rotating body, since the locking member is inserted, the passive rotating body may not rotate.

The locking unit may further include an unlocking member which is connected to the active rotating body and able to move the locking member due to the rotation of the active rotating body. The active rotating body and the passive rotating body may be coupled to generate a space while rotating in such a way that a rotational force of the active rotating body is not transferred to the passive rotating body as the space. While the active rotating body is rotating as the space, the unlocking member may move the locking member to a place in which an insertion does not occur in such a way that the passive rotating body rotates when the active rotating body passes the space and transfers the rotational force to the passive rotating body.

The locking unit may further include a stud member formed on one of the active rotating body and the passive rotating body and a stud hole which is formed in the other of the active rotating body and the passive rotating body and accommodates the stud member. An inner diameter of the stud hole may be greater than an outer diameter of the stud member, thereby generating a gap between the stud hole and the stud member.

The locking unit may further include an elastic member which pushes the locking member to a place in which the insertion occurs.

The locking member may be provided two or more to generate insertions in different rotational directions and the unlocking member may be provided two or more in response to the locking member in such a way that even when the active rotating body rotates in any direction, the unlocking member moves the locking member to a place in which an insertion does not occur to allow the passive rotating body to rotate.

The power transfer unit may include an input gear connected to the input shaft and an output gear which gears into the input gear and is connected to the output shaft, and the input shaft and the output shaft may be arranged not to be parallel to each other and the input gear and the output gear may be coupled to convert a rotational axis direction to transfer the power input below the body unit to the body unit.

The trolley may further include a connection portion connected to the power transfer unit and a handle unit detachably connected to the connection portion and receives the power, in which the connection portion may include a guide member which guides an end of the handle unit to be easily inserted.

The handle unit may include a connection member connected to the connection portion and a handle bar which includes a bent portion bent by an external force, and when the handle unit is connected to the connection portion, a rotational force of the handle unit may be transferred to the input shaft.

The handle unit may further include an elastic member which provides an elastic force to the bent portion to maintain a state of not being bent when the external force which bends the bent portion is removed.

The handle unit may further include a cover member which exposes or covers the bent portion in such a way that when the cover member covers the bent portion, the handle bar is not bent by the external force.

The handle unit may further include a cover member fixing portion which is able to fix the cover member while the cover member is exposing the bent portion.

The handle unit may include an elastic supporting portion which provides an elastic force in a direction in which the cover member covers the bent portion.

The handle unit may include a connection member connected to the connection portion and a handle bar gripped by a worker to input a rotational force. When the handle unit is connected to the connection portion, the rotational force of the handle unit may be transferred to the input shaft. The handle unit may include a handle physically connected to the handle bar which becomes a rotational axis and located separate from a central axis of the handle bar, a first rotation cover which surrounds an outer diameter of the handle and is independently rotatable, and a second rotation cover which surrounds an outer diameter of the handle bar and is independently rotatable.

The body unit may include rolling wheels which roll along a top surface of the rail and a supporting wheel which rolls along a bottom surface of the rail, and the supporting wheel may be located facing the rolling wheels based on a longitudinal central line of the rail and support the moment generated because the power transfer unit and the locking unit are located in one side based on the longitudinal central line of the rail.

The body unit may include a first supporting plate and a second supporting plate located on both sides based on the longitudinal central line of the rail. The rolling wheels may be coupled with the first supporting plate and the second supporting plate, respectively. The power transfer unit may be coupled with the first supporting plate and the supporting wheel may be coupled with the second supporting plate.

The supporting wheel may be coupled to be changeable in location above and below the body unit.

The body unit may include a first supporting plate and a second supporting plate located on both sides of the longitudinal central line of the rail, a connection shaft member which penetrates and connects the first and second supporting plates, a first spacer which surrounds an outer diameter of the connection shaft member and is provided between a tightening nut and one of the first supporting plate and the second supporting plate to maintain a certain distance between the tightening nut and one of the first supporting plate and the second supporting plate, a second spacer which surrounds the outer diameter of the connection shaft member and is provided between the first supporting plate and the second supporting plate to maintain a certain distance between the first supporting plate and the second supporting plate, and the tightening nut which fixes the connection shaft member and the first and second supporting plates.

Through holes may be formed on both ends of the connection shaft member and a slit whose one side is open may be formed along an outer diameter of the tightening nut in such a way that when a pin is inserted along the through hole while the tightening nut is coupled with the connection shaft member, rotation and separation of the tightening nut are prevented by the pin.

The power transfer unit may further include a case. The case may include a base portion connected to the body unit, through which the input shaft penetrates, and a cover portion coupled with the base portion to surround the input shaft, the output shaft, and the locking unit. The base portion may be coupled with the body unit to be movable up and down to release a coupling state between the input gear and the output gear.

Advantageous Effects

As is apparent from the above description, a trolley in accordance with one embodiment of the present invention removes chains used for inputting power for driving or braking, thereby providing a worker with safety, providing aesthetic external appearance, and moving with less power.

Also, a rotational force is transferred only in a direction from an input shaft to an output shaft, thereby preventing a braking state from being randomly released to provide safety and to increase working efficiency.

Also, bidirectional driving or braking is available, thereby increasing working efficiency.

Also, a separable handle unit is usable and the handle unit is removed when the trolley is not used, thereby preventing a collision with a worker and providing aesthetic external appearance.

Also, the handle unit includes a bent section, thereby easily applying a rotational force, being used in various situations, and reducing fatigue accumulated on a connection section of the trolley.

Also, a supporting wheel is installed on the other side of a body unit in which a power transfer unit is installed, thereby allowing the trolley to stably drive on a rail. The supporting wheel supports a bottom surface of the rail, thereby reducing a load caused by an imbalance in weight.

Also, top and bottom positions of the supporting wheel may be changed, thereby being available to be installed on various rails and increasing ease of installation.

MODES OF THE INVENTION

Hereinafter, exemplary embodiments of the present invention will be described in detail with reference to the drawings.

Trolleys may run along a rail approximately horizontally installed on a ceiling or in the air and may be used to carry and transfer a heavy weight in various industrial settings, docks, and vessels. Rails, as shown in FIG. 1, may have the form of a beam with an H-shaped or I-shaped cross section but the form is not limited thereto.

Figure 1:
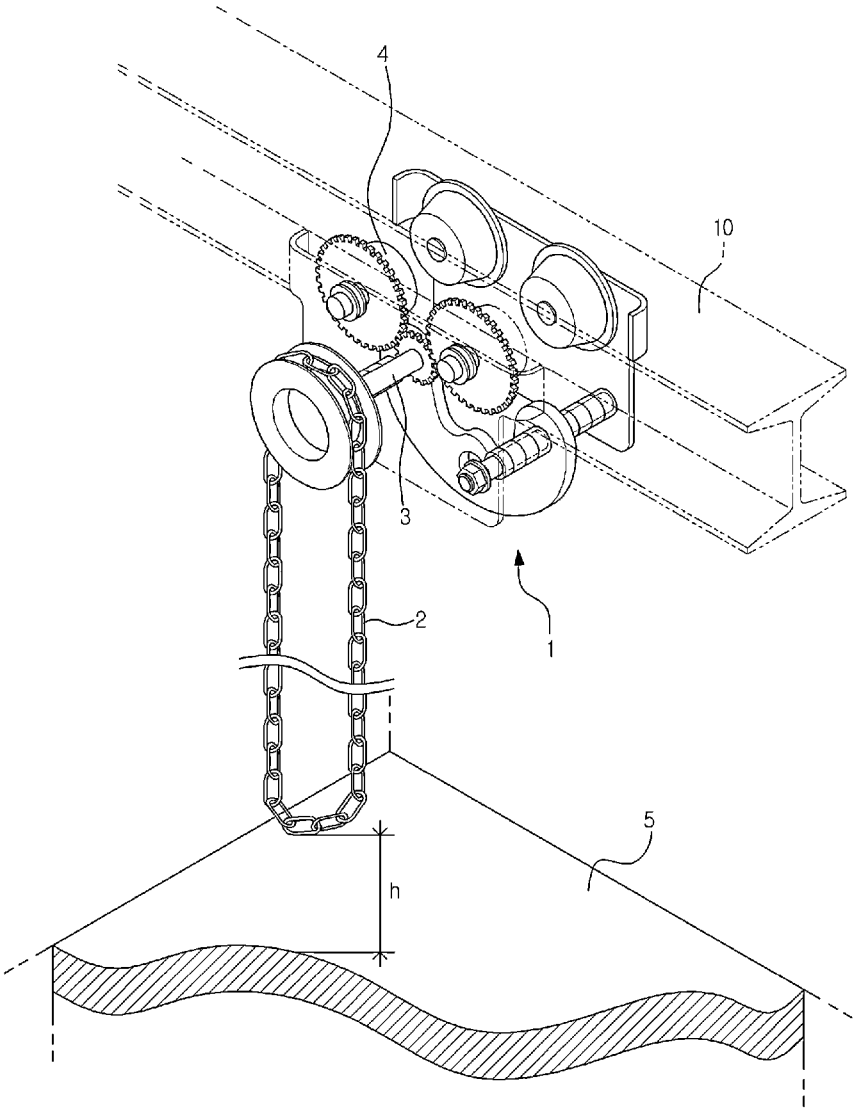
FIG. 1 is a perspective view of a general trolley.

FIG. 1 is a perspective view of a general trolley 1. Generally, the trolley 1 is driven on a rail 10 by a worker through pulling chains 2. The chains 2 rotate a driving axle 3 and wheels 4 connected to the driving axle 3 rotate, thereby allowing the trolley 1 to run along the rail. However, when the trolley 1 carries a heavy object, it costs the worker a lot of labor to move the trolley 1 by pulling the chains 2.

Also, there is a limitation such as a safety reason and an aesthetic reason generated by using the chains 2. It is necessary that the chains 2 droop down to a height h to allow the work to pull them. Also, it is difficult to remove the trolley 1 while being not used. Also, the chains 2 have a high level of mobility. Also, the chains 2 are formed of a metallic material and have a considerable weight thereof. Accordingly, when a vessel pitches due to waves, it may be a risk and an obstacle to the worker. Also, the chains 2 occupy a space in the vessel, which spoils an aesthetic appearance of the vessel.

A trolley 100 according to a first embodiment of the present invention removes the chains 2 for driving or braking to overcome the limitation described above.

Figure 2:
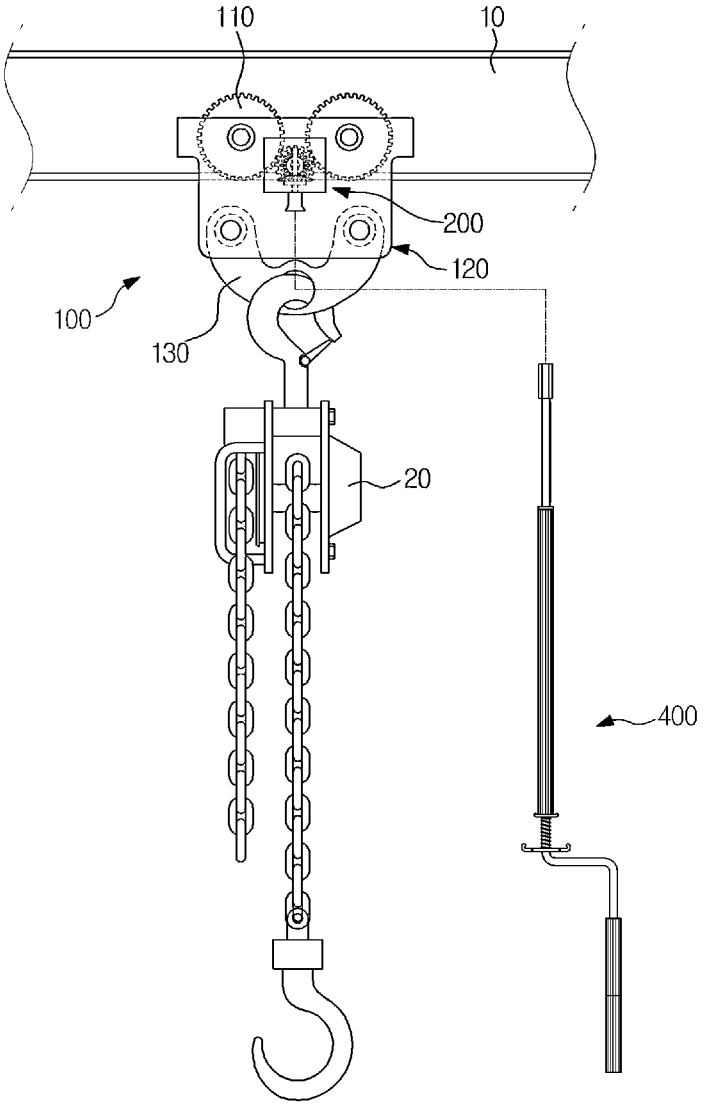
FIG. 2 is a side view illustrating a state in which a trolley according to a first embodiment of the present invention is installed on a rail.
Figure 3:
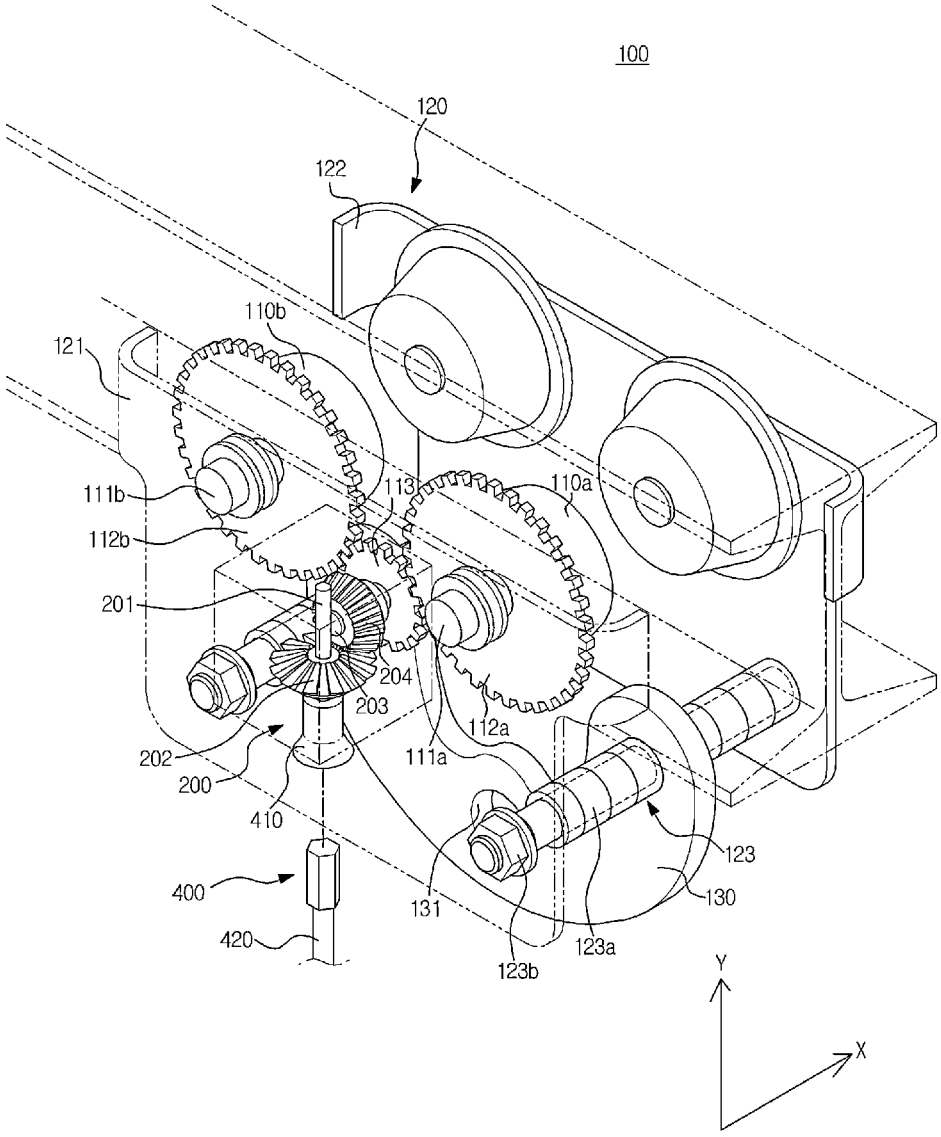
FIG. 3 is a perspective view of a driving unit of the trolley according to the first embodiment of the present invention.
Figure 4:
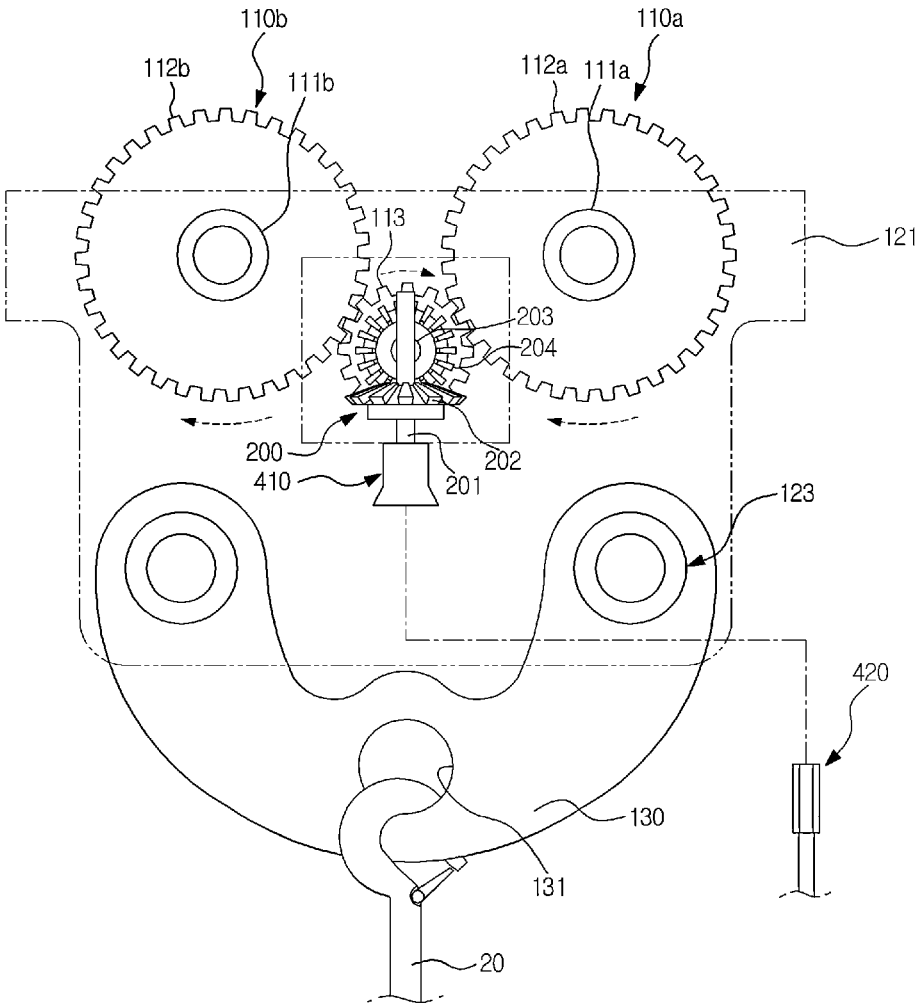
FIG. 4 is a side view of the driving unit of FIG. 3.

FIG. 2 is a side view illustrating a state in which the trolley according to the first embodiment of the present invention is installed on the rail. FIG. 3 is a perspective view of a driving unit of the trolley according to the first embodiment of the present invention. FIG. 4 is a side view of the driving unit of FIG. 3.

The trolley 100 according to the first embodiment of the present invention includes wheels 110: 110*a* and 110*b*, a body unit 120 which supports the wheels, and the driving unit which transfers a driving force to the wheels.

The wheels 110 may be provided one or more. A plurality of wheels 110 may be disposed two for each of both sides of the rail 10 with gaps therebetween for stable running. Totally four wheels 110 on both sides are used according to the first embodiment of the present invention but the number of the wheels 110 and an arrangement thereof are not limited thereto. The number or arrangement of the wheels 110 may vary according to a shape of the rail 10. That is, one wheel 110 may be mounted on the body unit 120.

The body unit 120, as shown in FIG. 3, includes a first side sheet 121 and a second side sheet 122 which are separately disposed on both sides of the rail 10 and support the two wheels 110 respectively and a connection unit 123 which connects the first side sheet 121 with the second side sheet 122 below the rail 10.

The connection unit 123, as shown in FIG. 3, may include two supporting rods 123*a*, respective both ends of which are installed to penetrate the first side sheet 121 and the second side sheet 122 while being parallel to and spaced apart from each other and fastened to tightening nuts 123*b*, thereby being fixed to the first side sheet 121 and the second side sheet 122. The connection unit 123 described above may adjust a distance between the first side sheet 121 and the second side sheet 122 by controlling the number of washers or bushes coupled with an outside of the supporting rod 123*a* between the first side sheet 121 and the second side sheet 122. Accordingly, corresponding to a width of the rail 10 which is applied, the distance between the first side sheet 121 and the second side sheet 122 may be adjusted. A plurality of tightening nuts 123*b* are fastened to the respective supporting rods 123*a* outside the first and second side sheets 121 and 122, thereby allowing the supporting rods 123*a* to be strongly coupled with the first and second side sheets 121 and 122.

A hanging unit 130 may be provided in an arch shape and may be installed to connect middle portions of both the supporting rods 123*a*. Also, to hang an object, a hanging hole 131 may be provided in the center. As shown in FIG. 2, a winding device 20 such as a chain block may be hanged and installed in the hanging hole 131 of the hanging unit 130. It is also possible to hang an object to be transferred through directly binding a rope with the hanging hole 131.

Meanwhile, the connection unit 123 which connects the first side sheet 121 with the second side sheet 122 according to the first embodiment of the present invention includes the two supporting rods 123*a* but is not limited thereto. The connection unit 123 may be formed using one supporting rod which connects lower middle portions of the first side sheet 121 and the second side sheet 122. Also, both ends the connection unit 123 may be formed of metal panels or section shape steel fixed to the first side sheet 121 and the second side sheet 122 through welding or bolt-fastening. Also, the connection unit 123 may be a metallic structure formed together with the first side sheet 121 and the second side sheet 122 as a single body. That is, the first side sheet 121, the second side sheet 122, and the connection unit 123 may be manufactured as a single body through casting.

As shown in FIG. 3, the plurality of wheels 110*a* and 110*b* may be installed to be rotatable by shafts 111: 111*a* and 111*b* fixed to the first side sheet 121 and the second side sheet 122. Also, the respective wheels 110 may be supported by a bearing installed thereinside to smoothly rotate around outsides of the shafts.

One or more of the plurality of wheels 110 include threads 112: 112*a* and 112*b*. The driving unit includes a first gear 113 which gears into the threads 112 and has a first axial direction X and a gear unit 200 which is connected to the first gear and changes a driving force in a second axial direction Y into a driving force in the first axial direction X. Since the trolley 100 moves above the worker, the worker may input a driving force below the body unit 120. Accordingly, the second axial direction Y may be vertical to a bottom of the trolley 100 and the first axial direction X may be vertical to both the second axial direction Y and a longitudinal direction of the rail 10.

The trolley 100 according to the first embodiment of the present invention may include a handle unit 400 which provides the driving force in the second axial direction Y. One end of the handle unit 400 may be connected to the gear unit 200, and the other end thereof may extend downward and be located to be operated by the worker.

An operation of the trolley 100 according to the first embodiment of the present invention will be described as follows. When the worker located below the trolley 100 inputs a rotational force in the second axial direction Y by turning the handle unit 400 which extends downward, the driving force in the second axial direction Y is provided to the gear unit 200 connected to the handle unit 400. Since the gear unit 200 includes a driving direction conversion unit such as a bevel gear body, the gear unit 200 may convert the driving force in the second axial direction Y into the driving force in the first axial direction X. The driving force in the first axial direction X rotates the first gear 113 connected to the gear unit 200. The wheels 110 including the threads 112 which gear into the first gear 113 rotate due to the rotation of the first gear 113, thereby allowing the trolley 100 to move on the rail 10.

Only one of the wheels 110 may include the threads 112 and the first gear 113 may be engaged therewith. However, as shown in FIG. 2, the two wheels 110*a* and 110*b* may include the threads 112*a* and 112*b* and the first gear 113 may be engaged therewith at the same time. In this case, due to the rotation of the first gear 113, the two wheels 110*a* and 110*b* may rotate at the same time and may increase the grip of the rail 10 and the wheels 110. Although excluded from a description, a plurality of the wheels 110 may include the threads 112 and a plurality of first gears (refer to 113) which gear thereinto may be connected to the gear unit 200. Also, the wheels 110 generally include circular treads and are in contact with the rail 10. However, the threads 112 included in the wheels 110 may be in direct contact with the rail 10.

The gear unit 200 used for the trolley 100 according to the first embodiment of the present invention will be described in detail. The gear unit 200 may include an input bevel gear 202 which is in contact with an end of the handle unit 400 and includes an input shaft 201 having the second axial direction Y and an output bevel gear 204 which gears into the input bevel gear 202 and includes an output shaft 203. A rotation in the second axial direction Y input through the input shaft 201 of the input bevel gear 202 is converted in an axial direction of the rotation from Y into X through the output shaft 203 of the output bevel gear 204. The output shaft 203 may be parallel to the first axial direction X. However, even when otherwise, the output shaft 203 may be converted into the first axial direction X by another gear body (not shown) connected to the output bevel gear 204. Also, the output bevel gear 204 may be directly connected to a shaft of the first gear 113 to rotate the first gear 113 but may include a speed reducer (not shown) therebetween.

The speed reducer may additionally include a gear to change a rotation ratio of the rotation of the input shaft 201 to the rotation of the wheels 110. For example, when the number of rotations of the wheels 110 is allowed to be greater than that of rotations of the input shaft 201, a speed of the trolley 100 may be increased but the worker needs a great force when a heavy object clings thereto. On the contrary, when the number of rotations of the wheels 110 is smaller than that of rotations of the input shaft 201, the speed of the trolley 100 may be decreased but it is possible to move the trolley 100 to which a heavy object clings with less force.

A gear ratio of the speed reducer may be changed according to an operation of the worker. In this case, it is possible to flexibly drive the trolley 100 depending on various situations. That is, when an object does not clings thereto or a light object clings thereto, the number of rotations of the wheels 110 may be increased to be greater than that of rotations of the input shaft 201. When a heavy object clings thereto or safe driving is necessary, a gear ratio which decreases the number of rotations of the wheels 110 may be used. In addition, when an object with more than a certain weight clings thereto, it is possible to use a speed reducer whose gear ratio is changed to decrease the number of rotations of the wheels 110.

Figure 5:
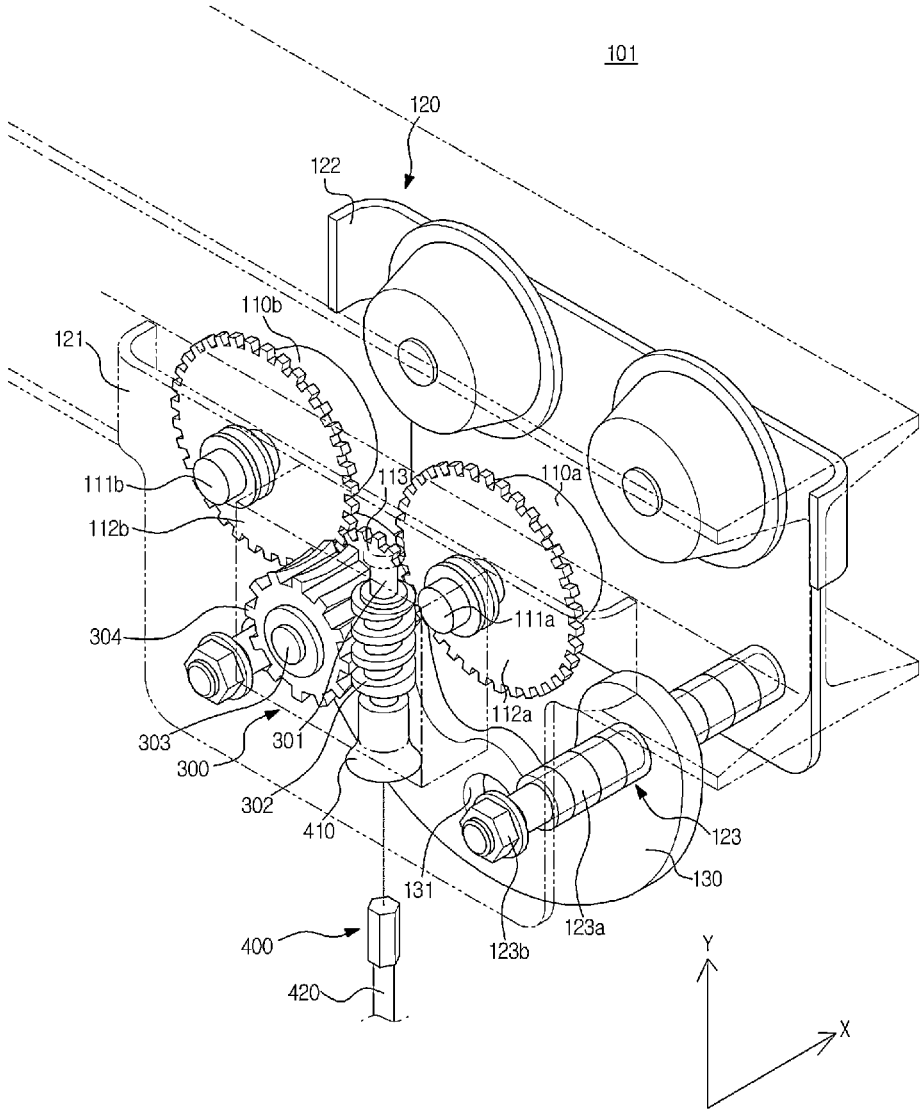
FIG. 5 is a perspective view of a driving unit according to another embodiment of the present invention.

Next, a gear unit 300 used for a trolley 101 according to another embodiment of the present invention will be described in detail. FIG. 5 is a perspective view of a driving unit of the trolley 101 according to another embodiment of the present invention.

The gear unit 300 may include a worm gear body. The gear unit 300 may include a worm gear 302 which is in contact with an end of the handle unit 400 and includes an input shaft 301 having the second axial direction Y and a worm wheel 304 which gears into the worm gear 302 and includes an output shaft 303. A rotation in the second axial direction Y input through the input shaft 301 of the worm gear 302 is converted in an axial direction of the rotation from Y into X through the output shaft 303 of the worm wheel 304. The output shaft 303 may be parallel to the first axial direction X. However, even when otherwise, the output shaft 303 may be converted into the first axial direction X by another gear body (not shown) connected to the worm wheel 304. Also, the worm wheel 304 may be directly connected to a shaft of the first gear 113 to rotate the first gear 113 but may include a speed reducer (not shown) therebetween.

Figure 6:
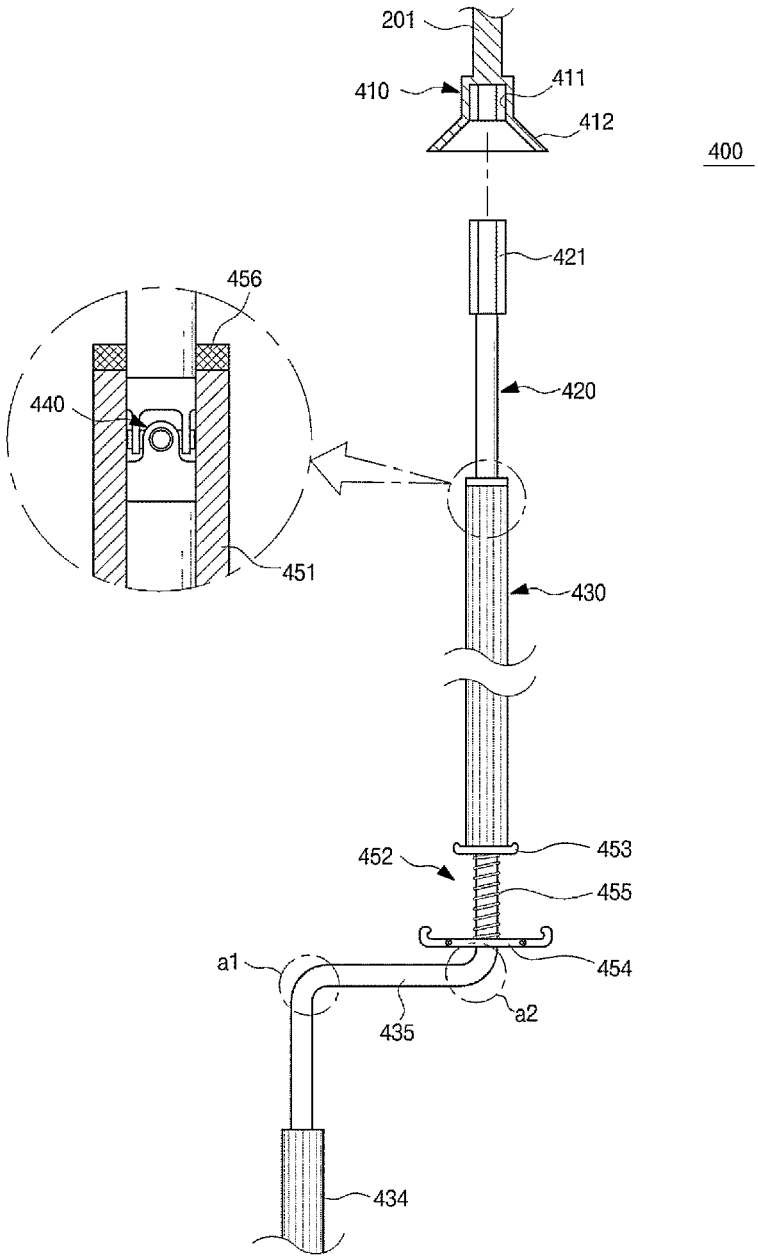
FIG. 6 is a view illustrating a state of a handle unit of the trolley according to the first embodiment of the present invention before bending.
Figure 7:
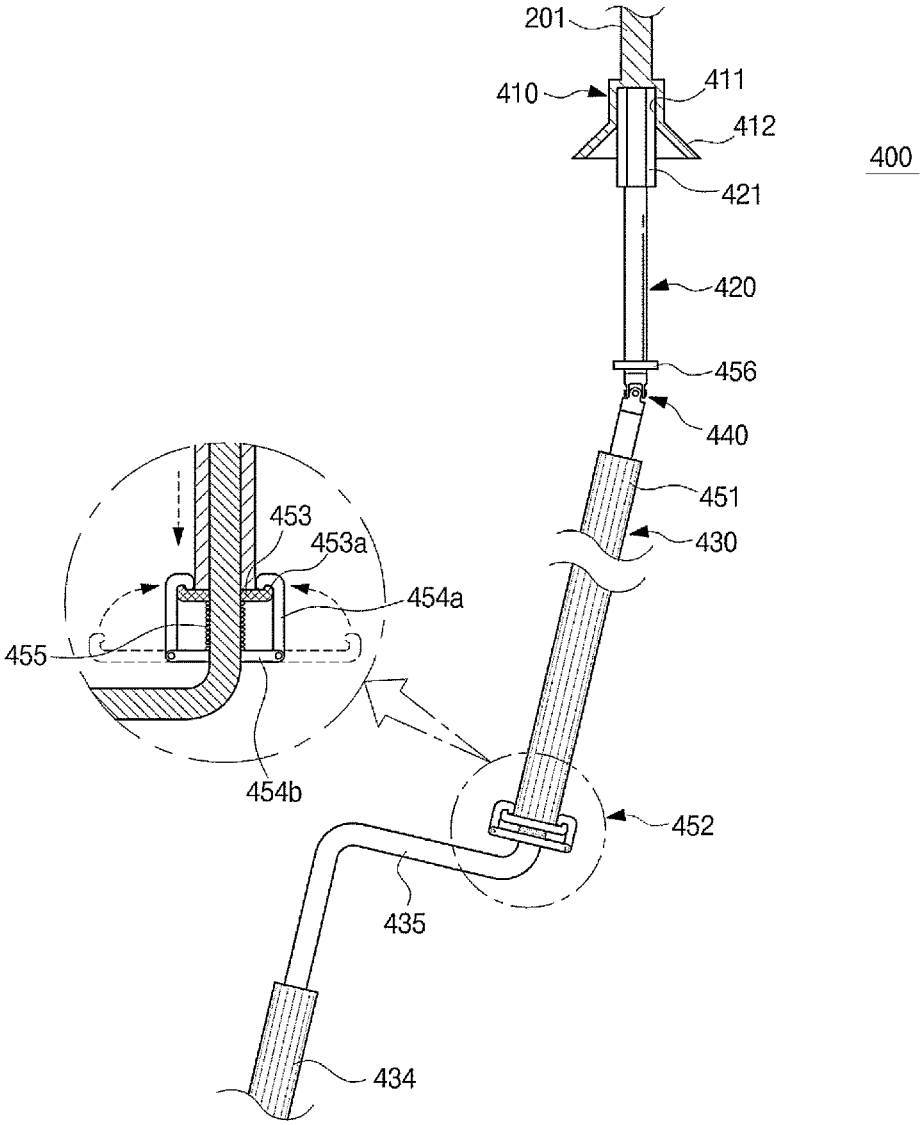
FIG. 7 is a view illustrating a state of the handle unit of FIG. 6 after bending.

Next, the handle unit 400 will be described with reference to FIGS. 6 and 7. FIG. 6 is a view illustrating a state of the handle unit 400 of the trolley 100 according to the first embodiment of the present invention before bending. FIG. 7 is a view illustrating a state of the handle unit 400 of FIG. 6 after bending.

As shown in FIG. 2, since it is necessary to connect the handle unit 400 to the gear unit 200 of the trolley 100 located higher than a working place of the worker, the trolley 100 may be provided as a long bar. Since the general trolley 1 (refer to FIG. 1) operates the driving axle 3 (refer to FIG. 1) using the chains 2 (refer to FIG. 1), the worker works pulling the chains which are hung down. However, this method needs a great force and the safety of the worker is threatened by swinging chains.

The trolley 100 according to the first embodiment of the present invention may be driven using the handle unit 400 while removing the chains 2 (refer to FIG. 1). Generally, the chains 2 used for driving the trolley 1 rotate a shaft due to a pulling force of the worker. On the contrary, in the case of the handle unit 400 according to the embodiment of the present invention, the worker rotates a shaft, thereby transferring a driving force to the gear unit 200.

The handle unit 400 may be detachably connected to the gear unit 200. The handle unit 400 may include a first connection portion 410 connected to an end of the input shaft 201, a second connection portion 420 detachably connected to the first connection portion 410, and a handle bar 430 connected to the second connection portion 420. It is necessary that the first connection portion 410 and the second connection portion 420 transfer a rotational force of the handle bar 430 to the input shaft 201 while being detachable. Accordingly, the first and second connection portions 410 and 420 may each include a groove portion including angled sides and a protrusion portion which has a shape corresponding thereto and is inserted into the groove portion. Since the protrusion portion does not spin while being inserted into the groove portion, a rotational force of the second connection portion 420 may be transferred to the first connection portion 410.

FIG. 6 illustrates a connection protrusion 421 having a hexagonal shape and a connection groove 411 having a shape corresponding thereto. Since the connection protrusion 421 and the connection groove 411 include polygonal shapes, the rotational force transferred through the handle unit 400 may be transferred to the input shaft 201 without any loss. Accordingly, other shapes which differ therefrom but are able to transfer the rotational force without any slip are included in the embodiments of the present invention. Here, the first connection portion 410 may be a protrusion portion as much as a groove portion. In FIG. 6, it is shown that the first connection portion 410 includes the connection groove 411 and the second connection portion 420 includes the connection protrusion 421. On the contrary, the second connection portion 420 may include a groove portion and the first connection portion 410 may include a protrusion portion.

A guide portion 412 which is able to guide the connection protrusion 421 to make connection with the second connection portion 420 easy may be provided in an end of the first connection portion 410. The guide portion 412 may have a shape whose opening becomes wider toward an end thereof. Accordingly, even when the connection protrusion 421 is coupled with the connection groove 411 not fitting completely but inserted into the opening of the guide portion 412, the connection protrusion 421 may be guided along an inner surface of the guide portion 412 and then inserted into the connection groove 411.

Also, to allow the handle unit 400 to easily rotate, as shown in FIG. 6, the end of the handle unit 400 may be bent twice at a1 and a2 to allow the user to easily input the rotational force. The method of inputting a rotational force, compared with a general method of using chains, may more easily and safely provide a driving force with less force. Also, as a length of a connection portion 435 which connects a handle 434 with the handle bar 430 increases, a greater force may be provided. As the length decreases, rotation may be performed at a high speed.

The handle unit 400 may include bent portions 431 and 440. The bent portions 431 and 440 include portions which are crooked or bent by a joint. Hereinafter, to avoid confusion, a bent portion which is crooked is referred to as a crooked portion 431 (refer to FIG. 8) and a bent portion which is bent by a joint is referred to as a joint portion 440 (refer to FIG. 6). Also, unless there is a particular reason, a description for the joint portion 440 will be also applied to the crooked portion 431.

Torque is proportional to a length between the input shaft 201 (refer to FIG. 3) or 301 (refer to FIG. 5) and a bent portion. Accordingly, when the length between the input shaft 201 or 301 and the bent portion decreases, the torque decreases and fatigue applied to the input shaft 201 or 301 is reduced. Also, the worker may operate the trolley 100 using the handle unit 400 which is bent and inclined due to the joint portion 440 in a proceeding direction, thereby easily moving the trolley 100 which hangs a heavy object.

The joint portion 440 of the handle unit 400 allows the handle unit 400 to be used even when an obstacle is present in a way thereof. Particularly, when a multidirectional joint portion using a universal joint is included, it is possible to proceed while avoiding the obstacle through all spaces.

The joint portion 440 may be located closer to or farther from the body unit 120 than the connection portions 410 and 420. In the case of the trolley 100 shown in FIG. 2, the connection portions 410 and 420 are located above the joint portion 440. On the other hand, the joint portion 440 may be located above the connection portions 410 and 420 according to the embodiment of the present invention.

The handle unit 400 in FIG. 6 includes the first connection portion 410 connected to the input shaft 201. The first connection portion 410 may include the connection groove 411 having a polygonal shape with which the handle unit 400 is detachably coupled. Also, the handle unit 400 includes the second connection portion 420 including the connection protrusion 421 which is coupled with the first connection portion 410 and has a polygonal shaped end, and the handle bar 430 including the joint portion 440 for bending.

The handle unit 400 may include a folding preventing portion capable of preventing the joint portion 440 from being folded. When the joint portion 440 is located below the second connection portion 420, since the joint portion 440 may be folded while being connected to the first connection portion 410, a connection process may be not easy. The folding preventing portion prevents the joint portion 440 from being folded during the connection process and may include a cover member 451 which is provided throughout the handle bar 430 to at least partially surround a peripheral part of the joint portion 440 and able to be slidably moved along the handle bar 430. When the cover member 451 is slidably moved toward the second connection portion 420, since the periphery of the joint portion 440 is at least partially surrounded, it is possible to prevent the joint portion 440 from being folded.

Also, an elastic supporting portion 452 which is provided on the handle bar 430 and applies an elastic force to the cover member 451 to return to an original position when the cover member 451 is moved downward to expose the joint portion 440 may be included. The elastic supporting portion 452 supports a bottom end of the cover member 451 to allow the cover member 451 which is moved downward, to return to the original position. Also, a restrictive portion 456 which is provided on one of a bottom end of the second connection portion 420 and a top end of the handle bar 430 and ties a top end of the cover member 451 to restrict an upward movement of the cover member 451 may be provided.

Here, the elastic supporting portion 452 may include a bottom supporting portion 453 which supports the bottom end of the cover member 451 and includes a locking protrusion 453*a* on a top surface thereof, a fixing member 454*b* which is provided below the bottom supporting portion 453 and includes a spring member 455 having a restoring force between the fixing member 454*b* and the bottom supporting portion 453, and a locking clip 454*a* which is pivotably provided on the fixing member 454*b* and is fastened to the locking protrusion 453*a* while the cover member 451 is moving downward. The locking clip 454*a* may have an end curved once or more to be hung on the locking protrusion 453*a*.

As shown in FIG. 7, a user may connect the handle unit 400 to the first connection portion 410, move the cover member 451 downward to completely expose the joint portion 440, and then operate rotation of the handle unit 400 at a slant angle. That is, when the joint portion 440 is surrounded by the cover member 451, the second connection portion 420 and the handle bar 430 of the handle unit 400 are kept upright, thereby being easily connected to the first connection portion 410.

Also, after the handle unit 400 is connected to the first connection portion 410, the cover member 451 is pulled and moved downward to completely expose the joint portion 440 to bend the handle unit 400. Accordingly, the user may transfer rotation of the handle unit 400 to the input shaft 201 at the slant angle to drive. Here, while the cover member 451 which is pulled is being fixed by fastening the locking clip 454*a* to the locking protrusion 453*a* of the cover member 451, a rotation operation may be performed by the handle unit 400.

Meanwhile, as described above, the handle unit 400 may be connected to the first connection portion 410 connected to the gear unit 200 when it is necessary to use the trolley 100. As described above, when the user rotates the handle unit 400 while the handle unit 400 is being connected, the input shaft 201 connected to the first connection portion 410 is rotated. Accordingly, the user may rotate the input shaft 201 forward or backward by rotating the handle unit 400 forward or backward, thereby operating the driving unit to perform bidirectional movement.

Figure 8:
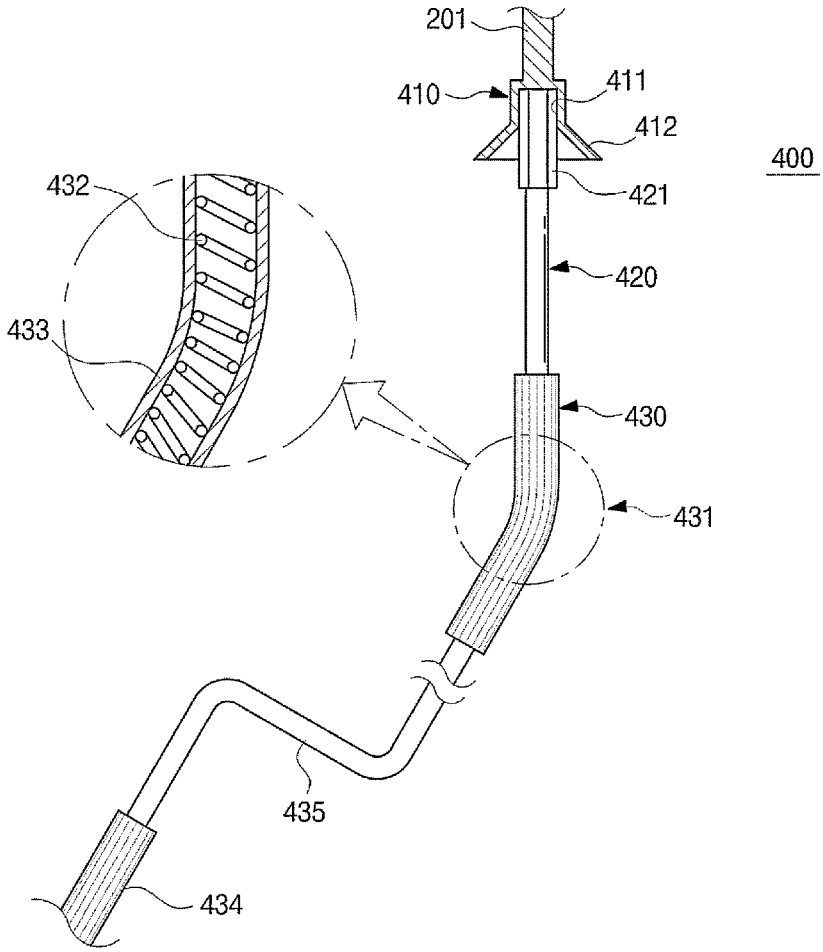
FIG. 8 is a view illustrating a state of the handle unit shown in FIG. 6 according to another embodiment of the present invention after bending.

Next, referring to FIG. 8, a handle unit according to another embodiment of the present invention will be described. FIG. 8 is a view illustrating a state of the handle unit shown in FIG. 6 according to another embodiment of the present invention after bending.

The handle unit 400 includes the first connection portion 410 connected to the input shaft 201. The first connection portion 410 may include the connection groove 411 having a polygonal shape with which the handle unit 400 is detachably coupled. The handle unit 400 includes the second connection portion 420 including the connection protrusion 421 which is coupled with the first connection portion 410 and has a polygonal shaped end, and the handle bar 430 which is connected to the second connection portion 420 and the crooked portion 431 and curved once or more for bending. Hereinafter, bending means being bent at a certain angle and curved, which may be defined as a term including all cases of bending deformation from an upright state.

The crooked portion 431 described above, as shown in a partially enlarged portion in FIG. 8, may include an elastic member 432 and an elastic cover 433 in which the elastic member 432 is inserted. For example, the elastic member 432 may include a material having an elastic force such as a spring, rubber, and plastic. The elastic cover 433 may also include a material having an elastic force such as rubber and plastic.

Accordingly, as shown in FIG. 8, after the handle unit 400 is connected to the first connection portion 410, rotation of the handle unit 400 is transferred to the input shaft 201 even at a slant angle using the handle unit 400 provided to be bendable, thereby performing bidirectional movements.

Figure 9:
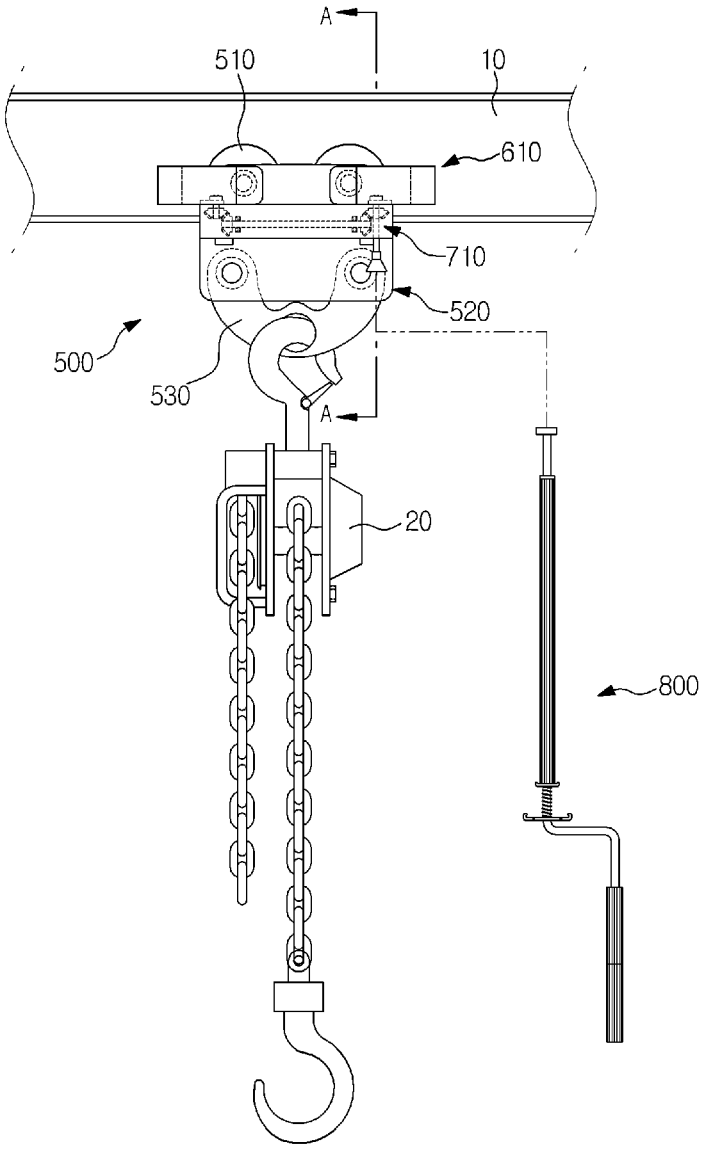
FIG. 9 is a side view illustrating a state in which a trolley according to a second embodiment of the present invention is installed on a rail.
Figure 10:
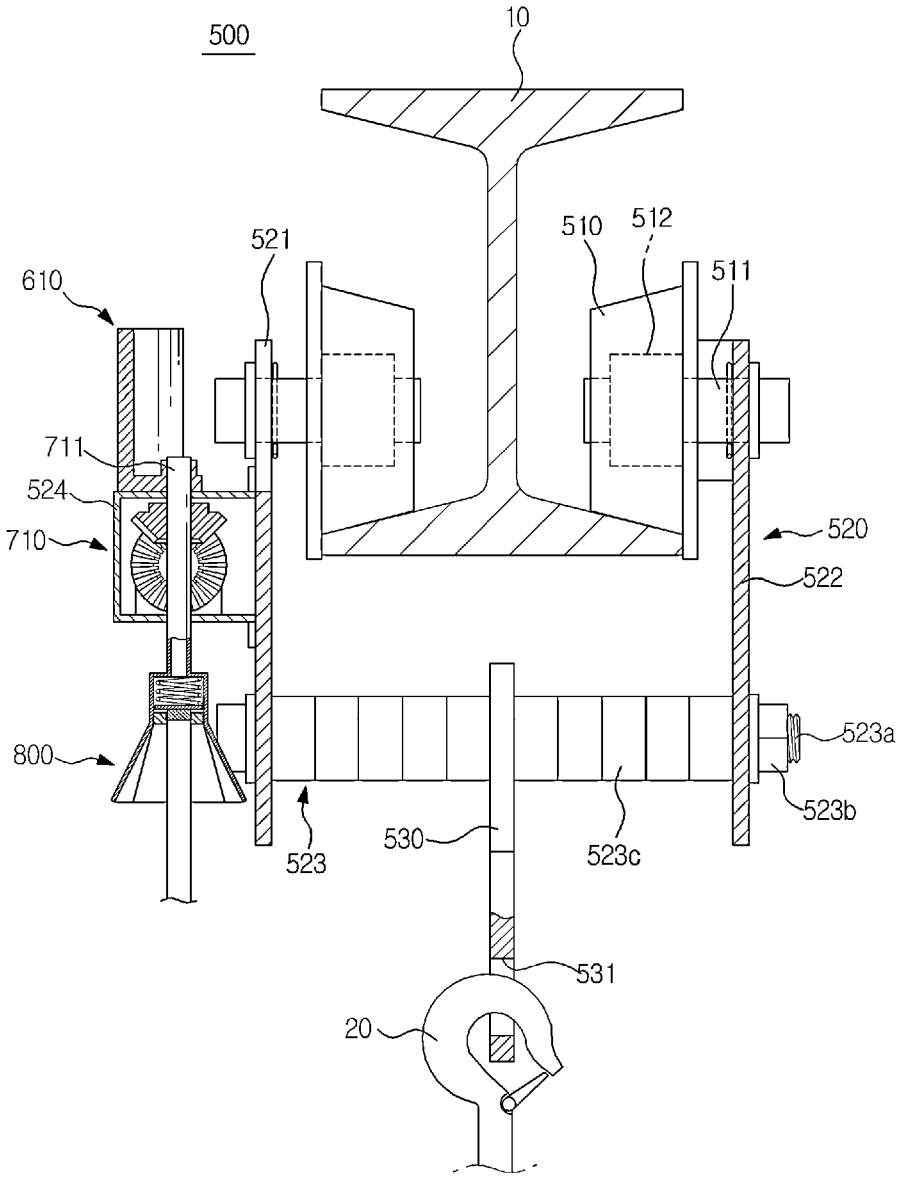
FIG. 10 is a cross-sectional view illustrating a portion taken along line A-A in FIG. 9, which illustrates a braking release state.
Figure 11:
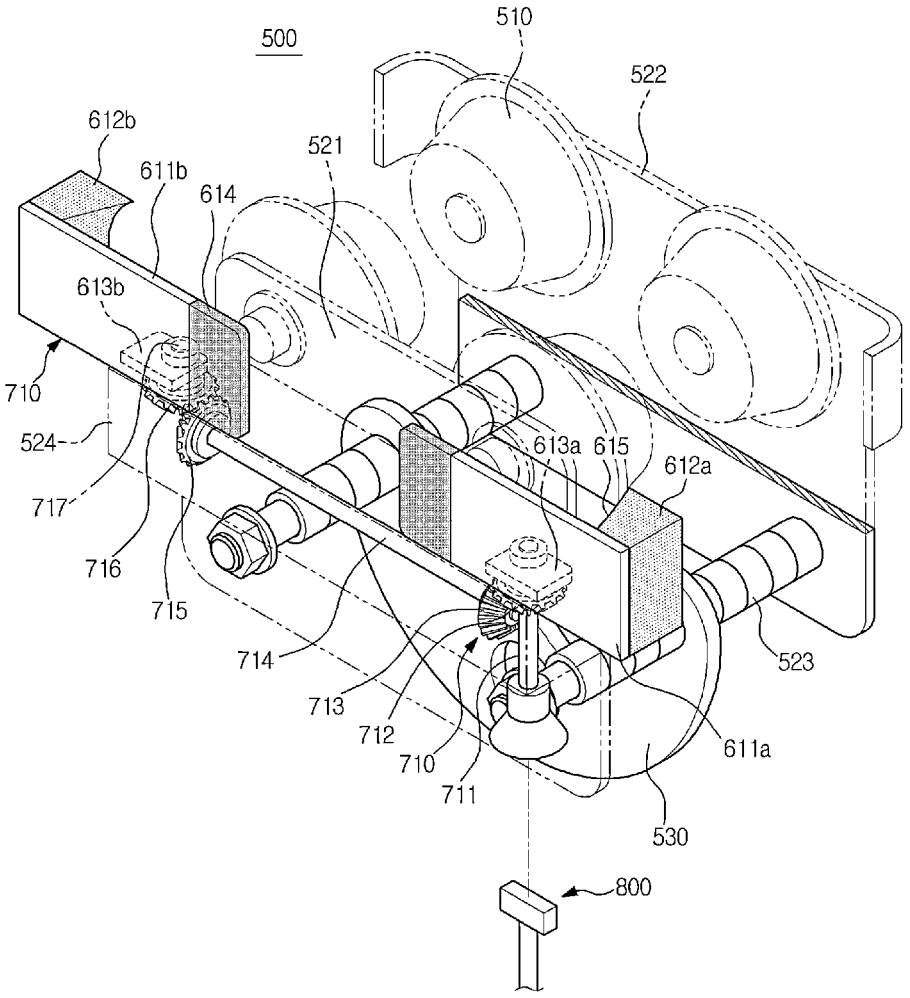
FIG. 11 is a perspective view of a brake unit of the trolley according to the second embodiment of the present invention.
Figure 12:
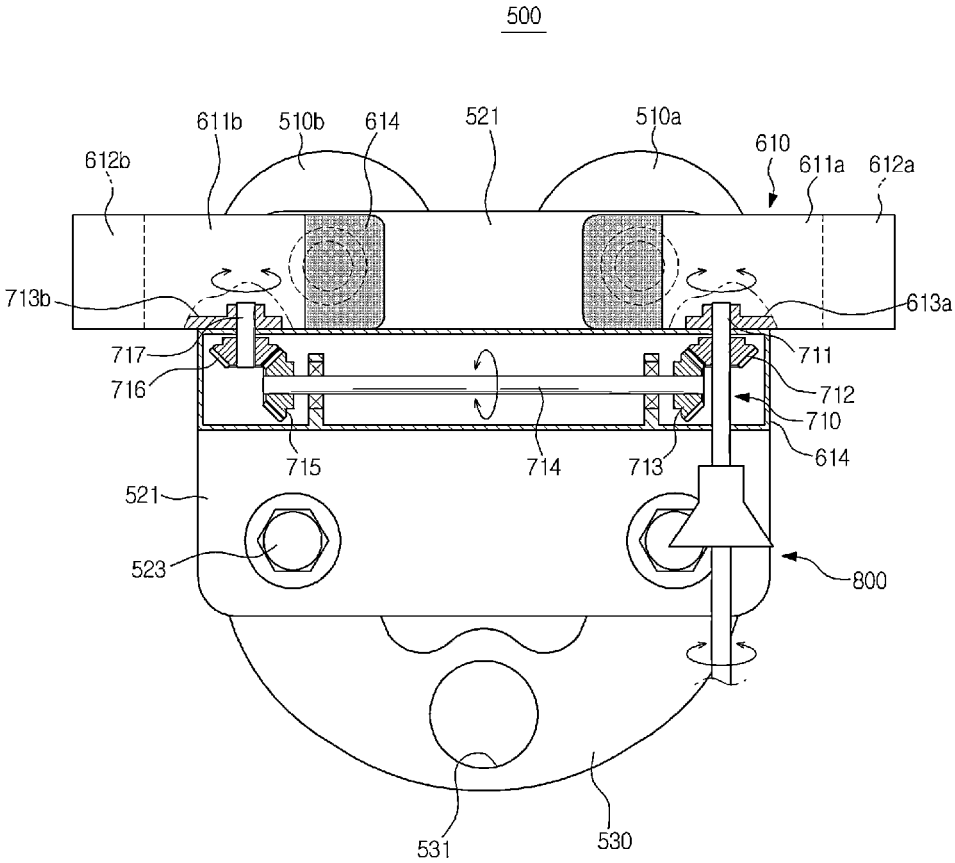
FIG. 12 is a side view of the brake unit shown in FIG. 11, which illustrates an operation of the brake unit.
Figure 13:
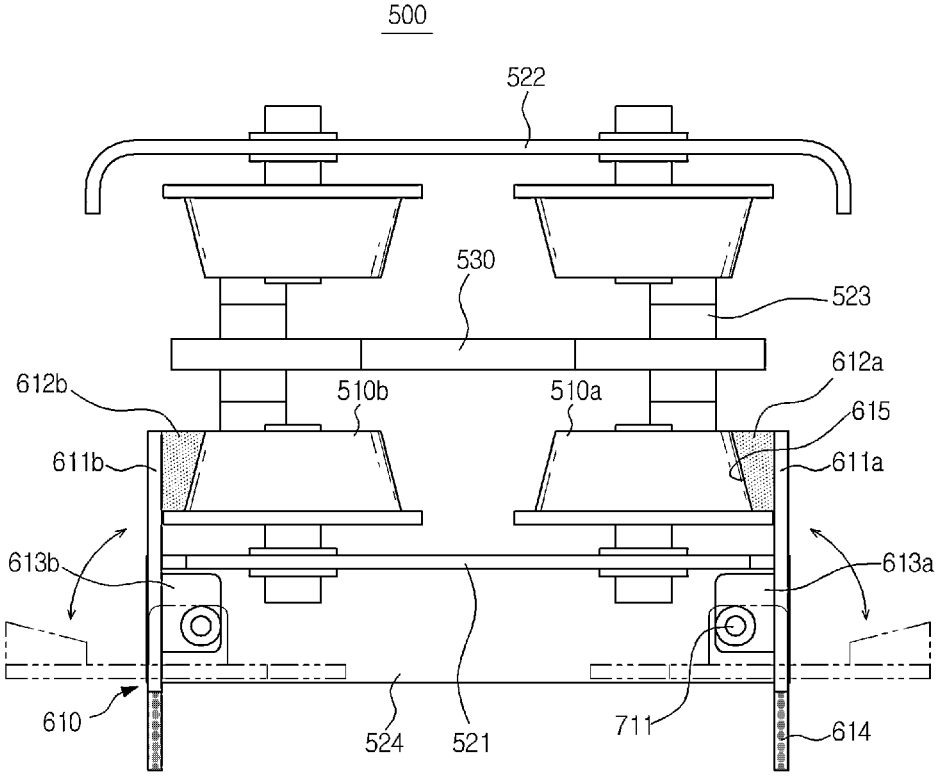
FIG. 13 is a plan view of the driving shown in FIG. 12.

Referring to FIGS. 9 to 13, a trolley according to a second embodiment of the present invention will be described. FIG. 9 is a side view illustrating a state in which the trolley according to the second embodiment of the present invention is installed on the rail. FIG. 10 is a cross-sectional view illustrating a portion taken along line A-A in FIG. 9, which illustrates a brake release state. FIG. 11 is a perspective view of a brake unit of the trolley according to the second embodiment of the present invention. FIG. 12 is a side view of the brake unit shown in FIG. 11, which illustrates an operation of the brake unit. FIG. 13 is a plan view of the brake unit of FIG. 12.

Referring to FIG. 9, a trolley 500 may run along the rail 10 approximately horizontally installed on a ceiling or in the air and may be used to carry and transfer a heavy weight in various industrial settings, docks, and vessels.

The rail 10, as shown in FIG. 10, may have the form of a beam with an H-shaped or I-shaped cross section but the form is not limited thereto. Parts of the trolley 500 installed on the rail 10 are disposed to be accommodated in both sides of the rail 10, respectively. The trolley 500 includes a plurality of wheels 510 which perform rolling movement while being in contact with the rail 10, a body unit 520 which rotatably supports the plurality of wheels 510 and is able to move along the rail 10 due to the rolling movement of the wheels 510, a hanging unit 530 installed below the body unit 520 to hang an object, and a brake unit 610 capable of restricting the movement of the body unit 520 as necessary.

The plurality of wheels 510 may be disposed two for each of the both sides of the rail 10 while being separate from each other for safe running. In the present embodiment, among four wheels 510 in total, two for each of the both sides are used but the number of the wheels 510 and an arrangement thereof are not limited thereto. The number or arrangement of the wheels 510 may vary according to a change in shape of the rail 10. That is, one wheel 510 may be mounted on the body unit 520.

The body unit 520, as shown in FIG. 10, includes a first side sheet 521 and a second side sheet 522 which are separately disposed on the both sides of the rail 10 and support the two wheels 510 respectively and a connection unit 523 which connects the first side sheet 521 with the second side sheet 522 below the rail 10.

The connection unit 523, as shown in FIG. 11, may include two supporting rods 523*a*, respective both ends of which are installed to penetrate the first side sheet 521 and the second side sheet 522 while being parallel to and spaced apart from each other and fastened to tightening nuts 523*b*, thereby being fixed to the first side sheet 521 and the second side sheet 522. The connection unit 523 described above may adjust a distance between the first side sheet 521 and the second side sheet 522 by controlling the number of washers or bushes 523*c* coupled with an outside of the supporting rod 523*a* between the first side sheet 521 and the second side sheet 522. Accordingly, corresponding to a width of the rail 10 which is applied, the distance between the first side sheet 521 and the second side sheet 522 may be adjusted. A plurality of tightening nuts 523*b* are fastened to the respective supporting rods 523*a* outside the first and second side sheets 521 and 522, thereby allowing the supporting rods 523*a* to be strongly coupled with the first and second side sheets 521 and 522.

The hanging unit 530 may be provided in an arch shape and may be installed to connect middle portions of both the supporting rods 523*a*. Also, to hang an object, a hanging hole 531 may be provided in the center. As shown in FIGS. 9 and 10, a winding device 20 such as a chain block may be hanged on and installed in the hanging hole 531 of the hanging unit 530. It is possible to hang an object to be transferred through directly binding a rope with the hanging hole 531.

Meanwhile, the connection unit 523 which connects the first side sheet 521 with the second side sheet 522 according to the present embodiment includes the two supporting rods 523*a* but is not limited thereto. The connection unit 523 may be formed using one supporting rod which connects lower middle portions of the first side sheet 521 and the second side sheet 522. Also, both ends of the connection unit 523 may be formed of metal panels or section shape steel fixed to the first side sheet 521 and the second side sheet 522 through welding or bolt-fastening. Also, the connection unit 523 may be a metallic structure formed together with the first side sheet 521 and the second side sheet 522 as a single body. That is, the first side sheet 521, the second side sheet 522, and the connection unit 523 may be provided as a single body through casting.

Also, a third side sheet 524 may be included to fix one of the brake unit 610 and a gear unit 710. The third side sheet 524 may be fixed to the first side sheet 521 and may have a hexahedral shape to include the gear unit 710. However, regardless of the shape, when it satisfies fixing one of the brake unit 610 and the gear unit 710, the third side sheet 524 may be formed together with the first side sheet 521 as a single body.

As shown in FIG. 10, the plurality of wheels 510 may be installed to be rotatable by shafts 511 fixed to the first side sheet 521 and the second side sheet 522. Also, the respective wheels 510 may be supported by a bearing 512 installed thereinside to smoothly rotate around outsides of the shafts 511.

Hereinafter, referring to FIGS. 11 to 13, the brake unit 610 of the trolley 500 according to the second embodiment of the present invention will be described in detail.

The brake unit 610 is a device for fixing the wheels 510 which move on the rail 10 and includes brake plates 611, brake pads 612, and displays 614.

The brake plate 611 is a member in a plate shape having a certain thickness and a bottom thereof is coupled with an input shaft 711. Accordingly, when the input shaft 711 rotates due to a handle unit 800, the brake plate 611 circles around the input shaft 711. The brake plate 611 may be coupled with the brake pad 612 on one side.

The brake pad 612 is in contact with an outside of the wheel 510 and fixes the trolley 500, which may be coupled with one side of the brake plate 611. The brake pad 612 is vertically coupled with inner one end of the brake plate 611 and may be in contact with or separated from the wheel 510 depending on rotation of the brake plate 611. One side of the brake pad 612 may be fixed to the brake plate 611 and the other side thereof may be in contact with wheel 510.

The brake pad 612 may be formed as an elastic body elastically restorable. For example, the brake pad 612 may be formed of elastic rubber. However, the brake pad 612 is not limited to the rubber and may be modified using other elastic materials.

The brake pad 612 may have an indented surface 615 in contact with the wheel 510. Accordingly, when the brake pad 612 is in contact with the wheel 510, the brake pad 612 may be completely close to the outside of the wheel 510 and may fix the wheel 510 moving along the rail 10.

Also, a protrusion (not shown) may be formed on one side of the brake pad 612. The protrusion is formed on a bottom of the brake pad 612. That is, the brake pad 612 may have a shape in which the bottom more protrudes than a top. The protrusion is interposed between the wheel 510 and the rail 10 when the brake pad 612 is in contact with the wheel 510. Accordingly, the wheel 510 may be completely fixed by the protrusion. Also, since the protrusion functions as a wedge, it is possible to prevent the wheel 510 from being pushed back.

Meanwhile, the display 614 may be formed on the one side of the brake plate 611. The display 614 allows checking whether the trolley 500 is fixed and may be formed on the one end of the brake plate 611. The display 614 may be easily distinguished using a method of painting an inner side and outer side using mutually different colors. Accordingly, when viewed from below the trolley 500, it may be easily checked whether the trolley 500 is fixed. For example, when the brake pad 612 is in contact with the wheel 510, since the display 614 may protrude from the outside of the body unit 520, it may be checked that the trolley 500 is fixed to the rail 10. On the contrary, when the brake pad 612 is separated from the wheel 510, since the display 614 may not protrude from the outside of the body unit 520, it may be checked that the trolley 500 is not fixed to the rail 10.

The display 614 may longitudinally extend from the one end of the brake plate 611. However, the display 614 is not limited to longitudinal extension from the brake plate 611 but may be modified as various structures. For example, the display 614 may vertically extend from the brake plate 611.

The brake unit 610 operates due to the input shaft 711 as described above. The gear unit 710 may be provided between the brake unit 610 and the handle unit 800 which inputs a rotational force for rotating the input shaft 711. Referring to FIG. 12, a process in which the brake unit 610 operates through the gear unit 710 will be described. In the trolley 500 according to the second embodiment of the present invention, two wheels 510*a* and 510*b* are fixed to the first side sheet 521. Accordingly, the brake unit 610 brakes both the two wheels 510*a* and 510*b*, thereby obtaining a more excellent brake effect than braking only one wheel 510. For this, it is necessary not only to operate a brake plate 611*a* connected to the input shaft 711 to brake the wheel 510*a* in the front but also to operate a brake plate 611*b* to brake the wheel 510*b* in the rear. As described above, the gear unit 710 is necessary to operate the brake plates 611*a* and 611*b* at mutually different positions at the same time.

The brake plate 611*a* in the front is connected to the input shaft 711 through a connection member 613*a* and rotates at the same time as the input shaft 711 rotates. To operate the brake plate 611*b* in the rear at the same time, a bevel gear body may be used. A first gear 712 rotates together with the input shaft 711, and a second gear 713 which gears into the first gear 712 and converts a rotation-axial direction is connected to a third gear 715 through a connection shaft 714. A fourth gear 716 may gear into the third gear 715 and may convert a rotation-axial direction. The first gear 712, the second gear 713, the third gear 715, and the fourth gear 716 may be formed of mutual bevel gear bodies. The fourth gear 716 rotates a fourth gear shaft 717. The fourth gear shaft 717 is connected to the brake plate 611*b* in the rear through a connection member 613*b* to rotate the brake plate 611*b*. As a result, one rotation of the input shaft 711 changes in a rotational direction through the gear unit 710 and rotates the two brake plates 611*a* and 611*b*, thereby pressing or rubbing brake pads 612*a* and 612*b* coupled with both the brake plates 611*a* and 611*b* toward or against the wheels 510*a* and 510*b* to brake the trolley 500.

Next, referring to FIGS. 14 and 15, a trolley 501 according to a third embodiment of the present invention will be described. Since a description of the wheels 510, the body unit 520, and the hanging unit 530 is identical to that of the trolley 500 according to the second embodiment of the present invention, it will be omitted.

Figure 14:
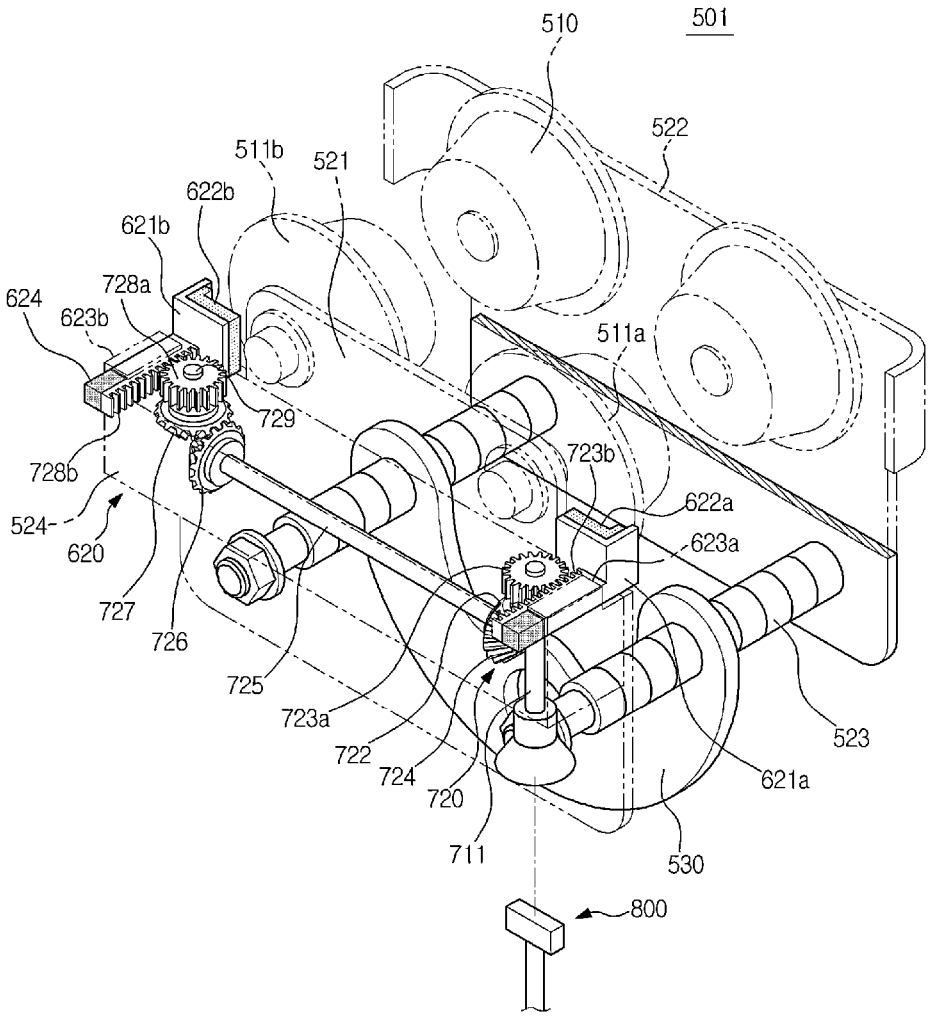
FIG. 14 is a perspective view of a brake unit of a trolley according to a third embodiment of the present invention.
Figure 15:
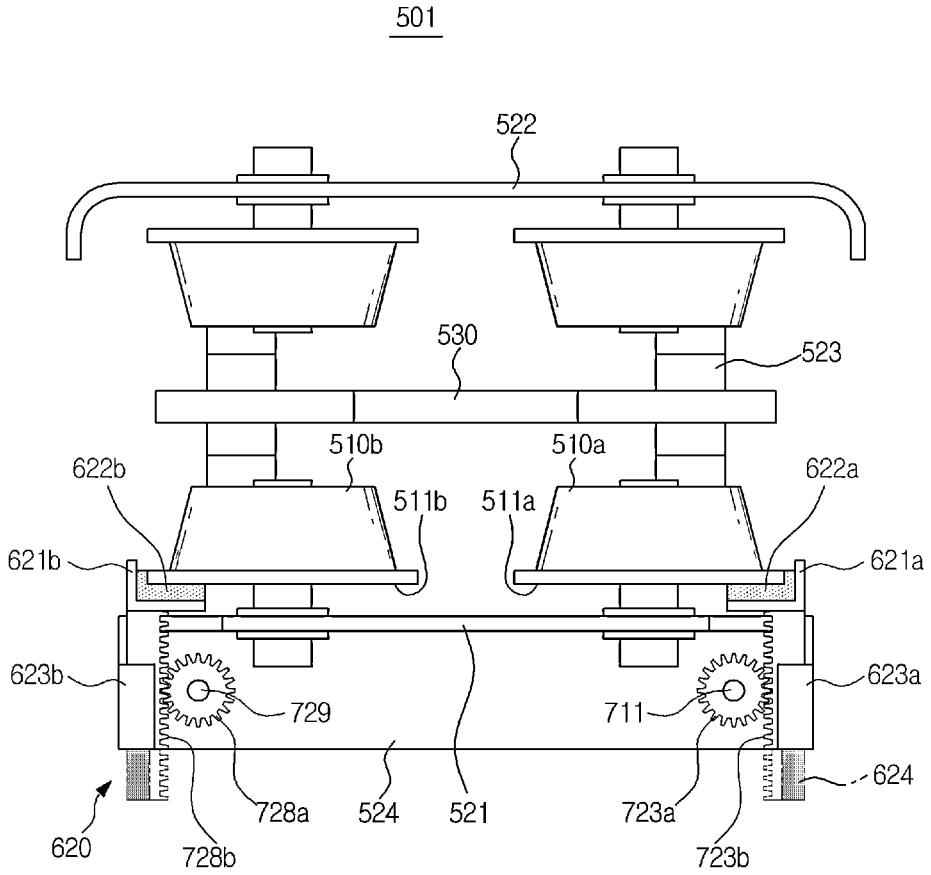
FIG. 15 is a plan view of the brake unit shown in FIG. 14, which illustrates an operation of the brake unit.

FIG. 14 is a perspective view of a brake unit of the trolley according to the third embodiment of the present invention. FIG. 15 is a plan view of the brake unit shown in FIG. 14, which illustrates an operation of the brake unit.

A brake unit 620 is a device for fixing the wheels 510 which move on the rail 10 and includes brake plates 621, brake pads 622, and displays 624.

The brake plate 621 has a certain thickness and may have one of a plate shape to pressurize wheel sides 511 and a curved shape to pressurize the wheel sides 511 and corners at the same time. FIG. 14 illustrates the brake plate 621 which has the curved shape. Also, the brake plate 621 is connected to the input shaft 711 and located to perform translation in a lateral direction of the wheel 510. Accordingly, when the input shaft 711 rotates due to the handle unit 800, the rotation of the input shaft 711 is converted into the translation due to a gear unit 720. Guide members 623 may be provided to allow the brake plates 621 to slide in one direction. The guide members 623 may be fixed to the third side sheet 524.

The brake plate 621 may be coupled with the brake pad 622 on one side. The brake pad 622 is in contact with the outside of the wheel 510 and fixes the trolley 501, which may be coupled with the one side of the brake plate 621. The brake pad 622 is coupled with inner one end of the brake plate 621 and may be in contact with or separate from the wheel 510 depending on the sliding of the brake plate 621. One side of the brake pad 622 may be fixed to the brake plate 621 and the other side thereof may be in contact with wheel 510.

The brake pad 622 may be formed as an elastic body elastically restorable. For example, the brake pad 622 may be formed of elastic rubber. However, the brake pad 622 is not limited to the rubber and may be modified using other elastic materials.

Meanwhile, the display 624 may be formed on the one side of the brake plate 621. The display 624 allows checking whether the trolley 501 is fixed and may be formed on the one end of the brake plate 621. The display 624 may be easily distinguished using a method of painting an inner side and outer side using mutually different colors. Accordingly, when viewed from below the trolley 501, it may be easily checked whether the trolley 501 is fixed. For example, when the brake pad 622 is in contact with the wheel 510, since the display 624 does not protrude from the outside of the body unit 520, it may be checked that the trolley 501 is not fixed to the rail 10. On the contrary, when the brake pad 622 is separated from the wheel 510, since the display 624 protrudes from the outside of the body unit 520, it may be checked that the trolley 501 is fixed to the rail 10.

The display 624 may longitudinally extend from the one end of the brake plate 621. However, the display 624 is not limited to longitudinal extension from the brake plate 621 but may be modified as various structures. For example, the display 624 may vertically extend from the brake plate 621.

A process in which the brake unit 620 performs translation due to the rotation of the input shaft 711 will be described. The input shaft 711 is connected to a pinion gear 723*a*, and the pinion gear 723*a* rotates together with the rotation of the input shaft 711 at the same time. A brake plate 621*a* is connected to a rack gear 723*b* which gears into the pinion gear 723*a* and then performs translation due to the pinion gear 723*a* which rotates. Here, the translation is guided by a guide member 623*a* in one direction.

The gear unit 720 may be provided between the brake unit 620 and the handle unit 800. Referring to FIG. 14, a process in which the brake unit 620 operates through the gear unit 720 will be described. In the trolley 501 according to the third embodiment of the present invention, the two wheels 510*a* and 510*b* are fixed to the first side sheet 521. Accordingly, the brake unit 620 brakes both the two wheels 510*a* and 510*b*, thereby obtaining a more excellent brake effect than braking only one wheel 510. For this, it is necessary not only to operate the brake plate 621*a* connected to the input shaft 711 to brake the wheel 510*a* in the front but also to operate a brake plate 621*b* to brake the wheel 510*b* in the rear. As described above, the gear unit 720 is necessary to operate the brake plates 621*a* and 621*b* at mutually different positions at the same time.

Since the brake plate 621*a* in the front is connected to the pinion gear 723*a* connected to the input shaft 711 through the rack gear 723*b* which gears into the pinion gear 723*a*, the brake plate 621*a* performs translation at the same time when the input shaft 711 rotates. To operate the brake plate 621*b* in the rear at the same time, a bevel gear body may be used. A first gear 722 rotates together with the input shaft 711, and a second gear 724 which gears into the first gear 722 and converts a rotation-axial direction is connected to a third gear 726 through a connection shaft 725. A fourth gear 727 may gear into the third gear 726 and may convert a rotation-axial direction. The first gear 722, the second gear 724, the third gear 726, and the fourth gear 727 may be formed of mutual bevel gear bodies. The fourth gear 727 rotates a fourth gear shaft 729. Since the fourth gear shaft 729 is connected to a pinion gear 728*a*, the pinion gear 728*a* is rotated. The brake plate 621*b* coupled with a rack gear 728*b* which gears into the pinion gear 728*a* applies or releases pressure to or from the wheel 510*b* while performing translation together with the rack gear 728*b*. Here, the translation may be guided by a guide member 623*b* in one direction.

As a result, one rotation of the input shaft 711 changes in a rotational direction through the gear unit 720 and rotates the two brake plates 621*a* and 621*b*, thereby pressing or rubbing brake pads 622*a* and 622*b* coupled with both the brake plates 621*a* and 621*b* toward or against the wheels 510*a* and 510*b* to brake the trolley 501.

Figure 16:
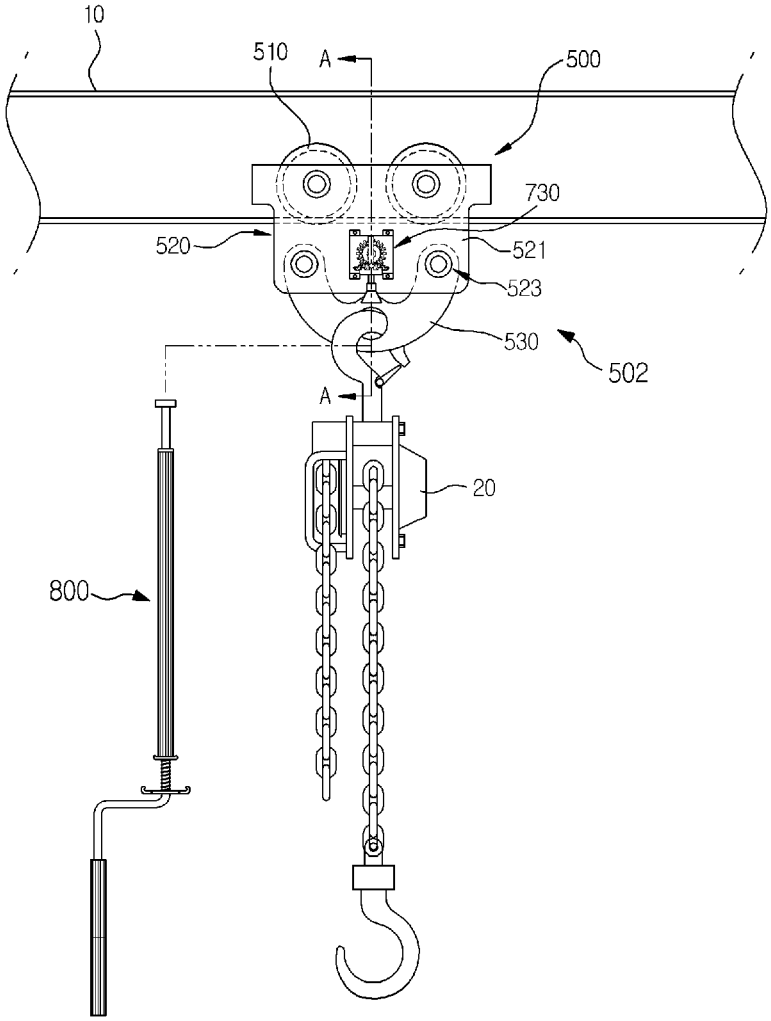
FIG. 16 is a side view illustrating a state in which a trolley according to a fourth embodiment of the present invention is installed on a rail.
Figure 17:
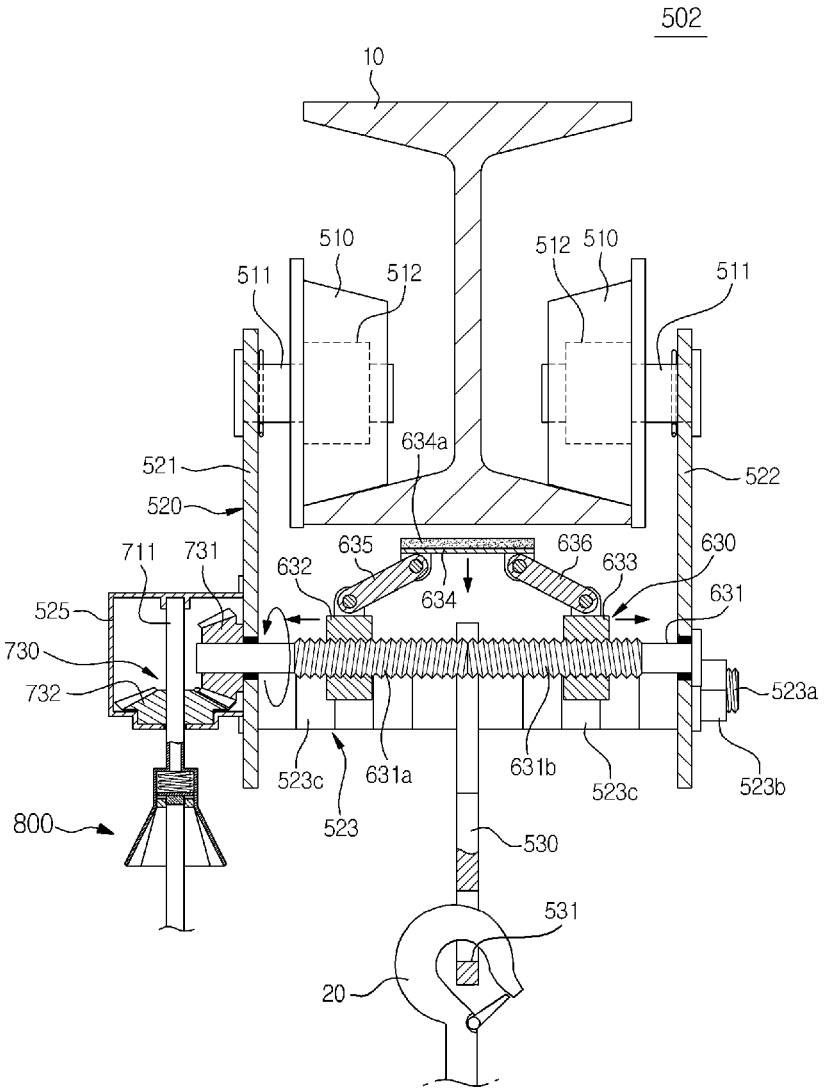
FIG. 17 is a cross-sectional view illustrating a portion taken along line A-A in FIG. 16, which illustrates a brake release state.
Figure 18:
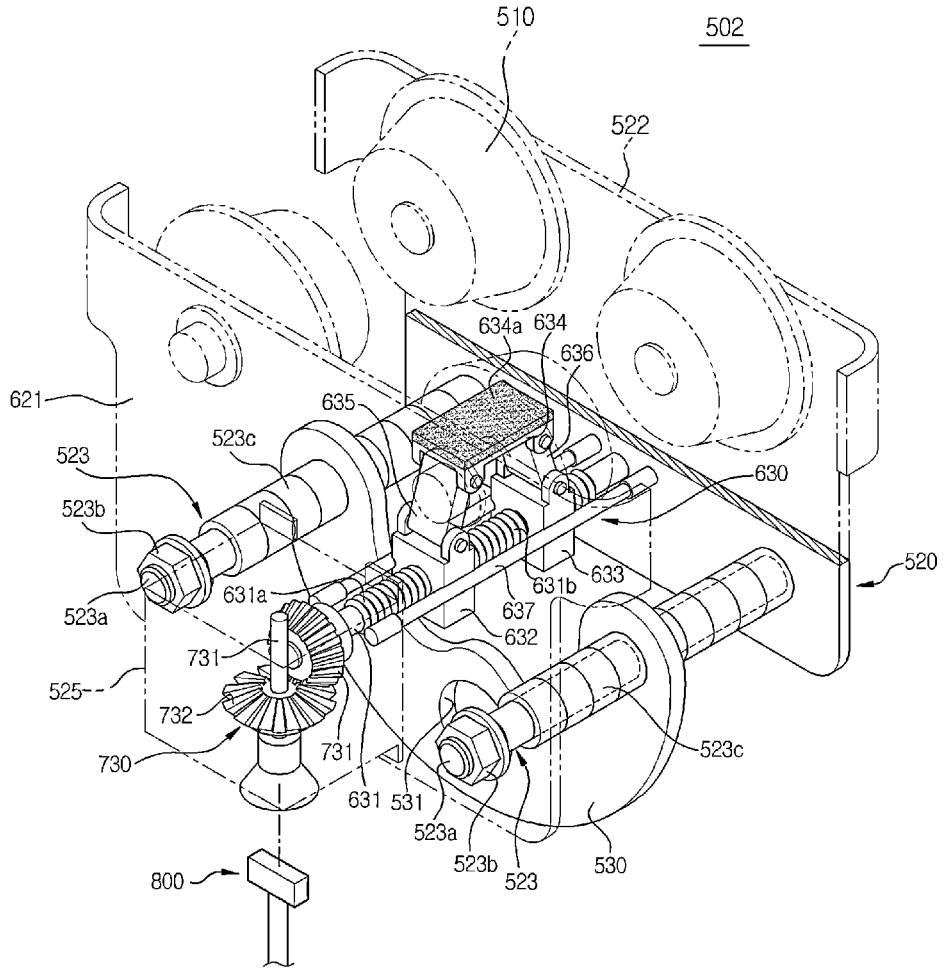
FIG. 18 is a perspective view of a brake unit of the trolley according to the fourth embodiment of the present invention.
Figure 19:
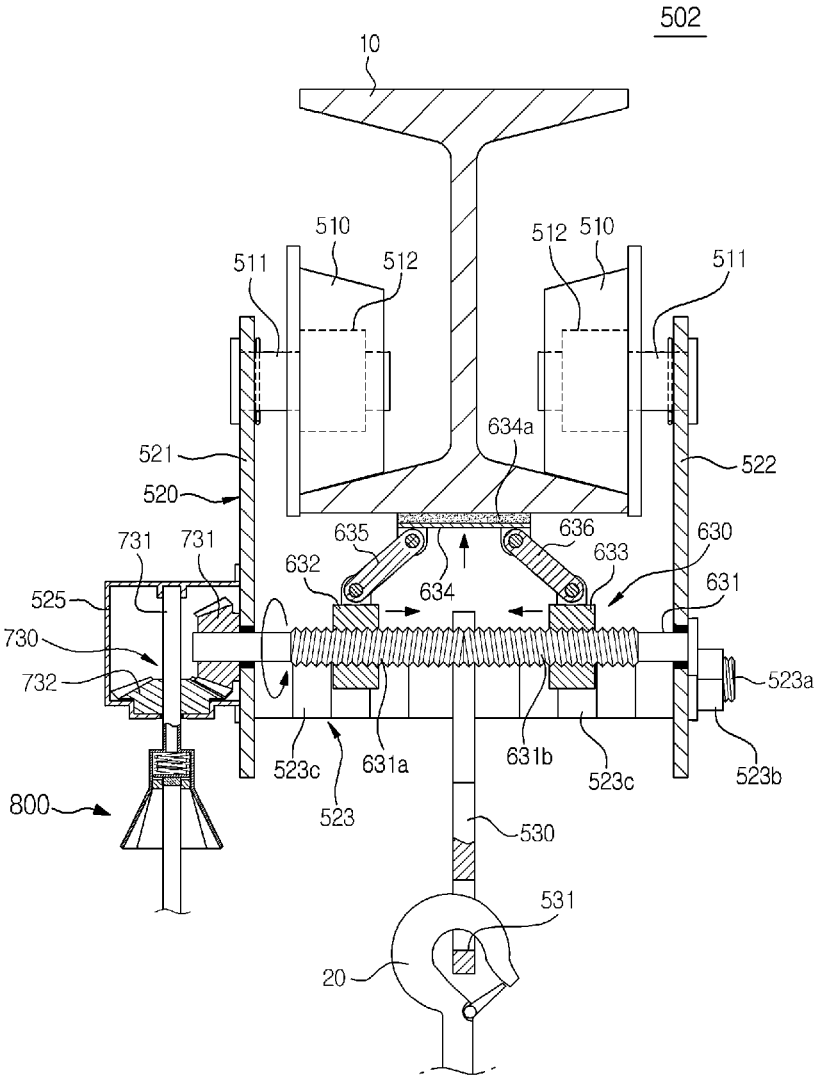
FIG. 19 illustrates a braking state of the brake unit shown in FIG. 17.

Next, referring to FIGS. 16 to 19, a trolley 502 according to a fourth embodiment of the present invention will be described. FIG. 16 is a side view illustrating a state in which the trolley 502 according to the fourth embodiment of the present invention is installed on the rail. FIG. 17 is a cross-sectional view illustrating a portion taken along line A-A in FIG. 16, which illustrates a brake release state. FIG. 18 is a perspective view of a brake unit of the trolley according to the fourth embodiment of the present invention. FIG. 19 illustrates a braking state of the brake unit shown in FIG. 17.

A brake unit 630, as shown in FIGS. 17 and 18, includes a screw shaft 631 rotatably installed in a bottom of the body unit 520 and a pressurizing unit which puts a brake by applying or releasing pressure to or from a bottom surface of the rail 10 while ascending due to a rotation operation of the screw shaft 631.

The screw shaft 631, as shown in FIG. 18, may be disposed between two supporting rods 523*a* which connect the first side sheet 521 with the second side sheet 522 parallel to the supporting rods 523*a*. Both ends of the screw shaft 631 are rotatably supported by the first and second side sheets 521 and 522 while penetrating through the first side sheet 521 and the second side sheet 522 and include a left screw portion 631*a* and a right screw portion 631*b*.

The pressurizing unit includes a first moving member 632 and a second moving member 633 coupled with the left screw portion 631*a* and the right screw portion 631*b* of the screw shaft 631, respectively, a pressurizing member 634 disposed below the rail 10 above the screw shaft 631 and provided as an approximately plate shape, a first connection link 635 which connects one side of the pressurizing member 634 with the first moving member 632, and a second connection link 636 which connects the other side of the pressurizing member 634 with the second moving member 633.

Both ends of the first connection link 635 are rotatably coupled with the pressurizing member 634 and the first moving member 632, respectively. In the same way, the second connection link 636 connects the second moving member 633 with the pressurizing member 634. A friction pad 544*a* may be attached to a top surface of the pressurizing member 634 which is in contact with the rail 10 to increase a frictional force. The friction pad 544*a* may be formed of a material having a great frictional force such as rubber, silicone, and leather. Also, the pressurizing unit, as shown in FIG. 18, may include a guide bar 637 which guides movement while restricting rotations of the first moving member 632 and the second moving member 633. The guide bar 637 may be disposed parallel to the screw shaft 631 while being in contact with the first and second moving members 632 and 633, and both ends thereof may be fixed to the first side sheet 521 and the second side sheet 522.

In the brake unit 630 described above, the first moving member 632 and the second moving member 633 move in two opposite directions due to the rotation of the screw shaft 631 in such a way that the first and second connection links 635 and 636 push up or drag down the pressurizing member 634 to allow the pressurizing member 634 to ascend or descend. Also, the pressurizing member 634 may put a brake by pressurizing the bottom surface of the rail 10 through ascending as shown in FIG. 19 and may release the brake through separation from the bottom surface of the rail 10 as shown in FIG. 17.

Also, the trolley 502 according to the fourth embodiment of the present invention, as shown in FIGS. 16 and 17, includes the handle unit 800 for the worker to manually rotate the screw shaft 631 at a position separate from the body unit 520 installed on the rail 10 and a gear unit 730 installed in the body unit 520 to transfer the rotation of the handle unit 800 to the screw shaft 631.

The gear unit 730, as shown in FIG. 17, includes a driven bevel gear 731 coupled with one end of the screw shaft 631 which extends from the second side sheet 522 and a driving bevel gear 732 which gears into the driven bevel gear 731 and is driven by the input shaft 711. Also, the body unit 520 may include a fourth side sheet 525 which is coupled with the second side sheet 522 and rotatably supports the input shaft 711 which is a shaft of the driving bevel gear 732 while accommodating the driven bevel gear 731 and the driving bevel gear 732.

Figure 20:
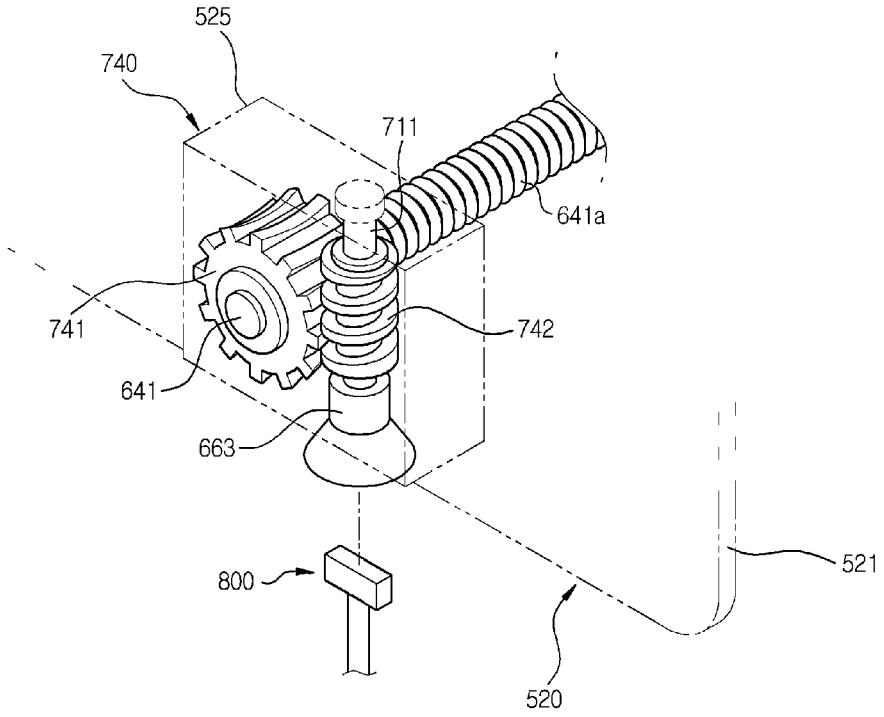
FIG. 20 is a perspective view illustrating a state in which a bevel gear body shown in FIG. 18 is converted into a worm gear body.

A gear unit according to the embodiments of the present invention is not limited to a bevel gear body. FIG. 20 is a perspective view illustrating a state in which a bevel gear body is converted into a worm gear body.

A gear unit 740 of FIG. 20 includes a worm gear 742 provided on the input shaft 711 which transfers a rotational force due to the handle unit 800 and a worm wheel 741 which gears into the worm gear 742 and is coupled with a screw shaft 641. Also, the body unit 520 includes the fourth side sheet 525 which accommodates and rotatably supports the worm gear 742 and the worm wheel 741 while being coupled with the first side sheet 521.

In the gear unit 740 of FIG. 20, when the worm gear 742 is rotated by the handle unit 800 while being in contact with the handle unit 800, the worm wheel 741 may rotate to rotate the screw shaft 641 forward and backward and a brake may be put or released by an operation of the screw shaft 641. Since the gear unit 740 prevents the rotation of the screw shaft 641 from being reversely transferred (toward an operation handle), it is possible to stably maintain a braking state or a brake releasing state.

Figure 21:
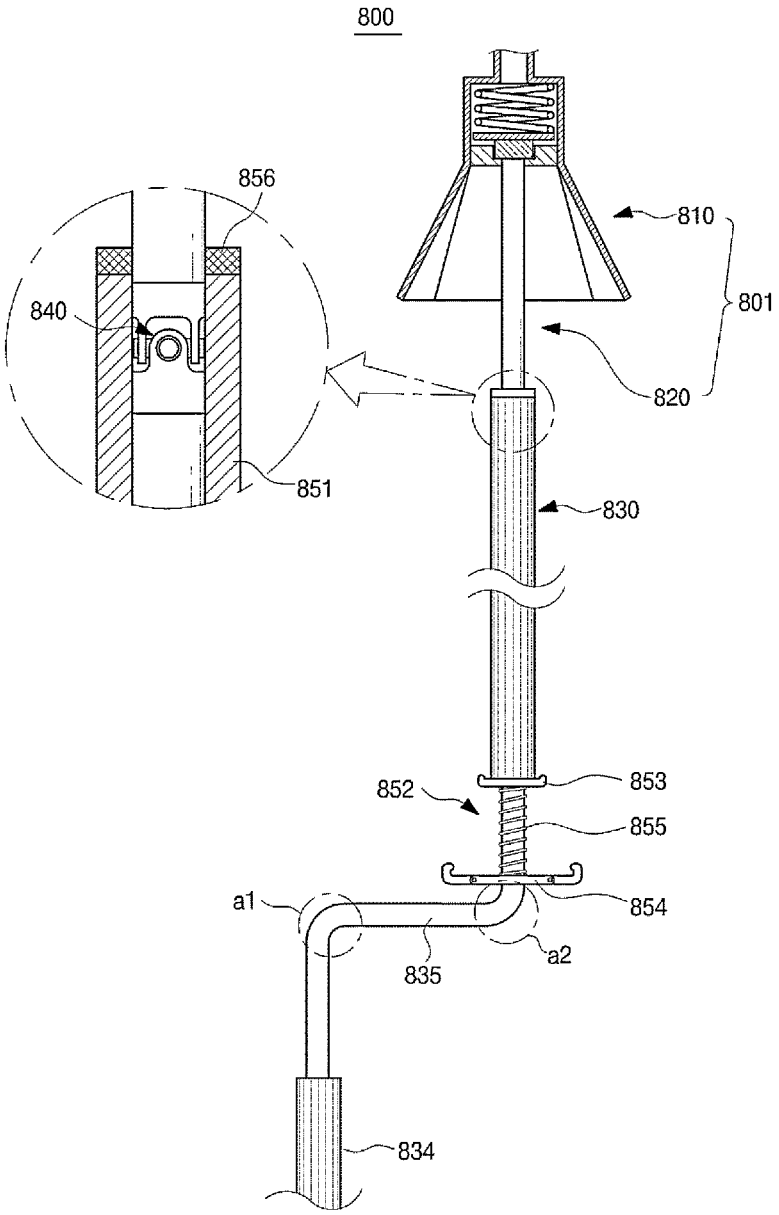
FIG. 21 is a view illustrating a state of a handle unit of the trolley according to the second embodiment of the present invention before bending.
Figure 22:
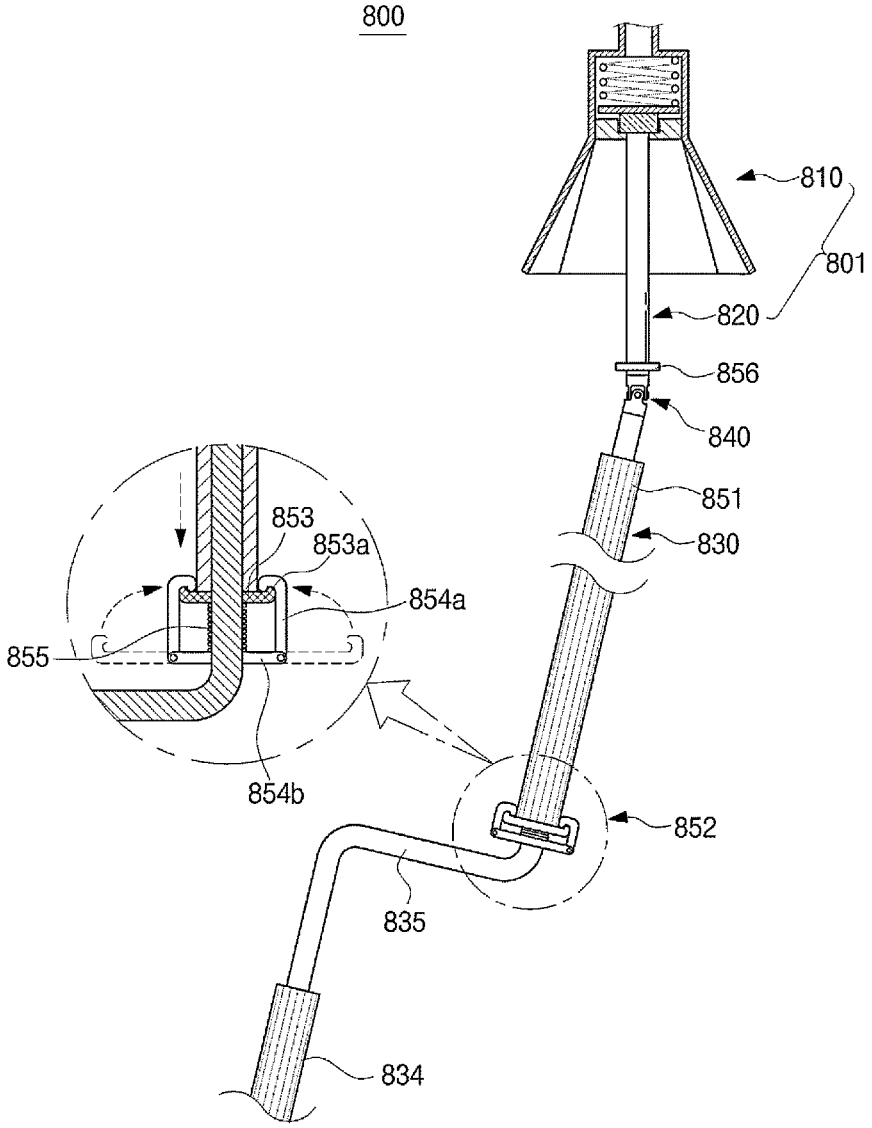
FIG. 22 illustrates a state of the handle unit shown in FIG. 21 after bending.

Next, the handle unit 800 of the trolley 500 according to the second embodiment of the present invention will be described. FIG. 21 is a view illustrating a state of the handle unit of the trolley according to the second embodiment of the present invention before bending. FIG. 22 illustrates a state of the handle unit shown in FIG. 21 after bending.

As shown in FIG. 9, since it is necessary to connect the handle unit 800 to the gear unit 710 of the trolley 500 located higher than a working place of the worker, the handle unit 800 may be provided as a long bar. Since a brake unit of a general trolley is operated using chains, the worker works while pulling the chains which droop. However, this method needs a great force and the safety of the worker is threatened by swinging chains. The trolley 500 according to the present embodiment may operate the brake unit 610 while removing chains. Chains rotate a shaft through a dragging force of the worker. On the other hand, in the case of the handle unit 800, the worker rotates a shaft to transfer a driving force to the gear unit 710. Here, to allow the shaft to easily rotate, as shown in FIG. 21, an end of the handle unit 800 may be bent twice at a1 and a2 to allow the user to easily input a rotational force. The method of inputting a rotational force described above, compared with a general method of using chains, may more easily and safely provide the driving force with less force. Also, as a length of a connection portion 835 which connects a handle 834 with a handle bar 830 increases, a greater force may be provided. As the length decreases, rotation may be performed at a high speed.

The handle unit 800 is basically for operating the brake unit 610 but may be used by the worker to move the trolley 500. That is, the worker may grip the handle unit 800 and may provide a pull or push to move the trolley 500 on the rail 10. The handle unit 800 is connected to the input shaft 711 of the gear unit 710. When the worker applies a force to the handle unit 800 to move the trolley 500, the handle unit 800 having a long bar shape applies torque to the input shaft 711. The torque described above may cause a damage of the input shaft 711 as fatigue accumulates.

Accordingly, the handle unit 800 may include bent portions 831 and 840. The bent portions 831 and 840 include portions which are bent or folded by a joint. Hereinafter, to avoid confusion, a bent portion which is crooked is referred to as a crooked portion 831 (refer to FIG. 23) and a bent portion which is bent by a joint is referred to as a joint portion 840 (refer to FIG. 21). Also, unless there is a particular reason, a description for the joint portion 840 may be also applied to the crooked portion 831. Torque is proportional to a length from the input shaft 711 (refer to FIG. 20) to a bent portion. Accordingly, when the length between the input shaft 711 and the bent portion decreases, the torque decreases and fatigue applied to the input shaft 711 is reduced. Also, the worker may pull the trolley 500 using the handle unit 800 which is bent and inclined due to the joint portion 840 in a proceeding direction, thereby easily moving the trolley 500 which hangs a heavy object.

The joint portion 840 of the handle unit 800 may be used even when an obstacle exists in the proceeding direction. Particularly, when a multidirectional joint portion using a universal joint is included, it is possible to proceed while avoiding the obstacle through all spaces.

Also, since the handle unit 800 includes connection portions 810 and 820, it is possible to separate the handle unit 800 from the gear unit 710 when the trolley 500 does not operate. Accordingly, the handle unit 800 which may acts as a risk factor in movement of the worker may be temporarily removed and it is possible to make an external appearance of the inside of a vessel aesthetic. Since a general trolley is driven using chains or a brake unit is operated, it is necessary to always hang chains to be within a worker's reach. The chains described above act as a risk factor to the worker due to swinging caused by pitching of the vessel. Since it is impossible to remove the general trolley while being not used for a long time, aesthetic thereof is spoiled and there are present risk factors.

The joint portion 840 may be located closer to or farther from the body unit 520 than the connection portions 810 and 820. In the trolley 500 of FIG. 9, the connection portions 810 and 820 are located above the joint portion 840. However, even when changed therefrom, it will be included in the embodiments of the present invention.

The handle unit 800 in FIG. 21 includes the first connection portion 810 connected to the input shaft 711. The handle unit 800 includes the second connection portion 820 coupled with the first connection portion 810 and the handle bar 830 which includes the joint portion 840 for bending.

To easily couple the first connection portion 810 with the second connection portion 820, a guide portion 813 which may guide the second connection portion 820 to the first connection portion 810 may be included. The guide portion 813 may be provided on an end of the first connection portion 810 and may have a shape whose opening becomes greater toward an end thereof.

The handle unit 800 may include a folding preventing portion capable of preventing the joint portion 840 from being folded. When the joint portion 840 is located below the second connection portion 820, since the joint portion 840 is folded while being connected to the first connection portion 810, a connection process may be not easy. The folding preventing portion prevents the joint portion 840 from being folded during the connection process and may include a cover member 851 which is provided throughout the handle bar 830 to at least partially surround a peripheral part of the joint portion 840 and able to slidably move along the handle bar 830. When the cover member 851 slidably moves toward the second connection portion 820, since the periphery of the joint portion 840 is at least partially surrounded, it is possible to prevent the joint portion 840 from being folded.

Also, an elastic supporting portion 852 which is provided on the handle bar 830 and applies an elastic force to the cover member 851 to return to an original position when the cover member 851 moves downward to expose the joint portion 840 may be included. The elastic supporting portion 852 supports a bottom end of the cover member 851 to allow the cover member 851 which moves downward to return to the original position. Also, a restrictive portion 856 which is provided on one of a bottom end of the second connection portion 820 and a top end of the handle bar 830 and ties a top end of the cover member 851 to restrict an upward movement of the cover member 851 may be provided.

Here, the elastic supporting portion 852 may include a bottom supporting portion 853 which supports the bottom end of the cover member 851 and includes a locking protrusion 853*a* on a top thereof, a fixing member 854*b* which is provided below the bottom supporting portion 853 and includes a spring member 855 having a restoring force between the fixing member 854*b* and the bottom supporting portion 853, and a locking clip 854*a* which is pivotably provided on the fixing member 854*b* and is fastened to the locking protrusion 853*a* while the cover member 851 is moving downward. The locking clip 854*a* may have an end curved once or more to be hung on the locking protrusion 853*a*.

As shown in FIG. 22, a user may connect the handle unit 800 to the first connection portion 810, may move the cover member 851 downward to completely expose the joint portion 840, and then may operate rotation of the handle unit 800 at a slant angle. That is, when the joint portion 840 is surrounded by the cover member 851, the second connection portion 820 and the handle bar 830 of the handle unit 800 are kept upright, thereby being easily connected to the first connection portion 810. Also, after the handle unit 800 is connected to the first connection portion 810, the cover member 851 is pulled and moved downward to completely expose the joint portion 840 to bend the handle unit 800. Accordingly, the user may transfer the rotation of the handle unit 800 to the input shaft 711 at the slant angle to put or release a brake. Here, while the cover member 851 which is pulled is being fixed by fastening the locking clip 854*a* to the locking protrusion 853*a* of the cover member 851, a rotation operation may be performed by the handle unit 800.

Meanwhile, as described above, the handle unit 800 may be connected to the first connection portion 810 connected to the gear unit 710 when it is necessary to use the trolley 500. As described above, when the user rotates the handle unit 800 while the handle unit 800 is being connected, the input shaft 711 connected to the first connection portion 810 is rotated. Accordingly, the user may rotate the input shaft 711 forward or backward by rotating the handle unit 800 forward or backward, thereby operating the brake unit to put or release a brake.

Figure 23:
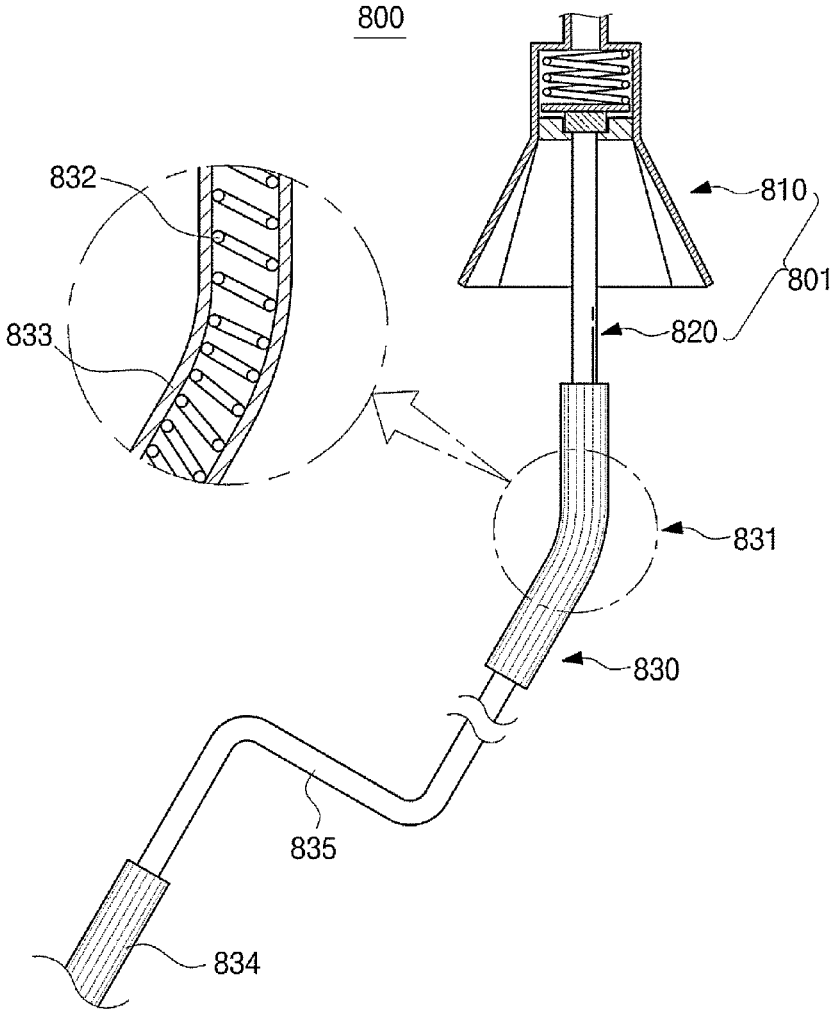
FIG. 23 is a view illustrating a state of the handle unit shown in FIG. 21 according to another embodiment of the present invention after bending.

Next, referring to FIG. 23, an example of a handle unit which differs from the handle unit of FIG. 21 according to another embodiment of the present invention will be described. FIG. 23 is a view illustrating a state of the handle unit shown in FIG. 21 according to another embodiment of the present invention after bending.

The handle unit 800 includes the first connection portion 810 connected to the input shaft 711. The handle unit 800 includes the second connection portion 820 coupled with the first connection portion 810 and the handle bar 830 which is connected to the second connection portion 820 through the crooked portion 831 and bent once or more. Hereinafter, bending means being bent at a certain angle and curved, which may be defined as a term including all cases of bending deformation from an upright state.

The crooked portion 831 described above, as shown in a partially enlarged portion in FIG. 23, may include an elastic member 832 and an elastic cover 833 in which the elastic member 832 is inserted. For example, the elastic member 832 may include a material having an elastic force such as a spring, rubber, and plastic. The elastic cover 833 may also include a material having an elastic force such as rubber and plastic.

Accordingly, as shown in FIG. 23, after the handle unit 800 is connected to the first connection portion 810, rotation of the handle unit 800 is transferred to the input shaft 711 even at a slant angle using the handle unit 800 provided to be bendable, thereby putting or releasing a brake.

Next, a method of using the trolley 500 according to the second embodiment of the present invention will be described.

When to transfer a heavy object using the trolley 500, as shown in FIG. 9, the winding device 20 such as a chain block may be hung on the hanging unit 530 to be installed and it is possible to lift the heavy object using the winding device 20.

The user may move the heavy object together with the trolley 500 in a desirable direction though pushing or pulling the heavy object or pushing or pulling the handle unit 800 in this state. In this case, the brake of the brake unit 610 is released.

After the user transfers the trolley 500 to a desirable position or when to stop the trolley 500 at a present position, the movement of the body unit 520 may be restricted using the brake unit 610. That is, after the handle unit 800 is connected to the first connection portion 810 of the gear unit 710, as shown in FIG. 13, the user rotates the input shaft 711 using the handle unit 800, thereby rotating the brake plate 611 to compress the brake pad 612 to the wheel 510. Through this, the brake of the trolley 500 may be performed.

When the brake is performed as described above, since the brake pad 612 attached to the one side of the brake plate 611 compresses the wheel 510 (refer to FIGS. 9 to 15 for the trolley according to one of the second embodiment and third embodiment of the present invention) or a friction pad 634*a* attached to the top surface of the pressurizing member 634 compresses the bottom surface of the rail 10 (refer to FIGS. 16 to 19 for the trolley according to the fourth embodiment of the present invention), it is possible to maintain a stable braking state. Also, since the user may separate the handle unit 800 from the first connection portion 810 of the gear unit 710 and may separately store the handle unit 800 after braking, it is possible to maintain a simple peripheral structure of the trolley 500 and to provide an aesthetic external appearance.

To release the brake of the trolley 500, the handle unit 800 is connected to the first connection portion 810 of the gear unit 710 again and the brake unit 610 is reversely operated, thereby easily releasing the brake.

Figure 24:
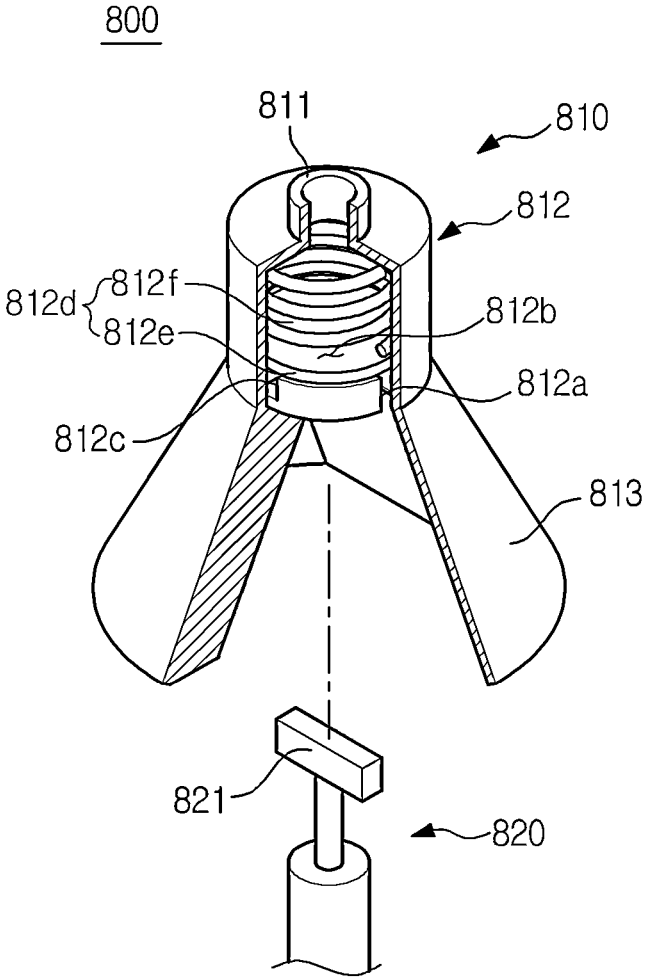
FIG. 24 is a perspective view illustrating a state of connection portions of the trolley according to the second embodiment of the present invention before being coupled.
Figure 25:
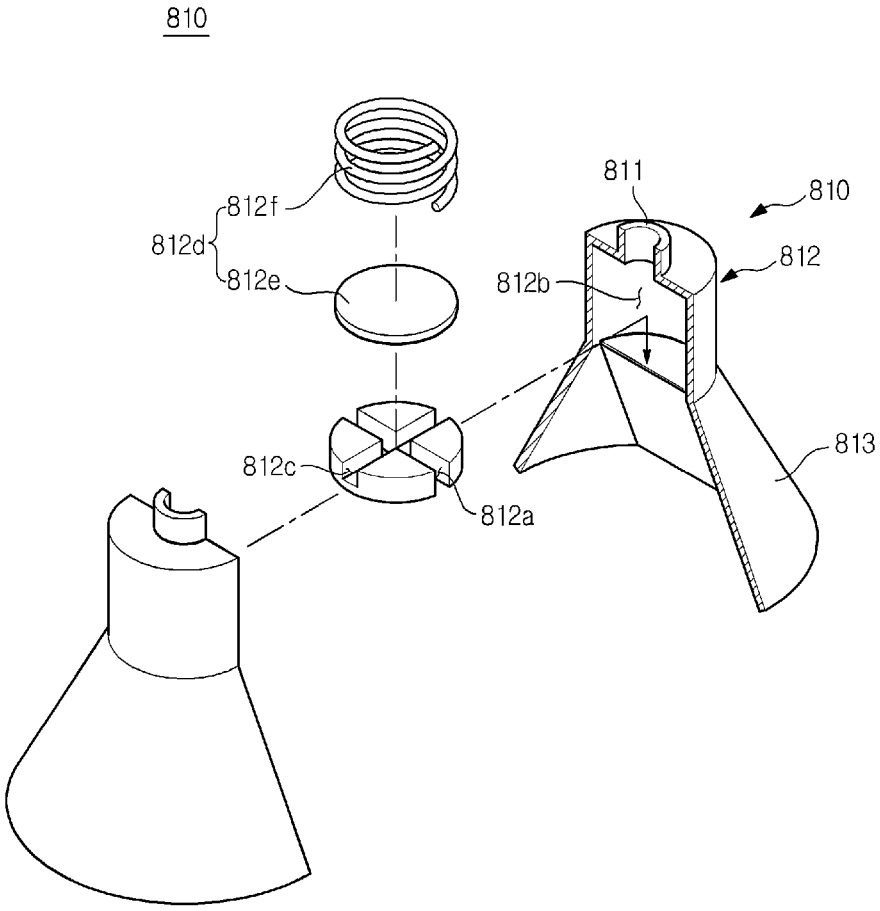
FIG. 25 is an exploded perspective view illustrating the connection portion of FIG. 24.
Figure 26:
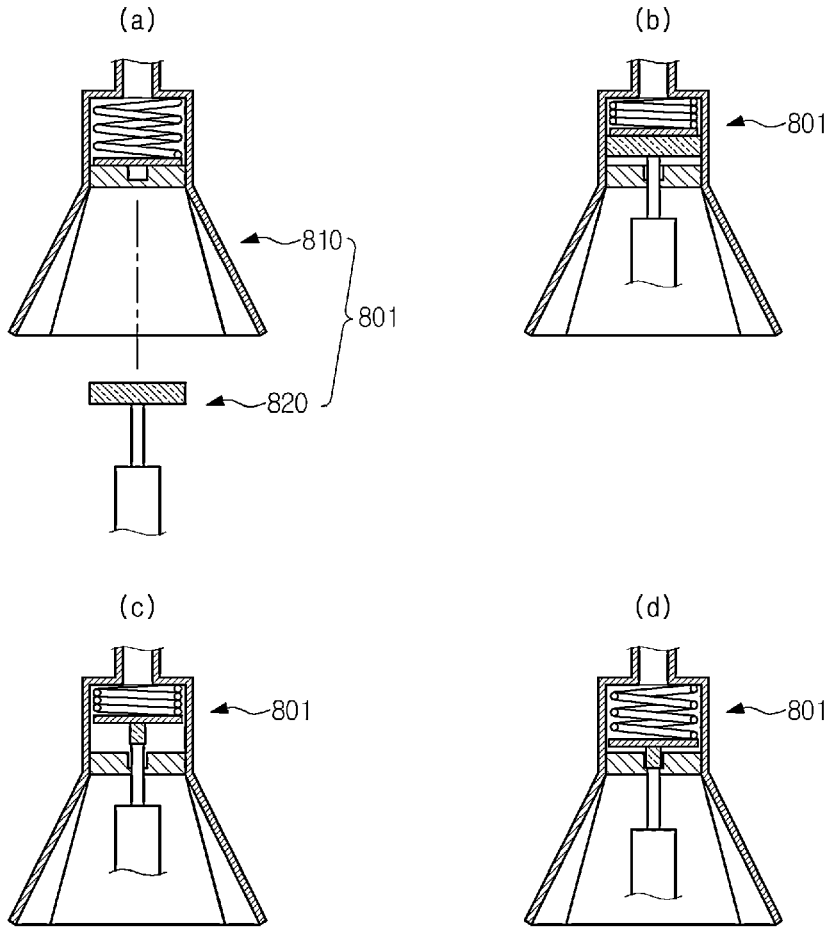
FIG. 26 illustrates a coupling state of the connection portions, in which (a) illustrates a state before inserting an insertion protrusion, (b) illustrates a state in which the insertion protrusion is inserted into a through groove, (c) illustrates a state in which the insertion protrusion rotates 90 degrees inside an insertion space, and (d) is a cross-sectional view illustrating a state in which the insertion protrusion is mounted on a mounting groove.

Next, referring to FIGS. 24 to 26, the connection portion 810, 820 of the handle unit 800 will be described in detail. FIG. 24 is a perspective view illustrating a state of the connection portion of the trolley according to the second embodiment of the present invention before being coupled. FIG. 25 is an exploded perspective view illustrating the connection portion of FIG. 24.

The handle unit 800 may include the first connection portion 810 connected to the gear unit 710 and the second connection portion 820 connected to the first connection portion 810. Since the second connection portion 820 is connected to the handle bar 830 to which the worker applies a rotational force, and the first connection portion 810 and the second connection portion 820 are inserted to be separable and to transfer the rotational force, the rotational force of the handle bar 830 is transferred to the gear unit 710 through the first connection portion 810.

The first connection portion 810 and the second connection portion 820 may be connected through coupling a groove portion with a protrusion portion corresponding thereto and may include the groove portion and the protrusion portion formed with angles to transfer the rotational force without any loss.

The first connection portion 810 of the handle unit 800 according to the embodiment of the present invention includes a connection member 811 connected to the gear unit 710 and an insertion member 812 connected to the connection member 811, into which the second connection portion 820 is inserted. Although the connection member 811 is connected to the gear unit 710 in the present embodiment, on the other hand, the connection member 811 may be connected to the brake unit 610 and may directly transfer the rotational force of the handle unit 800 to the brake unit 610 without the gear unit 710. An insertion protrusion 821 is provided on an end of the second connection portion 820, and a through groove 812*a* corresponding to a shape of the insertion protrusion 821 is formed on an end of the insertion member 812. The insertion protrusion 821 is inserted through the through groove 812*a* and then is rotated inside an insertion space 812*b* provided inside the insertion member 812 to prevent being separated again toward the through groove 812*a*. Here, shapes of the insertion protrusion 821 and the through groove 812*a*, as shown in FIG. 24, include a bar shape. Even when different therefrom, when including a function of preventing a separation after insertion, it will be considered being included in the insertion protrusion 821 and the through groove 812*a* according to the embodiment of the present invention.

The insertion space 812*b* may be provided to allow the insertion protrusion 821 to rotate at a certain angle but is not limited thereto as shown in FIG. 25.

To transfer a rotational force of the second connection portion 820 to the first connection portion 810, it is necessary that the handle unit 800 can prevent the insertion protrusion 821 from rotating inside the insertion space 812*b*. For this, a mounting groove 812*c* formed contrary to the through groove 812*a* may be included. A shape of the mounting groove 812*c* may be similar to the shape of the through groove 812*a* and may prevent the insertion protrusion 821 from being separated by including a bottom surface, which differs from the through groove 812*a*. Also, the shape of the mounting groove 812*c* is not limited to a concave shape as shown in FIG. 25 but may include a rotation preventer (not shown) to allow the insertion protrusion 821 to be mounted and not to rotate. In FIG. 25, the through groove 812*a* and the mounting groove 812*c* are disposed to go across as a cross shape. Although not shown in the drawing, the mounting groove 812*c* may include a guide surface (not shown) to allow the insertion protrusion 821 to be mounted. The guide surface may be formed to have a gradient toward the mounting groove 812*c* and may guide the insertion protrusion 821 to be mounted on the mounting groove 812*c* although the insertion protrusion 821 does not rotate to completely fit the mounting groove 812*c*.

The insertion member 812 may include an elastic supporting portion 812*d* which applies a force to the insertion protrusion 821 toward the through groove 812*a* to allow the insertion protrusion 821 to transfer the rotational force of the second connection portion 820 to the first connection portion 810 without any loss. The elastic supporting portion 812*d* may include a supporting surface 812*e* and an elastic member 812*f*, may pressurize the insertion protrusion 821 while the insertion protrusion 821 is being inserted and rotated, may prevent the insertion protrusion 821 from rotating when the rotational force is input through the second connection portion 820, and may transfer the rotational force to the first connection portion 810 without any loss. Here, when the mounting groove 812*c* is included as described above, the elastic supporting portion 812*d* only prevents the insertion protrusion 821 from being separated from the mounting groove 812*c*, thereby more effectively preventing a loss of the rotational force. A shape of the supporting surface 812*e* and a shape of the elastic member 812*f* are not limited to shapes shown in FIG. 25.

Hereinafter, connection between the first connection portion 810 and the second connection portion 820 will be described with reference to FIG. 26. FIG. 26 illustrates a coupling state of the connection portions 810 and 820, in which (a) illustrates a state before inserting the insertion protrusion 821, (b) illustrates a state in which the insertion protrusion 821 is inserted into the through groove 812*a*, (c) illustrates a state in which the insertion protrusion 821 rotates 90 degrees inside the insertion space 812*b*, and (d) is a cross-sectional view illustrating a state in which the insertion protrusion 821 is mounted on the mounting groove 812*c*.

The insertion protrusion 821 provided on the end of the second connection portion 820 is inserted into the through groove 812*a* provided on the end of the first connection portion 810 and corresponding to the shape of the insertion protrusion 821. The insertion protrusion 821 meets the elastic supporting portion 812*d* while passing through the through groove 812*a* and lifts the supporting surface 812*e* by applying a force greater than an elastic force of the elastic member 812*f*. After completely passing through the through groove 812*a*, the insertion protrusion 821 rotates 90 degrees, thereby being mounted on the mounting groove 812*c*. Here, when an external force applied to the elastic supporting portion 812*d* is removed, the elastic supporting portion 812*d* pressurizes the insertion protrusion 821 toward the through groove 812*a*, thereby preventing the insertion protrusion 821 from being separated from the mounting groove 812*c*. Thereby, the rotational force applied to the second connection portion 820 may be transferred to the first connection portion 810 without any loss and the second connection portion 820 is not separated from the first connection portion 810 until the worker applies a force upward to allow the insertion protrusion 821 to lift the elastic supporting portion 812*d*, thereby allowing stable rotation.

Figure 27:
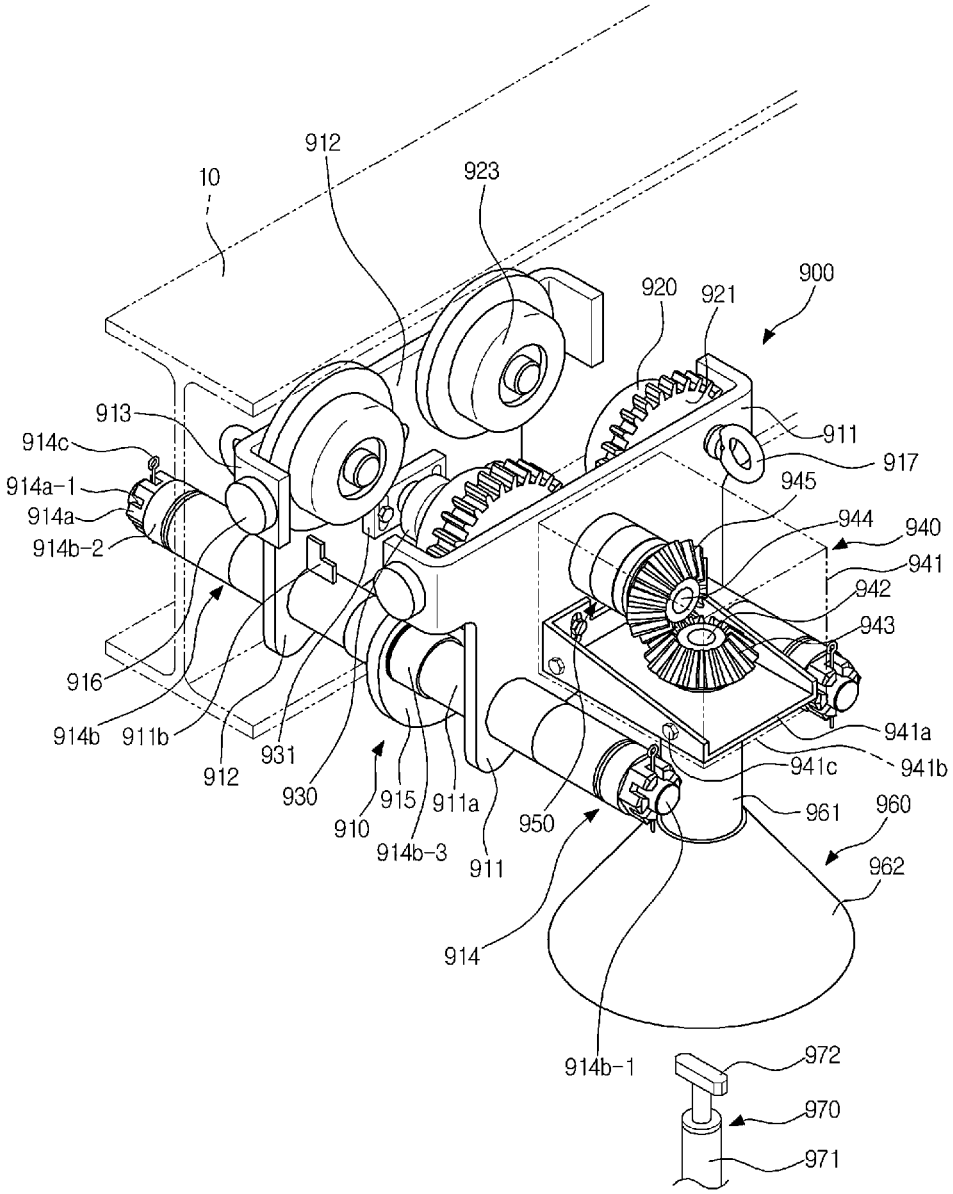
FIG. 27 is a perspective view of a trolley according to a fifth embodiment of the present invention.
Figure 28:
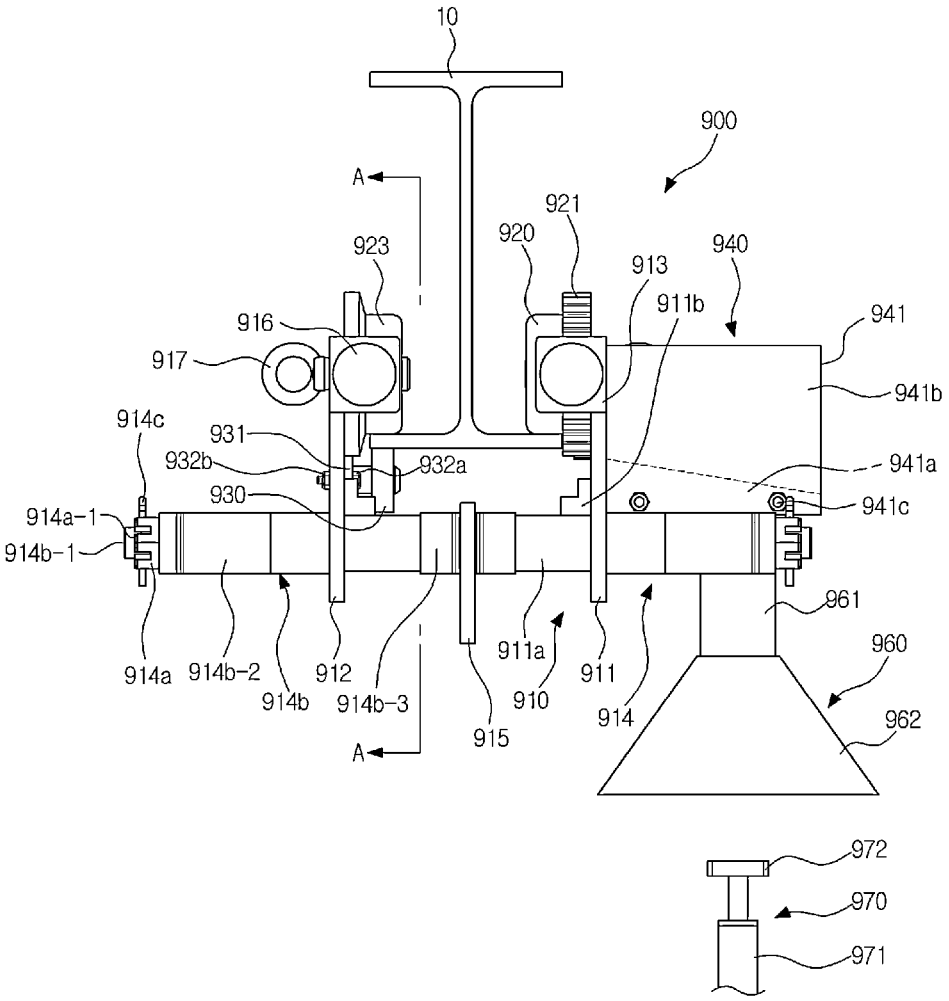
FIG. 28 is a front view of the trolley shown in FIG. 27.
Figure 29:
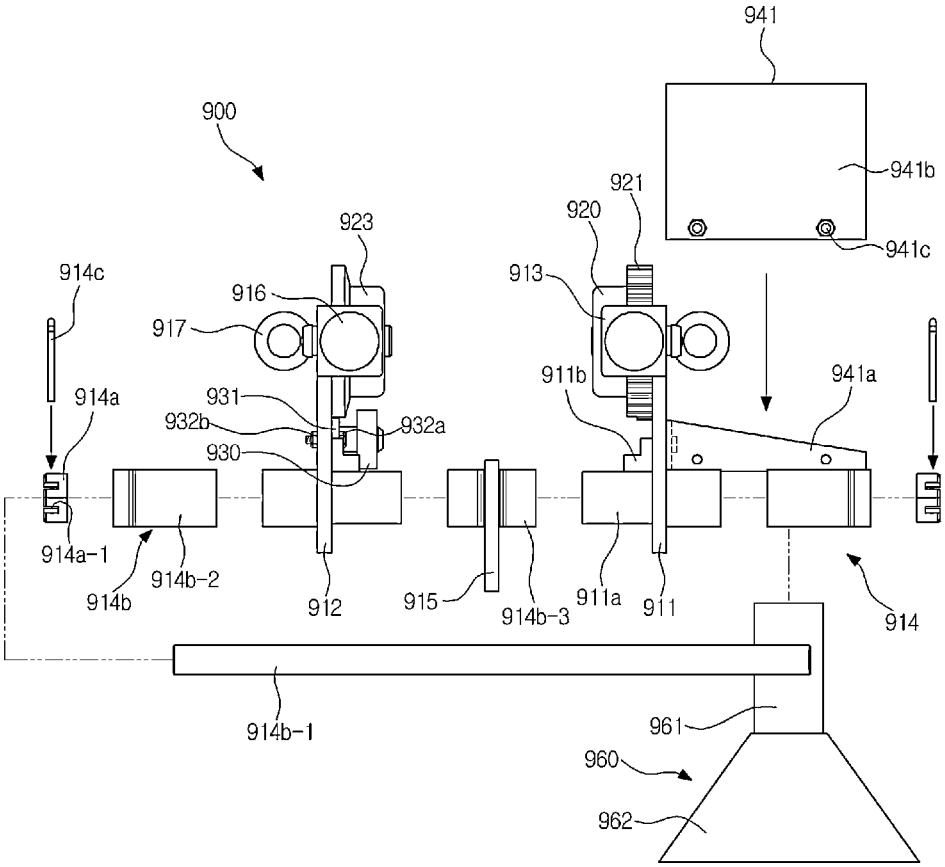
FIG. 29 is an exploded view of the trolley shown in FIG. 28.
Figure 30:
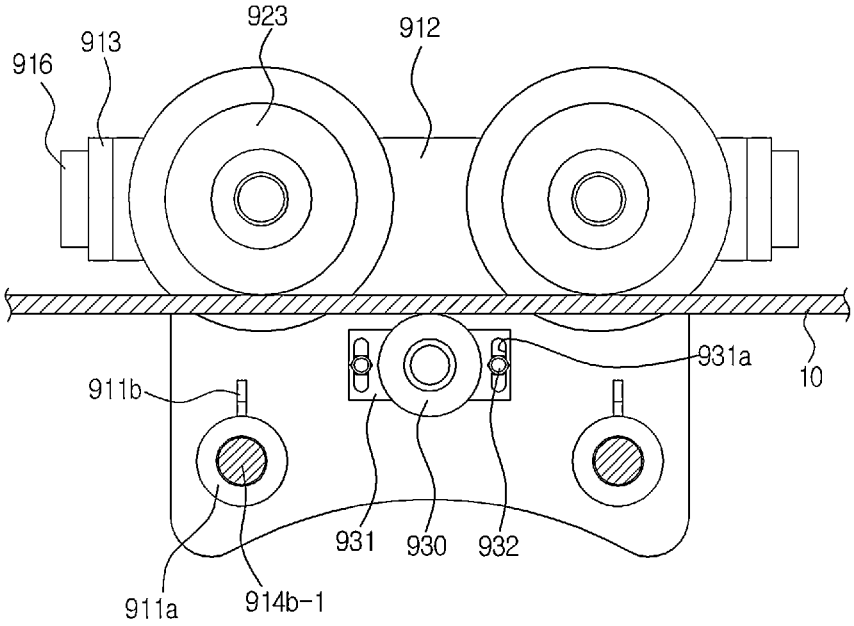
FIG. 30 is a cross-sectional view illustrating a portion taken along line A-A in FIG. 28.

Next, referring to FIGS. 27 to 46, a trolley 900 according to a fifth embodiment of the present invention will be described. FIG. 27 is a perspective view of the trolley 900 according to the fifth embodiment of the present invention. FIG. 28 is a front view of the trolley 900 shown in FIG. 27. FIG. 29 is an exploded view of the trolley 900 shown in FIG. 28. FIG. 30 is a cross-sectional view illustrating a portion taken along line A-A in FIG. 28.

The trolley 900 according to the fifth embodiment of the present invention may include a body unit 910 which moves along the rail 10, wheels which are connected to the body unit 910 and roll along the rail 10, and a power transfer unit 940 which transfers power for driving or braking of the body unit 910.

The body unit 910 may include a first supporting plate 911 and a second supporting plate 912 located on both sides of a proceeding direction of the rail 10 and a connection unit 914 which connects the first and second supporting plates 911 and 912. The first supporting plate 911 and the second supporting plate 912 may be disposed in parallel interposing the rail 10 therebetween.

Two connection units 914, as shown in FIG. 27, may be installed to allow both ends thereof mutually separate in parallel to penetrate the first supporting plate 911 and the second supporting plate 912 and may include two fixed supporting rods 914*b* fixed to the first supporting plate 911 and the second supporting plate 912 through fastening both ends thereof with tightening nuts 914*a*.

The two connection units 914 disposed in parallel are connected to the first and second supporting plates 911 and 912, thereby preventing degrees of freedom in rotation of the first and second supporting plates 911 and 912. Also, the connection units 914 may adjust a distance between the first supporting plate 911 and the second supporting plate 912 by controlling the number of washers or bushes coupled with outsides of the supporting rods 914*b* between the first supporting plate 911 and the second supporting plate 912. Accordingly, corresponding to a width of the rail 10 which is applied, the distance between the first supporting plate 911 and the second supporting plate 912 may be adjusted. A plurality of tightening nuts 914*a* are fastened to the respective supporting rods 914*b* outside the first and second supporting plates 911 and 912, thereby allowing the supporting rods 914*b* to be strongly coupled with the first and second supporting plates 911 and 912.

A hanging unit 915 may be provided in an arch shape and may be installed to connect middle portions of both the supporting rods 914*b*. Also, to hang an object, a hanging hole (not shown) may be provided in the center. A winding device such as a chain block may be hung and installed on the hanging unit 915. It is possible to hang an object to be transferred through directly binding a rope with the hanging hole.

Meanwhile, the connection units 914 which connect the first supporting plate 911 with the second supporting plate 912 according to the present embodiment include the two supporting rods 914*b* but are not limited thereto. The connection unit 914 may be formed using one supporting rod 914*b* which connects lower middle portions of the first supporting plate 911 and the second supporting plate 912. Also, both ends of the connection unit 914 may be formed of metal panels or section shape steel fixed to the first supporting plate 911 and the second supporting plate 912 through welding or bolt-fastening. Also, the connection unit 914 may be a metallic structure formed together with the first supporting plate 911 and the second supporting plate 912 as a single body. That is, the first supporting plate 911, the second supporting plate 912, and the connection unit 914 may be provided as a single body through casting.

Hereinafter, components of the connection unit 914 will be described in detail with reference to FIGS. 28 and 29.

The connection units 914 may each include the supporting rod 914*b* which connects the first and second supporting plates 911 and 912 and the tightening nuts 914*a* which are fastened to both ends of the supporting rod 914*b* and fix the first and second supporting plates 911 and 912. Also, the supporting rod 914*b* may include a connection shaft member 914*b*-1 which penetrates the first and second supporting plates 911 and 912 and spacers 914*b*-2 and 914*b*-3 which are coupled with an outer circumferential surface of the connection shaft member 914*b*-1 to maintain a certain distance.

The first and second supporting plates 911 and 912 may include a shaft supporting portion 911*a* which extends toward one side to support the connection shaft member 914*b*-1 and includes a through hole through which the connection shaft member 914*b*-1 penetrates. In the drawings, the shaft supporting portion 911*a* which extends between the first and second supporting plates 911 and 912 is shown. On the other hand, the shaft supporting portion 911*a* may protrude from the first and second supporting plates 911 and 912 or may be formed on both sides. The supporting rod 914*b* supports a heavy object in addition to coupling and fixing the first and second supporting plates 911 and 912. Here, as a weight of the object increases, a force applied to the supporting rod 914*b* increases, thereby increasing a force applied to the first and second supporting plates 911 and 912. Here, the shaft supporting portion 911*a* formed on the first and second supporting plates 911 and 912 increases in an area which receives the force applied by the connection shaft member 914*b*-1, thereby distributing the force. Accordingly, it is possible to hang a heavier object on the hanging unit 915 and to increase the durability of the trolley 900.

The spacers 914*b*-2 and 914*b*-3 may include first spacers 914*b*-2 which are coupled with the outer circumferential surface of the connection shaft member 914*b*-1 protruding from external surfaces of the first and second supporting plates 911 and 912 and maintain certain distances between the first and second supporting plates 911 and 912 and the tightening nuts 914*a* and second spacers 914*b*-3 which are coupled with the outer circumferential surface of the connection shaft member 914*b*-1 and maintain distances between the first and second supporting plates 911 and 912 and the shaft supporting portions 911*a*.

The connection unit 914 may be provided much longer than the distance between the first and second supporting plates 911 and 912. That is, since it is applicable to the body unit 910 having various widths and rotational inertia increases as a distance from a center of rotation increases, it is possible to more stably move. Accordingly, spaces occur between the tightening nuts 914*a* and the first and second supporting plates 911 and 912, which are filled with the first spacers 914*b*-2. Also, a screw thread to which the hanging unit 915 may be fastened may be provided on an outer circumferential surface of the second spacer 914*b*-3. When the hanging unit 915 is not fixed to one point of the second spacer 914*b*-3 and slides, since the stability of the trolley 900 is hindered, the hanging unit 915 and the second spacer 914*b*-3 may be screw-coupled, thereby preventing sliding. Also, the second spacer 914*b*-3 may cover a certain part of the outer circumferential surface of the connection shaft member 914*b*-1 to allow a load of an object supported by the hanging unit 915 to distribute a force transferred to the connection shaft member 914*b*-1.

The supporting rod 914*b* may be applied even when the distance between the first and second supporting plates 911 and 912 is changed. For this, the first and second spacers 914*b*-2 and 914*b*-3 may be manufactured in various lengths. When the distance between the first supporting plate 911 and the second supporting plate 912 changes or when the length of the connection shaft member 914*b*-1 changes, the spacers 914*b*-2 and 914*b*-3 which are manufactured in various sizes to fit the changed distance may be inserted. Accordingly, regardless of various changes in size and shape of a rail, the trolley 900 may be applied thereto.

To prevent the tightening nut 914*a* from being released and separate from the connection shaft member 914*b*-1, a pin member 914*c* may be inserted into a hole which penetrates the connection shaft member 914*b*-1. Also, a groove 914*a*-1 into which the pin member 914*c* may be inserted is formed on one side of the tightening nut 914*a*, thereby preventing the tightening nut 914*a* from rotating while the pin member 914*c* is being coupled.

The body unit 910 may further include flange portions 913 to protect the wheels. The flange portions 913 are provided on both sides of the first and second supporting plates 911 and 912 and concave inwards to prevent the wheels from colliding with the outside. FIG. 27 illustrates totally four flange portions 913 provided on both sides of the first supporting plate 911 and the second supporting plate 912.

The body unit 910 may further include shock absorbing members 916 attached to the flange portions 913. The shock absorbing members 916 may reduce impulses generated when the flange portions 913 collide with obstacles using an elastic material such as rubber. The shock absorbing members 916 are located outermost portions of the trolley 900 and collide first with obstacles. Also, the shock absorbing members 916 in the front and rear and the flange portions 913 protect the wheels located therebetween.

Ring members 917 may be provided on respective one sides of the first and second supporting plates 911 and 912. The ring member 917 may be coupled with a crane (not shown) to easily install the trolley 900. The rail 10 on which the trolley 900 is installed may be generally located at a high place beyond the worker's reach. Accordingly, it is convenient to use the crane to install the trolley 900 on the rail 10 and the ring members 917 form coupling holes in which hooks of the crane hang. Considering stability in installation, the ring members 917 are formed on the first and second supporting plates 911 and 912, respectively. Also, when formed adjacently to the center of the first and second supporting plates 911 and 912, movements may occur while the trolley 900 is being lifted. Accordingly, the ring members 917 may be formed far from the center of the first and second supporting plates 911 and 912. Also, instead of forming four ring members 917 in the front and rear of the first and second supporting plates 911 and 912, as shown in FIG. 27, only two ring members 917 may be formed diagonally.

The wheels may be provided one or more. A plurality of wheels may be disposed two for each of both sides of the rail 10 with gaps therebetween for stable running. In the present embodiment, as shown in FIG. 27, totally four wheels are used on both sides but the number of the wheels or an arrangement thereof is not limited thereto. The number or arrangement of the wheels may vary according to a change in shape of the rail 10. That is, one wheel may be mounted on the body unit 910.

The plurality of wheels may be coupled with one of the first supporting plate 911 and the second supporting plate 912 to be rotatably installed. Also, the respective wheels may be supported by a bearing installed thereinside to smoothly rotate around an outside of a shaft.

The wheels may include rolling wheels 920 and 923 and a supporting wheel 930 which supports the bottom surface of the rail 10. FIG. 27 illustrates the two rolling wheels 920 and 923 coupled with the first supporting plate 911 and the second supporting plate 912, respectively, and the supporting wheel 930 coupled with the second supporting plate 912.

The rolling wheels 920 and 923 may include driving wheels 920 which roll along the rail 10 due to power transferred from the power transfer unit 940 and driven wheels 923 which does not directly receive the power but roll along the rail 10 together with the driving wheels 920 according to the movement of the body unit 910.

The two driving wheels 920 may be coupled with the first supporting plate 911. The driving wheels 920 may be integrated with driving wheel gears 921, respectively. The driving wheel gears 921 may rotate the driving wheels 920 through the power transferred from the power transfer unit 940. Referring to FIG. 29, the two driving wheel gears 921 may gear into a power transfer gear 922 at the same time and the power transfer gear 922 may be connected to an output shaft 944. Accordingly, as the output shaft 944 rotates, the power transfer gear 922 rotates and the two driving wheels 920 rotate in the same direction at the same time. Accordingly, a driving force is applied to both the two driving wheels 920, which increases a grip force between the rail 10 and the driving wheels 920, thereby preventing the body unit 910 from slipping from the rail 10. Also, the driving wheels 920 generally include circular treads and are in contact with the rail 10. However, a screw thread of the driving wheel gear 921 may be in direct contact with the rail 10.

The two driven wheels 923 may be coupled with the second supporting plate 912 and passively roll on the rail 10 along the body unit 910 which moves on the rail 10 according to the rolling of the driving wheels 920. In the drawings, the driven wheels 923 are located corresponding to positions of the driving wheels 920. On the other hand, one driven wheel 923 may be located or located alternately with the driving wheels 920. The number and positions of the driven wheels 923 may change as necessary.

To remove instability caused by an imbalance in weight of the trolley 900, the supporting wheel 930 may be coupled with the second supporting plate 912 in which the power transfer unit 940 is not located and may support the bottom of the rail 10. The supporting wheel 930 may be coupled with the first supporting plate 911. However, it may be most effective that the supporting wheel 930 is coupled with the second supporting plate 912 and supports the bottom of the rail 10.

In the trolley 900 according to the fifth embodiment of the present invention, the power transfer unit 940 is located on one side of the body unit 910, thereby generating an imbalance in weight between both sides. The imbalance in weight may make the trolley 900 instable and may separate the driven wheels 923 from the rail 10. Also, fatigue accumulates on the driving wheels 920 and the power transfer unit 940, thereby shortening a repair cycle.

The supporting wheel 930 may be coupled to be changeable in position above and below the body unit 910. For example, the supporting wheel 930 may be fixedly coupled with a supporting wheel bracket 931 and the supporting wheel bracket 931 may be coupled to be changeable in position above and below the body unit 910. The position of the supporting wheel 930 is changed above and below, thereby easily installing the trolley 900 on the rail 10. That is, the supporting wheel 930 is located below while being installed to make a gap from the driven wheels 923 greater than a thickness of the rail 10 and then the supporting wheel 930 is lifted upward and fixed to support the rail 10. Also, the thickness of the rail 10 may change, in which the position of the supporting wheel 930 changes above or below corresponding to various thicknesses of the rail 10.

FIG. 30 is a cross-sectional view illustrating a portion taken along line A-A in FIG. 28. Referring to FIG. 30, a method of coupling the supporting wheel 930 will be described. The supporting wheel bracket 931 includes guide grooves 931*a* vertically provided. Also, fixing members 932 are inserted through the guide grooves 931*a* and coupled with the second supporting plate 912. FIG. 28 illustrates the supporting wheel bracket 931 coupled with the second supporting plate 912 using a bolt 932*a* and a nut 932*b*.

Figure 31:
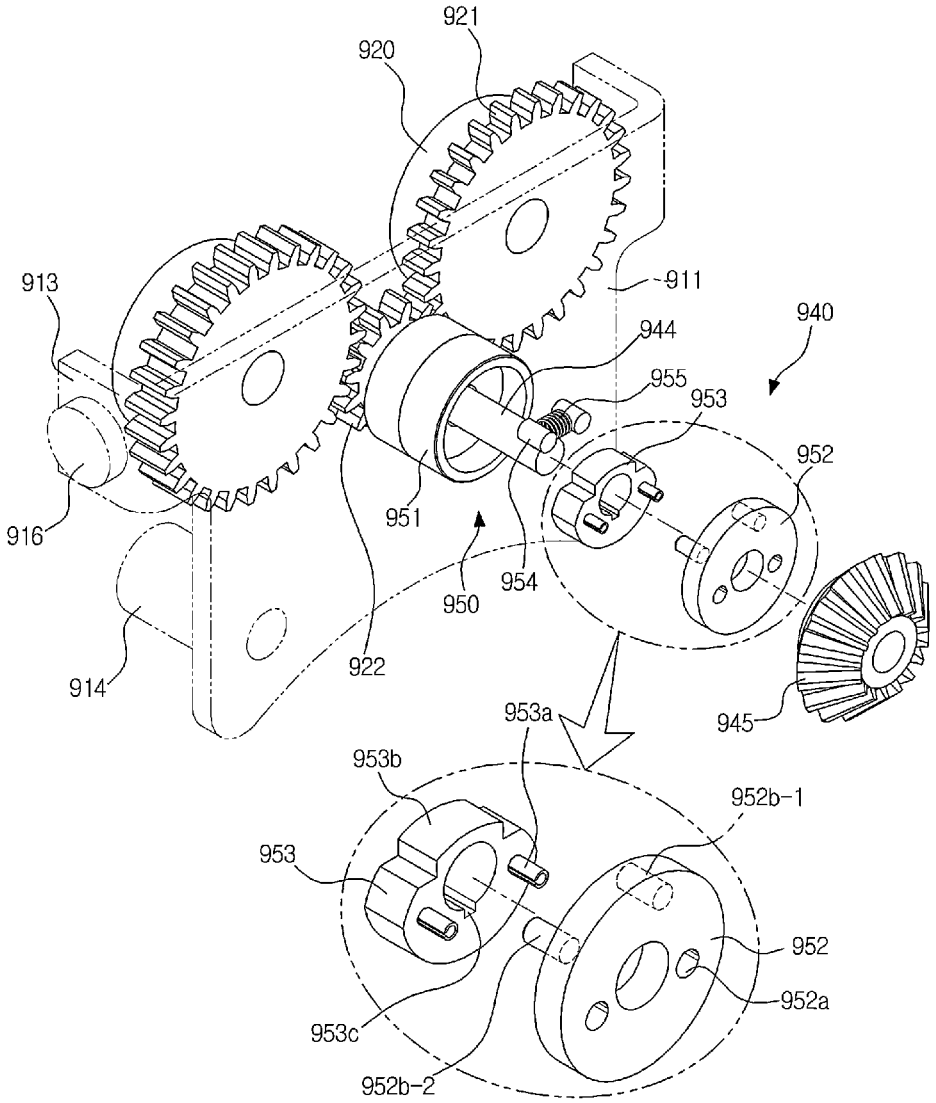
FIG. 31 is an exploded perspective view of a power transfer unit of the trolley according to the fifth embodiment of the present invention.

FIG. 31 is an exploded perspective view of the power transfer unit 940 of the trolley 900 according to the fifth embodiment of the present invention. Referring to FIGS. 27 and 31, the power transfer unit 940 will be described.

The power transfer unit 940 may be connected to the body unit 910 in the proceeding direction of the rail 10 and may transfer power for driving or braking of the body unit 910. In the drawings, the power transfer unit 940 is coupled with the first supporting plate 911.

The power transfer unit 940 may include an input shaft 942 which rotates due to power, the output shaft 944 which is connected to the input shaft 942 and drives or brakes the body unit 910, and a locking unit 950 which transfers a rotational force from the input shaft 942 to the output shaft 944 but does not transfer a rotational force from the output shaft 944 to the input shaft 942.

The power transfer unit 940 according to the embodiment of the present invention transfers power for driving. However, it is not limited thereto and the power transfer unit for braking may be included. A device which transfers power for braking has been described with reference to the trolley 500 according to the second embodiment of the present invention and the trolley 502 according to the fourth embodiment of the present invention. However, the power transfer unit which transfers power for braking will not be limited thereto and may include various embodiments.

Hereinafter, the power transfer unit 940 which transfers power for driving will be described. It will be understood that the power transfer unit 940 is a generic term for functional components through which an external force is input to the input shaft 942, passes through the output shaft 944, and operates the driving wheels 920. Accordingly, the power transfer unit 940 may include the input shaft 942, an input gear 943, an output gear 945, the output shaft 944, the power transfer gear 922, and/or the driving wheel gear 921.

The input shaft 942 may be connected to a connection portion 960. The power may be input by a handle unit 970 connected to the connection portion 960. A method in which the body unit 910 runs due to the input power will be described. The input shaft 942 which rotates due to the power rotates the input gear 943. The output shaft 944 is rotated by the output gear 945 which gears into the input gear 943. The output shaft 944 is connected to the power transfer gear 922. The rotation of the output shaft 944 rotates the driving wheel gear 921 which gears into the power transfer gear 922. The driving wheels 920 integrated with the driving wheel gear 921 rotate and roll on the rail 10. The body unit 910 connected to the driving wheels 920 runs on the rail 10. Here, the driven wheels 923 or the supporting wheel 930 connected to the body unit 910 may rotate at the same time.

The input gear 943 and the output gear 945 may be coupled to convert the power input below the body unit 910 into a vertical direction. Since the trolley 900 generally runs along the rail 10 installed on a ceiling or in the air, it is necessary that the worker inputs power below the trolley 900. Since an axial direction of the driving wheels 920 is generally horizontal to the ground, a gear assembly which can converts the power input below the body unit 910 into a vertical direction may be necessary. FIG. 27 illustrates that the input gear 943 and the output gear 945 are coupled as a bevel gear assembly. On the other hand, the input gear 943 and the output gear 945 are coupled as a worm and a worm gear assembly.

The locking unit 950 may include an active rotating body 952 which rotates due to the input power and a passive rotating body 953 which is coupled to rotate in the same direction as a rotational direction of the active rotating body 952 and is coupled with one of the input shaft 942 and the output shaft 944. FIG. 31 illustrates the active rotating body 952 which is connected to the output gear 945 and rotates and the passive rotating body 953 which is connected to the output shaft 944 and rotates the output shaft 944. On the other hand, the active rotating body 952 may be connected to the input shaft 942 and rotate and the passive rotating body 953 may rotate the input gear 943. However, as shown in FIG. 31, the locking unit 950 is located close to the body unit 910, thereby allowing the center of gravity of the body unit 910 to be closer to the center of the trolley 900.

In the locking unit 950, the passive rotating body 953 rotates due to the rotation of the active rotating body 952 and rotates one of the output shaft 944 and the input shaft 942 while the passive rotating body 953 is not rotating even when a rotational force is applied to one of the output shaft 944 and the input shaft 942 due to an external force. Hereinafter, referring to FIGS. 32 and 33, an example of components for allowing the locking unit 950 to perform the function described above will be described.

Figure 32:
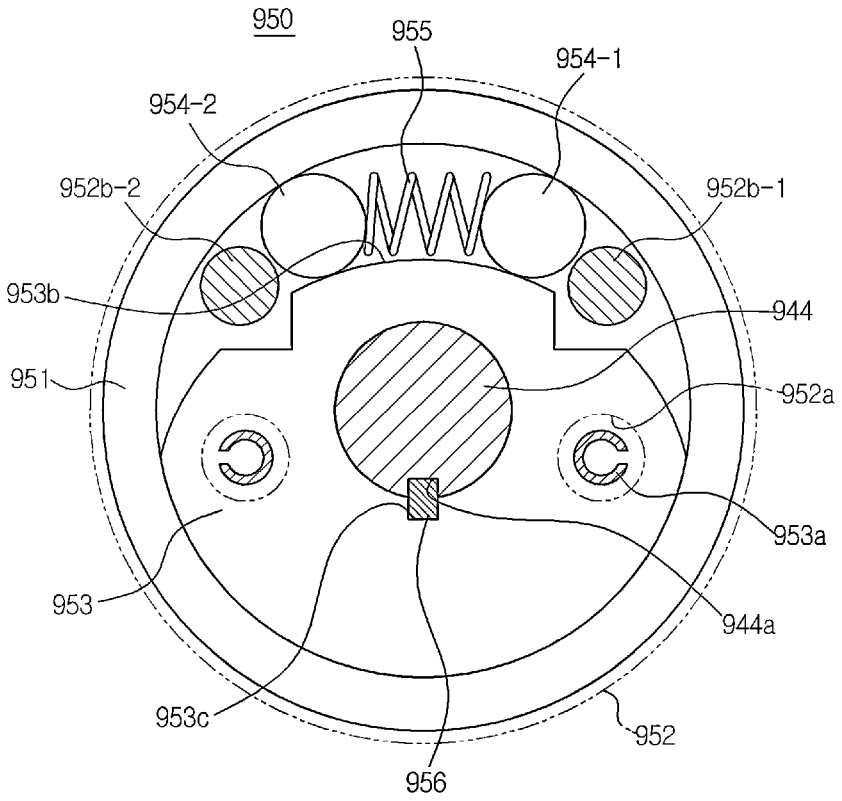
FIG. 32 is a cross-sectional view of a locking unit of the trolley according to the fifth embodiment of the present invention.
Figure 33:
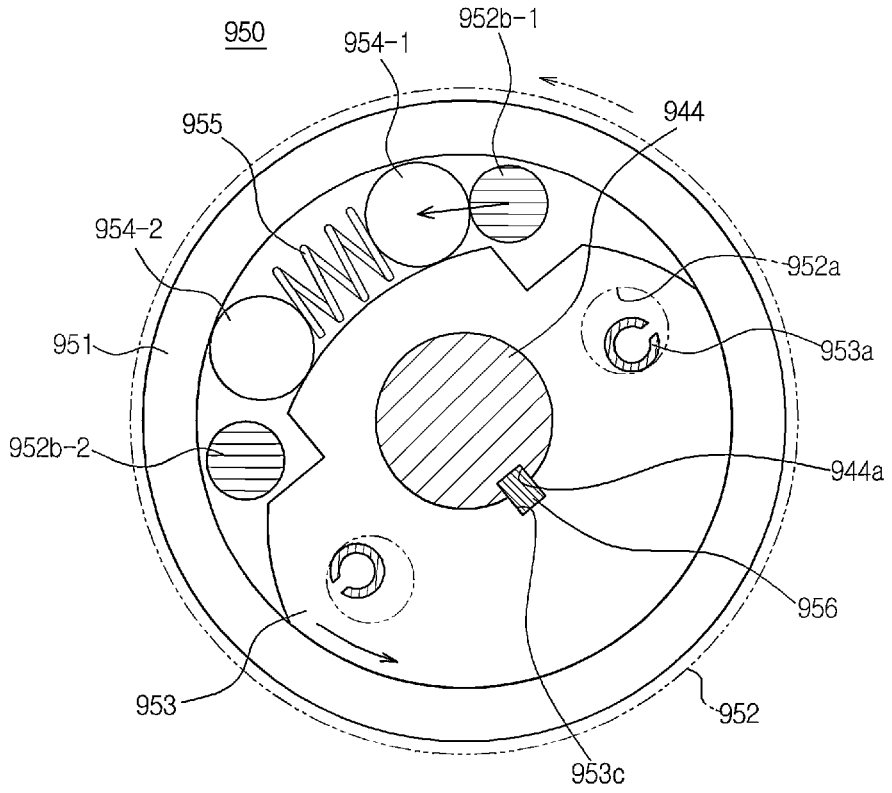
FIG. 33 is a view illustrating a state in which the locking unit of FIG. 32 rotates.

FIG. 32 is a cross-sectional view of the locking unit 950 of the trolley 900 according to the fifth embodiment of the present invention. FIG. 33 is a view illustrating a state in which the locking unit 950 of FIG. 32 rotates. The locking unit 950 may further include a housing 951 which accommodates the passive rotating body 953 thereinside, a locking member 954 which is disposed between the housing 951 and the passive rotating body 953 and is inserted in only one rotational direction, and/or an unlocking member 952*b* which is connected to the active rotating body 952 and may rotate the locking member 954 through rotation.

The active rotating body 952 and the passive rotating body 953 may be coupled through coupling between a stud member 953*a* and a stud hole 952*a*. In FIG. 31, the stud member 953*a* protrudes from one side of the passive rotating body 953, the stud hole 952*a* is formed in a corresponding side of the active rotating body 952, and a pair of the stud members 953*a* are coupled interposing a shaft therebetween, thereby performing concentric rotation.

The active rotating body 952 may be coupled with the output gear 945, thereby performing corotation. Also, the passive rotating body 953 may be coupled with the output shaft 944, thereby performing corotation. The passive rotating body 953 and the output shaft 944 may be key-coupled. That is, a key 956 may be inserted between a key groove 953*c* provided on the passive rotating body 953 and a key groove 944*a* provided on the output shaft 944.

The locking member 954 may be disposed between the housing 951 and a guide surface 953*b* of the passive rotating body 953 and may have a cylindrical shape. The guide surface 953*b* may have a greater radius curvature than an internal radius curvature of the housing 951. Accordingly, a distance between the guide surface 953*b* and the housing 951 becomes smaller as being far from the center of the guide surface 953*b*. The locking member 954 may have a diameter within a range between a maximum value and a minimum value of the distance between the guide surface 953*b* and the housing 951. Accordingly, when the locking member 954 goes toward an outer area of the guide surface 953*b*, an insertion occurs between the housing 951 and the guide surface 953*b*. When the locking member 954 goes toward the center of the guide surface 953*b*, it is possible to roll without any insertion.

When the locking member 954 is provided on one side of an outer portion of the guide surface 953*b*, the passive rotating body 953 may rotate in only one direction. The locking member 954 generates the insertion when the passive rotating body 953 rotates in one direction, thereby preventing the rotation of the passive rotating body 953. For convenience of description, it is assumed that only one locking member 954 exists. When the passive rotating body 953 rotates clockwise, the locking member 954 rotates counterclockwise due to friction with the guide surface 953*b*. Accordingly, the locking member 954 may receive a force of rolling toward the center of the guide surface 953*b* and the passive rotating body 953 may freely rotate.

On the contrary, when the passive rotating body 953 rotates counterclockwise, the locking member 954 rotates clockwise due to friction with the guide surface 953*b*. Accordingly, the locking member 954 may receive a force of rolling toward the outer area of the guide surface 953*b* to be inserted between the guide surface 953*b* and the housing 951 and the passive rotating body 953 may not rotate. Hereinafter, a clockwise direction in which the passive rotating body 953 is rotatable will be indicated as a rotational direction and a counterclockwise direction in which the passive rotating body 953 is not rotatable will be indicated as an insertion direction.

The unlocking member 952*b* may be coupled to protrude from a surface of the active rotating body 952 which faces the passive rotating body 953. The unlocking member 952*b* is located on an outer area of the locking member 954 and rotates together with the rotation of the active rotating body 952 at the same time, thereby pushing the locking member 954 toward the center of the guide surface 953*b*. Accordingly, the locking member 954 may not be inserted between the housing 951 and the guide surface 953*b* and the passive rotating body 953 may freely rotate.

The unlocking member 952*b* allows the passive rotating body 953 to rotate when the active rotating body 952 rotates even in the insertion direction. Accordingly, it is possible to operate as one-way clutch. In other words, when the active rotating body 952 rotates in the insertion direction, the unlocking member 952*b* moves the locking member 954 in a direction not be inserted, that is, toward the center of the guide surface 953*b*, thereby allowing the passive rotating body 953 to rotate. However, when a rotational force is applied to the output shaft 944 due to an external force and the passive rotating body 953 intends to rotate in the insertion direction, since the locking member 954 is inserted between the housing 951, rotation is impossible.

The locking member 954 and the unlocking member 952*b* may be provided on both outer areas of the guide surface 953*b* as one pair. This is for allowing the passive rotating body 953 to bidirectionally rotate. As described above, an operation in a case in which the locking member 954 and the unlocking member 952*b* are provided only in one outer area of the guide surface 953*b* has been described. Hereinafter, an operation of the locking unit 950 when the locking member 954 and the unlocking member 952*b* are located in both outer areas of the guide surface 953*b* will be described with reference to FIG. 33.

When the active rotating body 952 rotates, regardless of rotating clockwise or counterclockwise, the passive rotating body 953 may rotate together with the active rotating body 952. FIG. 33 illustrates that the active rotating body 952 rotates counterclockwise. Due to the rotation of the active rotating body 952, the unlocking member 952*b* rotates to push a first locking member 954-1 in an insertion position to a place in which insertion does not occur. Also, since a second locking member 954-2 is not inserted, the passive rotating body 953 may rotate without hindrance.

On the contrary, when the passive rotating body 953 intends to rotate due to an external force applied to the output shaft 944, since any one of the two locking members 954-1 and 954-2 is inserted regardless of a direction of rotation, the passive rotating body 953 may not rotate. Accordingly, no matter in which direction power is input, the locking unit 950 may drive the body unit 910 by rotating the output shaft 944. However, when a rotational force is applied to the output shaft 944 through applying an external force to the body unit 910, since the passive rotating body 953 is impossible to rotate, the body unit 910 does not move.

The active rotating body 952 and the passive rotating body 953 may be coupled in such a way that a space occurs when rotation is performed. The space means a rotation angle at which the active rotating body 952 may independently rotate from the passive rotating body 953. To allow the unlocking member 952*b* to push the locking member 954 to a place in which insertion does not occur, an affordable rotation angle to allow the unlocking member 952*b* to move is necessary. Within the space, the active rotating body 952 may move independently from the passive rotating body 953. When the passive rotating body 953 is coupled with the active rotating body 952 without space, there is no room to allow the unlocking member 952*b* to move due to the locking member 954. That is, while the active rotating body 952 is rotating as a rotation angle separate from the passive rotating body 953, the unlocking member 952*b* moves the locking member 954 to the place in which insertion does not occur, thereby allowing the passive rotating body 953 to rotate.

As an example of generating the space, the stud hole 952*a* accommodates the stud member 953*a* while being separate therefrom, thereby coupling the active rotating body 952 with the passive rotating body 953. The passive rotating body 953 is allowed to rotate together with the rotation of the active rotating body 952 with the space as a distance between the stud member 953*a* and the stud hole 952*a*. That is, for the space between the active rotating body 952 and the passive rotating body 953, an inner diameter of the stud hole 952*a* may be greater than an outer diameter of the stud member 953*a*.

The locking unit 950 may further include an elastic member 955 which pushes the locking member 954 to a place in which insertion occurs. To prevent the passive rotating body 953 from rotating due to the output shaft 944, it is necessary that the locking member 954 is in an insertion state. When the locking member 954 is not located in the insertion state, it is impossible to prevent the passive rotating body 953 from rotating until the locking member 954 is located in the insertion state.

Also, as shown in FIG. 33, when the locking members 954-1 and 954-2 and unlocking members 952*b*-1 and 952*b*-2 are provided on both outer areas of the guide surface 953*b* as pairs, the elastic member 955 may be located between the two locking members 954-1 and 954-2. Accordingly, the elastic member 955 pushes the locking members 954-1 and 954-2 located on both sides to the place in which insertion occurs, thereby preventing a space in which the passive rotating body 953 is rotatable.

Next, advantages obtained by using the locking unit 950 will be described. As described above, the power transfer unit 940 according to the embodiment of the present invention may transfer power for driving or braking of the body unit 910.

The trolley 900 may be installed in a place in which pitching may occur such as a vessel. Also, the rail 10 may not be always horizontal but may be installed with a certain gradient. In this case, a force is generated by potential energy in the trolley 900. In addition, various external forces may be generated to apply a force to the trolley 900.

When the power transfer unit 940 transfers power for driving or when the power transferred from the power transfer unit 940 is cut off, the trolley 900 is in a brake state. When the power for driving is transferred, a rotational force is transferred to the output shaft 944 through the input shaft 942, the input gear 943, the active rotating body 952, and the passive rotating body 953, and the driving wheels 920 start rolling to allow the trolley 900 to run on the rail 10. However, when the power is cut off, the trolley 900 may maintain a standstill. When the driving wheels 920 intend to passively roll due to a gradient, the locking unit 950 prevents the output shaft 944 from rotating. Accordingly, it is possible to provide the trolley 900 which can maintain a brake state without any additional brake device.

When a power transfer unit (not shown) transfers power for braking, the locking unit 950 maintains the brake state. As an example, when a braking operation is performed by a pad which applies friction to one of the wheels or the rail 10, the trolley is in an instable state when there is a certain change in the brake state due to an external force, that is, when braking is loosened. The locking unit 950 may prevent a certain change in the braking state by preventing rotation of the output shaft 944.

Next, referring to FIG. 27, a state in which the power transfer unit 940 is coupled between the body unit 910 and the connection portion 960 will be described. The power transfer unit 940 may be surrounded by a case 941 and protected from surroundings. Since the power transfer unit 940 includes coupling among shafts and gears, when exposed outwards, a problem may be caused in durability.

The case 941 may include a base portion 941*a* and a cover portion 941*b*. A bottom of the base portion 941*a* may be penetrated by the input shaft 942 and may be connected to a body 961 of the connection portion 960, thereby supporting the connection portion 960. Also, one side of the base portion 941*a* may be coupled with the first supporting plate 911. Here, the base portion 941*a* may be coupled with the first supporting plate 911 to be slidable up and down. The output shaft 944 and the output gear 945 are fixedly supported by the first supporting plate 911, and the input shaft 942 and the input gear 943 are fixedly supported by the base portion 941*a*. Here, since the output gear 945 and the input gear 943 are coupled with each other, when disassembling to maintain or repair, the output gear 945 and the input gear 943 may be separated into top and bottom to be disassembled. When an external force is transferred while the two gears 943 and 945 are being coupled with each other, teeth thereof may be damaged.

That is, a slit hole in which a bolt is vertically movable may be formed in the base portion 941*a* and a through hole 911*c* (refer to FIG. 30) through which the bolt penetrates may be formed in the first supporting plate 911. Otherwise, a slit hole in which a bolt is vertically movable may be formed in the first supporting plate 911 and a through hole through which the bolt penetrates may be formed in the base portion 941*a*. The base portion 941*a* and the first supporting plate 911 may be coupled with bolts and nuts. When coupling between bolts and nuts is loosened, the base portion 941*a* becomes vertically slidable.

The base portion 941*a* may have four open sides except a surface in contact with the first supporting plate 911 and a bottom surface. That is, it is unnecessary to completely disassemble the case 941 to maintain or repair the power transfer unit 940. The power transfer unit 940 may be exposed through by merely separating the cover portion 941*b*. Here, sides of the base portion 941*a* may be partially provided for coupling between the cover portion 941*b* and the base portion 941*a* and the cover portion 941*b* and the base portion 941*a* may be coupled with each other through bolting.

Figure 34:
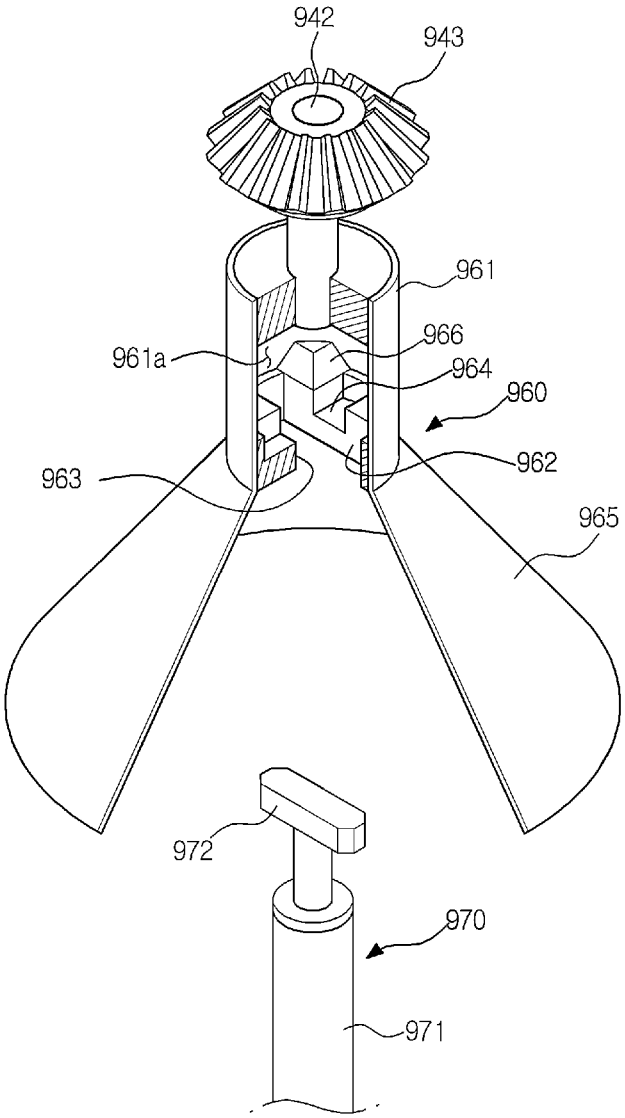
FIG. 34 is an incised perspective view of a connection portion of the trolley according to the fifth embodiment of the present invention.

FIG. 34 is an incised perspective view of the connection portion 960 of the trolley 900 according to the fifth embodiment of the present invention.

The trolley 900 according to the fifth embodiment of the present invention may further include the handle unit 970 for inputting power and the connection portion 960 detachably connected to the handle unit 970. As described above, there is a limitation in the general trolley 9 in which it is impossible to remove the chains 2 for driving or braking as unnecessary. Accordingly, in the embodiment of the present invention, the handle unit 970 and the connection portion 960 detachably connected to input power for driving or braking may be used.

One end of the connection portion 960 is connected to the handle unit 970 and the other end is connected to the power transfer unit 940. The one end of the connection portion 960 is connected to a connection protrusion 972 provided on an end of a handle bar 971, thereby transferring a rotational force of the handle unit 970 to the power transfer unit 940. For this, the connection portion 960 may include the body 961 and a base 962.

The body 961 may provide a rotation space 961*a* in which the connection protrusion 972 is rotatable, and a top thereof may be connected to the input shaft 942 and a bottom thereof may be connected to the base 962. The base 962 may include a through groove 963 into which the connection protrusion 972 is inserted and a mounting groove 964 on which the connection protrusion 972 is mounted. FIG. 34 illustrates a bar shape as an example of the connection protrusion 972, and the through groove 963 and the mounting groove 964 are formed corresponding thereto. However, even if different therefrom, when including a function of preventing a separation after insertion, it will be included in the through groove 963 and the mounting groove 964 according to the embodiment of the present invention.

Also, the through groove 963 and the mounting groove 964 are provided to intersect at 90 degrees in FIG. 34 but are not limited thereto. Different from FIG. 34, the rotation space 961*a* may be provided as an acute angle of the degree at which the through groove 963 and the mounting groove 964 intersect.

The connection protrusion 972 may be inserted into the body 961 through the through groove 963 and then may rotate at 90 degrees in the rotation space 961*a*, thereby being mounted on the mounting groove 964. When the handle bar 971 rotates after the connection protrusion 972 is mounted on the mounting groove 964, a rotational force of the handle unit 970 is intactly transferred to the connection portion 960. That is, the rotational force is allowed to pass through the base 962 and the body 961 and to rotate the input shaft 942.

Also, a shape of the mounting groove 964 is not limited to a concave shape as shown in FIG. 34 but may include a rotation preventer (not shown) formed to allow the connection protrusion 972 to be mounted and not to rotate.

The connection portion 960 may include a guide protrusion 966 to allow the connection protrusion 972 to be easily mounted on the mounting groove 964. The guide protrusion 966 includes a slant guide surface 953*b*, thereby guiding the connection protrusion 972 to be mounted on the mounting groove 964 even when the connection protrusion 972 passes through the through groove 963 and does not completely rotate at 90 degrees. The guide protrusion 966 may be provided on the base 962 between the through groove 963 and the mounting groove 964.

The connection portion 960 may include a guide member 965 which guides an end of the handle unit 970 to be easily inserted. The guide member 965 may be provided below the body 961 and may include a shape whose opening becomes wider toward an end thereof. Accordingly, even when the connection protrusion 972 is coupled with the through groove 963 not to completely fit but is inserted into the opening of the guide member 965, the connection protrusion 972 may be guided along the guide member 965 and may be inserted into the through groove 963.

Not shown in the drawings, the connection portion 960 may include an elastic supporting member (not shown) which applies a force to the connection protrusion 972 toward the through groove 963 to prevent the connection protrusion 972 from being separated from the mounting groove 964. The elastic supporting member may include a supporting surface and an elastic member and may pressurize the connection protrusion 972 while being mounted to prevent the connection protrusion 972 from being separated from the mounting groove 964, thereby transferring a rotational force to the connection portion 960 without any loss.

Figure 35:
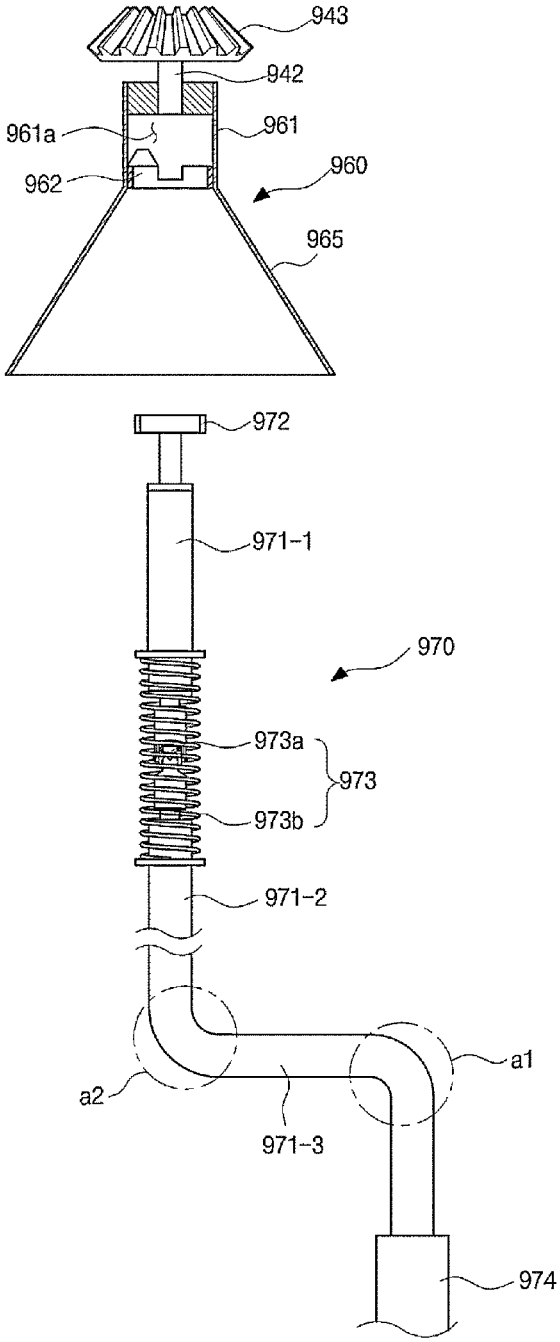
FIG. 35 is a view illustrating a state of a handle unit of the trolley according to the fifth embodiment of the present invention before bending.
Figure 36:
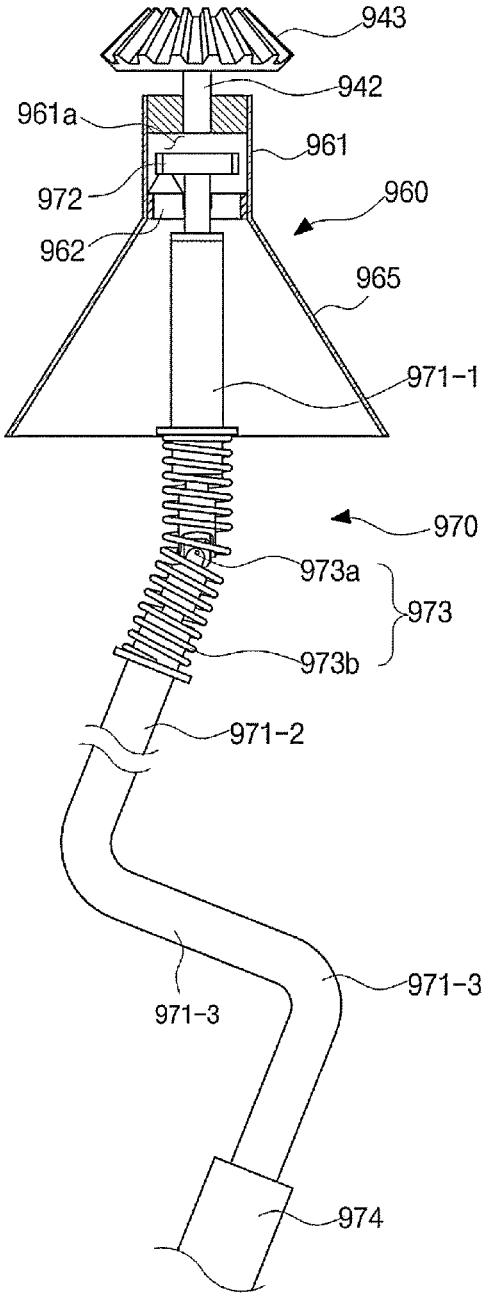
FIG. 36 is a view illustrating a state of the handle unit of FIG. 35 after bending.

FIG. 35 illustrates a state of the handle unit 970 of the trolley 900 according to the fifth embodiment of the present invention before bending. FIG. 36 illustrates a state of the handle unit 970 of FIG. 35 after bending.

The handle unit 970 may be included in the trolley 900 or may be a device separately produced. Also, the handle unit 970 is not limited to being used for the trolley 900 according to the fifth embodiment of the present invention but includes being used for another apparatus including the connection portion 960. Hereinafter, the handle unit 970 as an individual device will be described.

The handle unit 970 may be detachably connected to input power for driving or braking to the trolley 900 which moves along the rail 10. Also, the handle unit 970 may include the handle bar 971 which includes a joint portion 973 and a connection protrusion 972 connected to the connection portion 960 of the trolley 900.

Since it is necessary that the handle unit 970 is connected to the connection portion 960 of the general trolley 9 located in a higher place than a working place of the worker, the handle unit 970 may be provided as a long bar. In the general trolley 9, since one of a driving unit or a brake unit is operated using the chains 2 which droop, the worker works while pulling the chains 2 which droop. However, this method needs a great force and the safety of the worker is threatened by the chains 2 which swing. Using the handle unit 970 detachably connected, it is possible to transfer power to the power transfer unit 940 while removing the chains 2.

Also, the chains 2 rotate the input shaft 942 through a pulling force of the worker. On the other hand, the handle unit 970 may allow the worker to directly rotate the handle bar 971 or may connect the handle bar 971 with a driver to rotate. This method of inputting a driving force, compared with a case of using the general chains 2, is safer and may easily provide an driving force through less power. In this case, to easily rotate the handle unit 970, as shown in FIG. 35, an end of the handle bar 971 may be bent twice at a1 and a2 to allow a user to easily input a rotational force. As a length of a connection portion 971-3 which connects a handle 974 with the handle bar 971 increases, it is possible to provide a greater force. As the length decreases, it is possible to quickly rotate.

The handle unit 970 is basically to transfer power for driving or braking and may be used when the worker moves the trolley 900. That is, the worker grips the handle unit 970 connected to the connection portion 960 and applies a pulling or pushing force, thereby moving the trolley 900 on the rail 10.

The handle bar 971 may include a bent portion 973. The bent portion 973 includes a portion which is crooked or bent by a joint. The bent portion 973 includes a single directional or multidirectional joint portion. The worker may rotate the handle bar 971 in various position or postures using the handle bar 971 which is bendable. Also, when the worker applies a force to the handle unit 970 to move the trolley 900, the handle unit 970 without the bent portion 973 applies great torque to the input shaft 942 and the input shaft 942 may be damaged as fatigue accumulates. The torque is proportional to a length from the input shaft 942 to a bent portion. Accordingly, when the length between the input shaft 942 and the bent portion decreases, the torque becomes smaller and the fatigue applied to the input shaft 942 is reduced.

The bent portion 973 of the handle bar 971 may be used even when there is present an obstacle in a proceeding direction. Particularly, when a multidirectional joint portion using a universal joint is included, it is possible to proceed while avoiding obstacles using spaces in all directions.

FIG. 35 illustrates a multidirectional joint portion 973*a* as an example of the bent portion 973. The handle bar 971 may include a first handle bar 971-1 located on one end of the joint portion 973*a*, a second handle bar 971-2 located on the other end thereof, and an elastic member 973*b* which can maintain a state of not being bent when an external force for bending the bent portion 973 is removed. The elastic member 973*b* may surround the joint portion 973*a* while both ends thereof are being fixed to the first handle bar 971-1 and the second handle bar 971-2. The multidirectional joint portion 973*a* may use a universal joint, and the elastic member 973*b* may use a coil spring.

The elastic member 973*b* allows the handle bar 971 to keep an I-shape despite the joint portion 973*a*. Accordingly, the worker may easily connect the connection protrusion 972 to the connection portion 960. Also, the handle bar 971 is prevented from being bent by pitching of a vessel, etc., thereby providing the safety of the worker.

Figure 37:
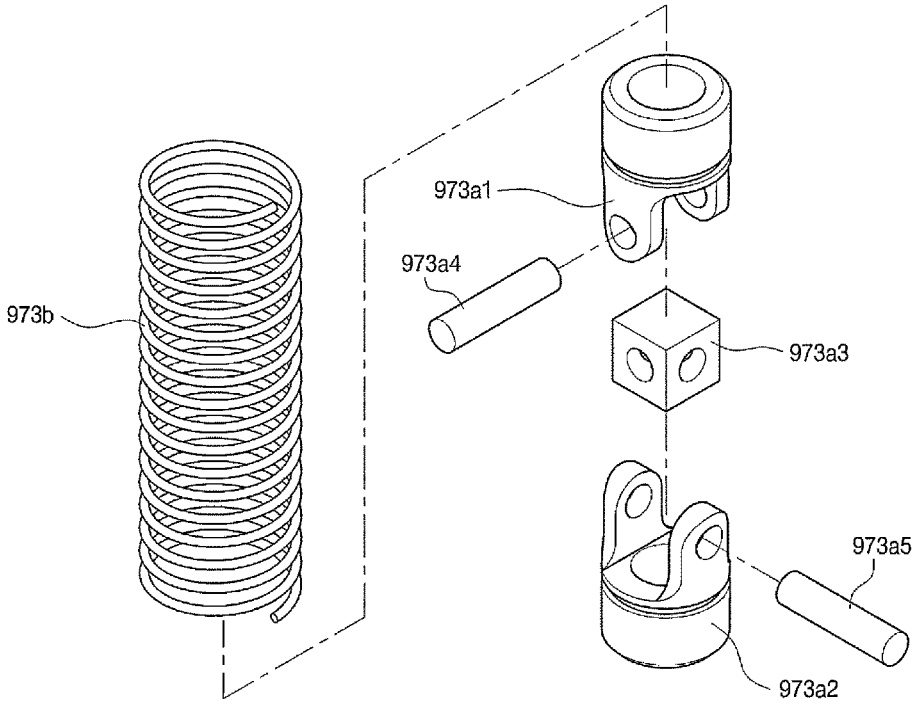
FIG. 37 is an exploded perspective view illustrating components of a joint unit shown in FIG. 35.

FIG. 37 is an exploded perspective view illustrating components of the joint portion 973*a* of FIG. 35.

The joint portion 973*a* includes a first joint member 973*a*1, a second joint member 973*a*2, and an insertion member 973*a*3 and two pins 973*a*4 and 973*a*5 which are inserted between the two joint members 973*a*1 and 973*a*2 to allow the two joint members 973*a*1 and 973*a*2 to be rotatable but not to be separated. The first and second joint members 973*a*1 and 973*a*2 include flange portions for coupling on both sides, in which through holes for being coupled with the pins 973*a*4 and 973*a*5 are formed. The two joint members 973*a*1 and 973*a*2 are coupled with each other at 90 degrees, and the insertion member 973*a*3 is disposed between the two joint members 973*a*1 and 973*a*2. The insertion member 973*a*3 includes through holes which intersect at 90 degrees. The respective pins 973*a*4 and 973*a*5 are coupled with the through holes.

When the two joint members 973*a*1 and 973*a*2 are coupled with one shaft, the insertion member 973*a*3 is unnecessary but rotation is allowed on only one plane. However, like the joint portion 973*a* according the embodiment of the present invention, when the two joint members 973*a*1 and 973*a*2 are coupled using two rotational shafts 973*a*4 and 973*a*5 which intersect at 90 degrees, rotation is allowed on two planes. This not only means that the first handle bar 971-1 and the second handle bar 971-2 are bendable in any direction but also means that a rotational force may be transferred while the two handle bars 971-1 and 971-2 are being bent.

Figure 38:
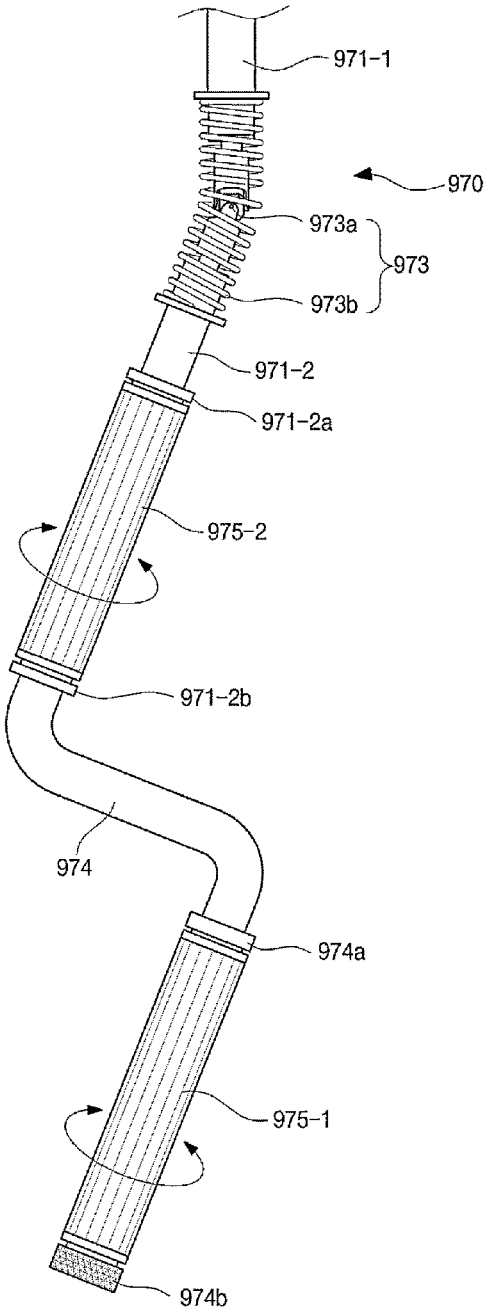
FIG. 38 is a view of a handle unit including a rotation cover.

FIG. 38 illustrates a handle unit including a rotation cover.

The rotation cover may include a first rotation cover 975-1 rotatably provided on the handle 974 and a second rotation cover 975-2 rotatably provided on the second handle bar 971-2. The handle 974 may include supporting jaws 974*a* and 974*b* which may support a top and bottom of the first rotation cover 975-1, and the second handle bar 971-2 may include supporting jaws 971-2*a* and 971-2*b* which may support a top and bottom of the second rotation cover 975-2. The rotation cover may rotate relatively to one of the handle 974 and the second handle bar 971-2. Being relatively rotatable means maintaining a standstill despite rotations of the handle 974 and the second handle bar 971-2.

Next, referring to FIGS. 39 and 40, a method of operating the trolley 900 using the handle unit 970 will be described.

Figure 39:
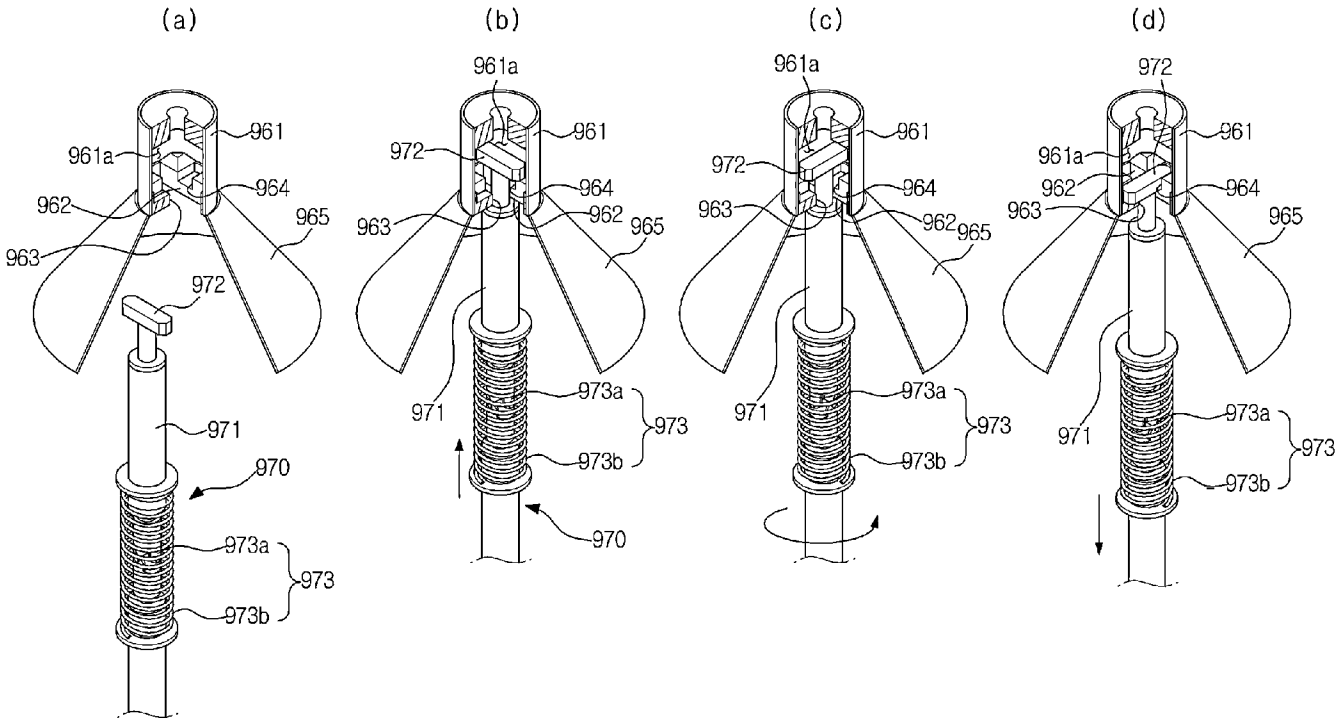
FIG. 39 illustrates a method of coupling the connection portion of the trolley according to the fifth embodiment of the present invention with the handle unit, in which (a) illustrates a state before inserting a connection protrusion, (b) illustrates a state in which the connection protrusion is inserted into a through groove, (c) illustrates a state in which the connection protrusion rotates at 90 degrees inside a rotation space, and (d) is a cross-sectional view illustrating a state in which the connection protrusion is mounted on a mounting groove.
Figure 40:
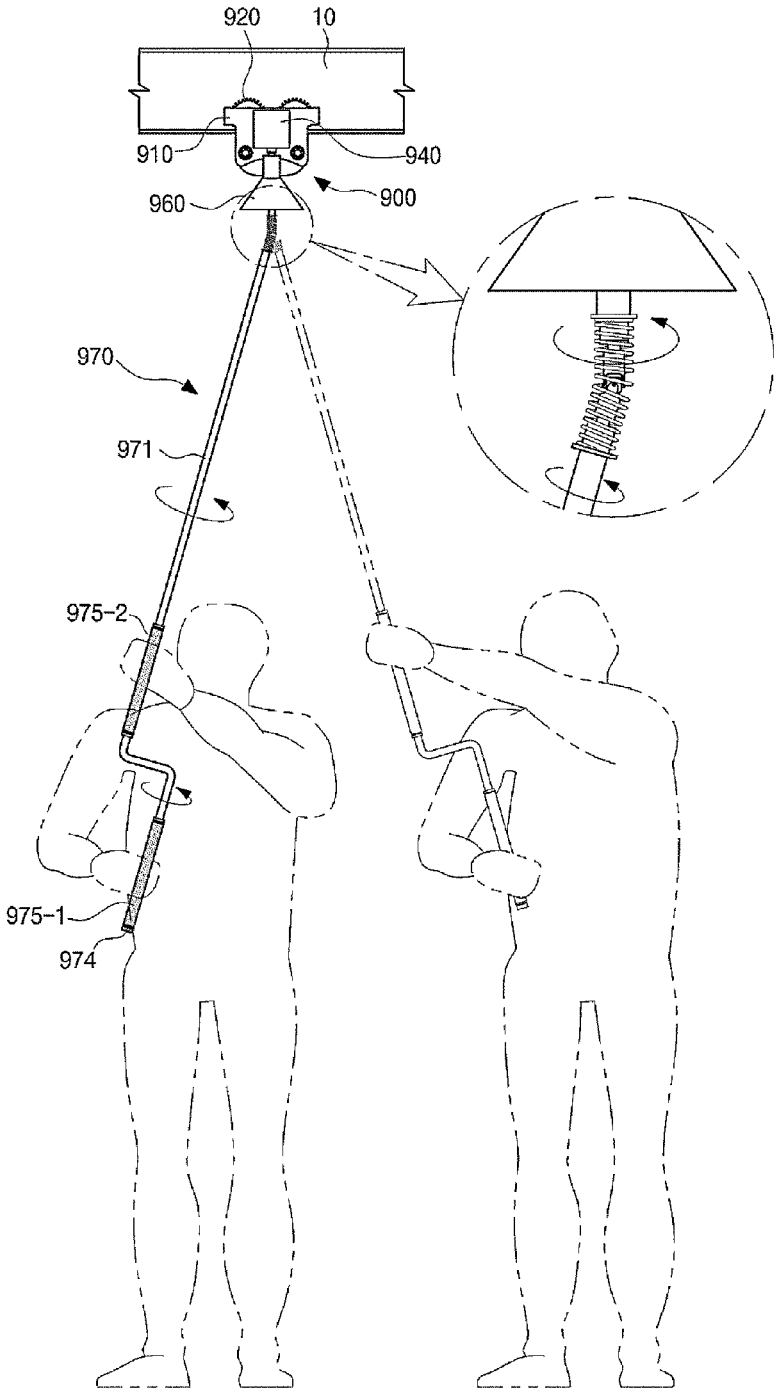
FIG. 40 is a view illustrating a state in which the trolley according to the fifth embodiment of the present invention is operated.

FIG. 39 illustrates a method of coupling the connection portion 960 of the trolley 900 according to the fifth embodiment of the present invention with the handle unit 970, in which (a) illustrates a state before inserting the connection protrusion 972, (b) illustrates a state in which the connection protrusion 972 is inserted into the through groove 963, (c) illustrates a state in which the connection protrusion 972 rotates at 90 degrees inside the rotation space 961*a*, and (d) is a cross-sectional view illustrating a state in which the connection protrusion 972 is mounted on the mounting groove 964. Also, FIG. 40 illustrates a state in which the trolley 900 according to the fifth embodiment of the present invention is operated.

Since the handle bar 971 maintains an I-shape due to the elastic member 973*b*, it is easy to dispose the connection protrusion 972 inside an opening of the guide member 965. The connection protrusion 972 may be guided by the guide member 965 to pass through the through groove 963 and enter the rotation space 961*a*, and then may rotate at degrees at which the through groove 963 and the mounting groove 964 get across each other (90 degrees in FIG. 39), thereby being mounted on the mounting groove 964. Here, even when getting across at certain degrees, the connection protrusion 972 may be guided to the mounting groove 964 by the guide protrusion 966. The handle unit 970 is pulled down in a state to be mounted on the mounting groove 964, thereby mounting the connection protrusion 972 on the mounting groove 964. After that, the handle bar 971 is rotated, thereby transferring a rotational force to the connection portion 960. Here, as shown in FIG. 40, the worker grips the handle 974 with one hand and grips the handle bar 971 with the other hand, thereby applying the rotational force. Also, since the handle bar 971 may be bent by the bent portion 973 at various angles, the worker may rotate the handle bar 971 in various positions.

In addition, functions of the rotation covers 975-1 and 975-2 when the rotational force is applied will be described. The rotation cover allows the user not to turn hands according to rotations of the handle 974 and the handle bar 971 when the user inputs the rotational force while gripping the handle 974 and the handle bar 971 with hands. That is, while the user is gripping the first rotation cover 975-1 and the second rotation cover 975-2 with both hands and an arm which grips the second rotation cover 975-2 is fixed to become a rotational axis, the user inputs the rotational force by rotating an arm which grips the first rotation cover 975-1 around the rotational axis. According to the rotational force input by the user, the handle 974 and the handle bar 971 rotate. However, since the rotation covers 975-1 and 975-2 may stand still regardless of rotations thereof, it is unnecessary that the user inconveniently rotates the hand in a reverse direction of the rotational direction or it is possible to prevent a palm from being rubbed.

Figure 41:
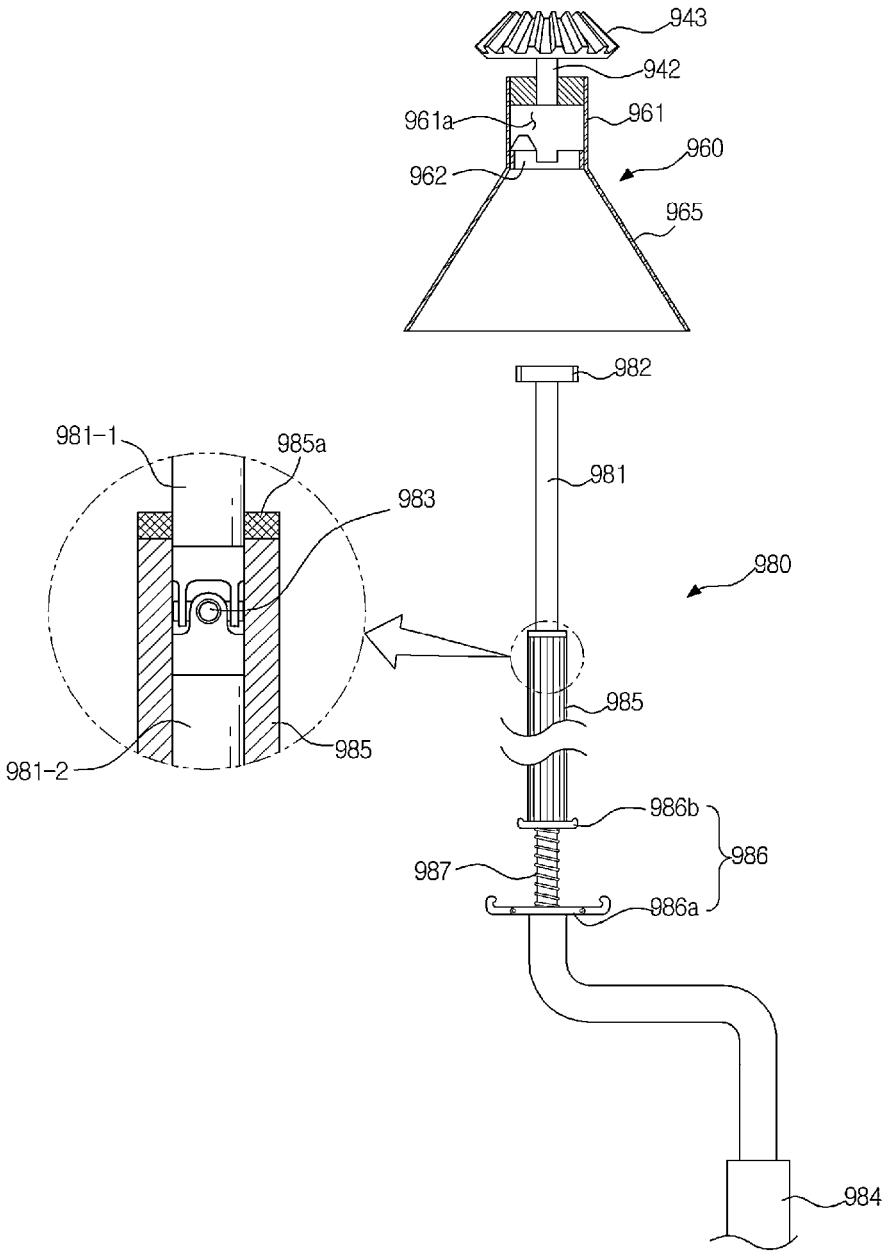
FIG. 41 is a view illustrating a state of a handle unit according to another embodiment of the present invention, which differs from FIG. 35, before bending.
Figure 42:
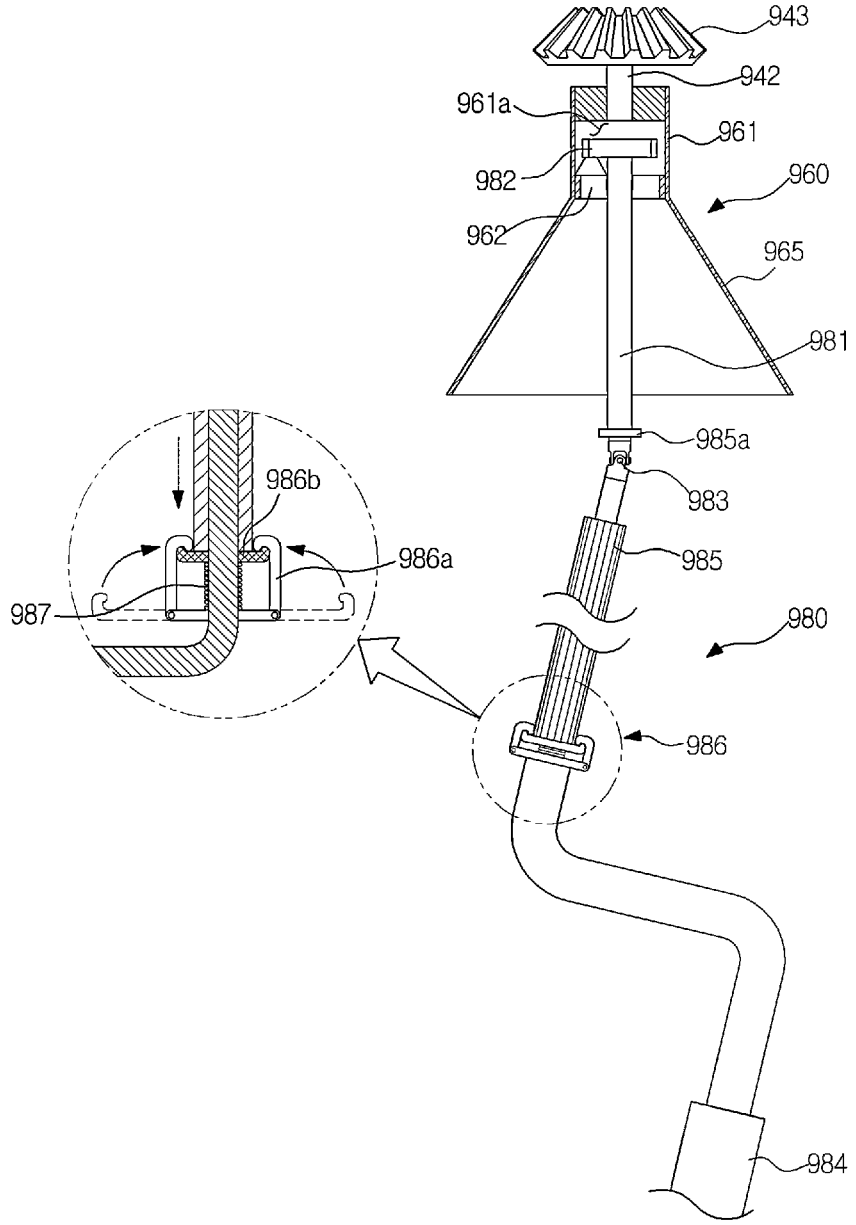
FIG. 42 illustrates a state of the handle unit shown in FIG. 41 after bending.

FIG. 41 is a view illustrating a state of a handle unit 980 according to another embodiment, which differs from FIG. 35, before bending. FIG. 42 illustrates a state of the handle unit 980 of FIG. 41 after bending.

A bent portion may include a multidirectional joint portion 983 and a cover member 985 which may open or cover the joint portion 983. The cover member 985 according to another embodiment corresponds to the elastic member 973*b* of FIG. 35. The cover member 985 is provided to at least partially surround a peripheral portion of the joint portion 983 and may slidably move along a handle bar 981. Since the cover member 985 slides and moves toward the joint portion 983 and at least partially surrounds the periphery of the joint portion 983, it is possible to prevent the handle bar 981 from being folded.

The handle bar 981 may further include an elastic supporting portion 987 which provides an elastic force to allow the cover member 985 to cover the joint portion 983. When the cover member 985 moves downward to expose the joint portion 983, the elastic supporting portion 987 applies the elastic force to allow the cover member 985 to return to an original position to cover the joint portion 983. Also, a stopping jaw 985*a* which is provided above the joint portion 983 may restrict an upward movement of the cover member 985 by supporting a top end of the cover member 985.

The handle bar 981 may further include a cover member fixing portion 986 which may fix the cover member 985 while exposing the joint portion 983. The cover member fixing portion 986 may include a fixing member 986*b* which protrudes from a bottom end of the cover member 985 and a moving member 986*a* which is provided below the elastic supporting portion 987, is pivotable, and is coupled with the fixing member 986*b*. Here, the fixing member 986*b* and the moving member 986*a* may be switched in locations thereof.

As shown in FIG. 41, the user may connect the handle unit 980 which maintains an I-shape by the cover member 985 covering the joint portion 983 to the connection portion 960. After that, the cover member 985 is pulled to fully expose the joint portion 983 to bend the handle bar 981. Accordingly, the user may rotate the handle unit 980 at a slant angle. Here, as shown in FIG. 41, the joint portion 983 may maintain being opened by fixing the cover member 985 to the cover member fixing portion 986.

Figure 43:
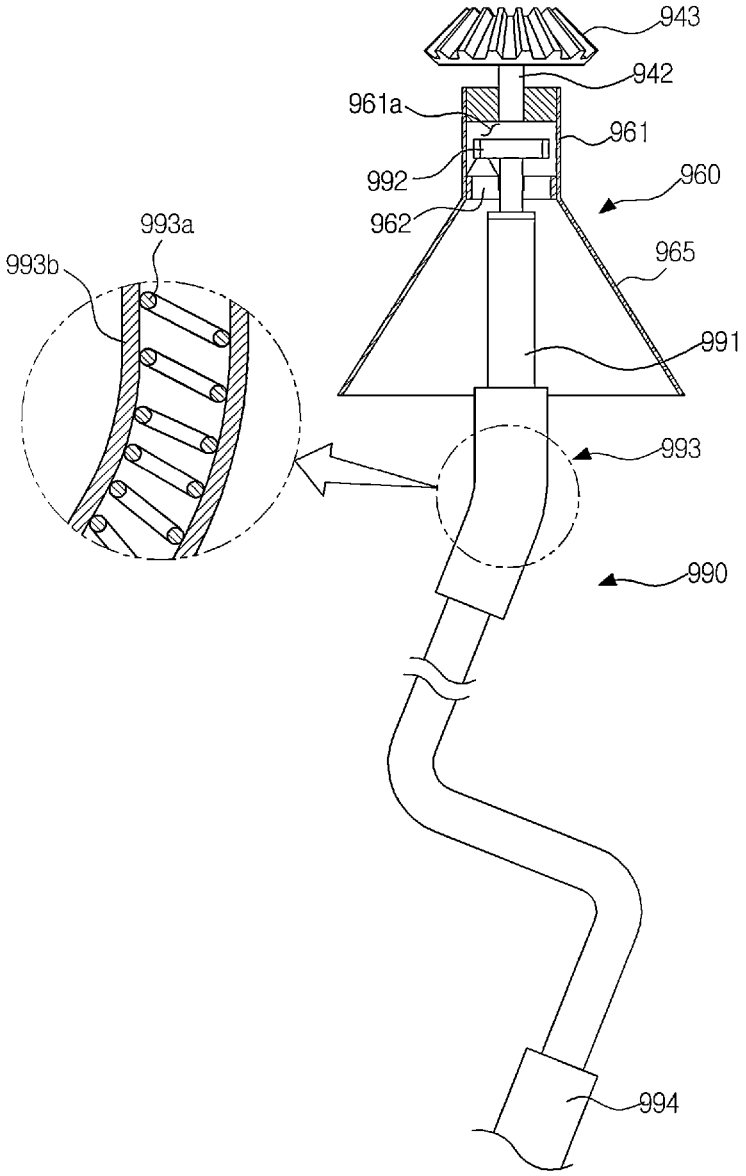
FIG. 43 is a view illustrating a state of a handle unit according to still another embodiment of the present invention, which differs from FIG. 35, after bending.

FIG. 43 is a view illustrating a state of a handle unit 990 according to still another embodiment of the present invention, which differs from FIG. 35, after bending. A bent portion 993, as shown in a partial enlarged portion of FIG. 43, may include a second elastic member 993*a* and an elastic cover 993*b* in which the second elastic member 993*a* is inserted. For example, the second elastic member 993*a* may include a spring and the elastic cover 993*b* may include a flexible material such as rubber and plastic. Also, the second elastic member 993*a* and the elastic cover 993*b* may be integrated as a single body. The elastic cover 993*b* allows a handle bar 991 to maintain an I-shape when an external force which bends the bent portion 993 is removed.

Figure 44:
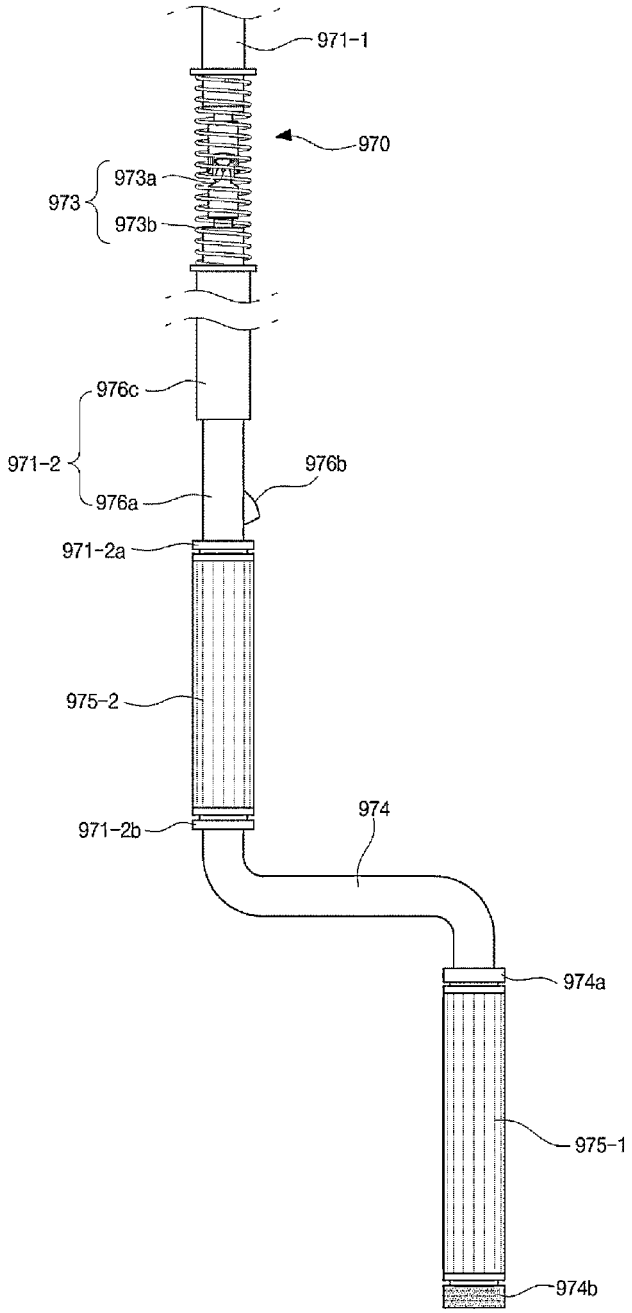
FIG. 44 is a view illustrating a state of a handle unit whose length is extendible, in which the handle unit lengthwise extends.

FIG. 44 is a view illustrating a state of the handle unit 970 whose length is extendible, in which the handle unit 970 lengthwise extends. The handle unit 970 may vary in length. An installation height of the trolley 900 may vary as necessary, and a height of the user or a working environment may be changed. Accordingly, the handle unit 970 whose length is variable allows power to be inputted to the trolley 900 at an optimal height in various situations.

Referring to FIG. 44, the second handle bar 971-2 may have a two-step structure which includes a first step handle bar 976*a* and a second step handle bar 976*c*. The first step handle bar 976*a* may be inserted into the second step handle bar 976*c*. Accordingly, when the first step handle bar 976*a* is inserted into the second step handle bar 976*c*, a total length of the handle unit 970 is reduced. When the first step handle bar 976*a* is out just not to be separated from the second step handle bar 976*c*, the total length of the handle unit 970 increases. Here, although not shown in the drawings, a hanging jaw and a hanging protrusion which prevent the first step handle bar 976*a* from being separated from the second step handle bar 976*c* may be provided on an outer circumferential surface of the first step handle bar 976*a* and an inner circumferential surface of the second step handle bar 976*c*.

Also, the handle unit 970 may not only be changed in length but also be fixed while being changed. A fixing protrusion 976*b* may be installed on the first step handle bar 976*a* to be inserted thereinto and protrudes from the outer circumferential surface. The fixing protrusion 976*b* may be elastically supported to maintain a state of protruding from the first step handle bar 976*a*. When the first step handle bar 976*a* is inserted into the second step handle bar 976*c*, the fixing protrusion 976*b* is hung on a hanging hole (not shown) provided on the second step handle bar 976*c*. Here, a surface of the fixing protrusion 976*b* which faces the second step handle bar 976*c* is provided as a curve to be easily inserted and a facing surface may be provided as a slant shape to easily maintain a state of being hung on the hanging hole of the second step handle bar 976*c*.

FIG. 44 illustrates a most general shape of the handle unit 970 whose length is extendible. However, a structure for extending a length or a structure for fixing a changed length may be employed in the art. Also, an extension structure more than two steps is available and consecutive length changes are available using a clamp.

Figure 45:
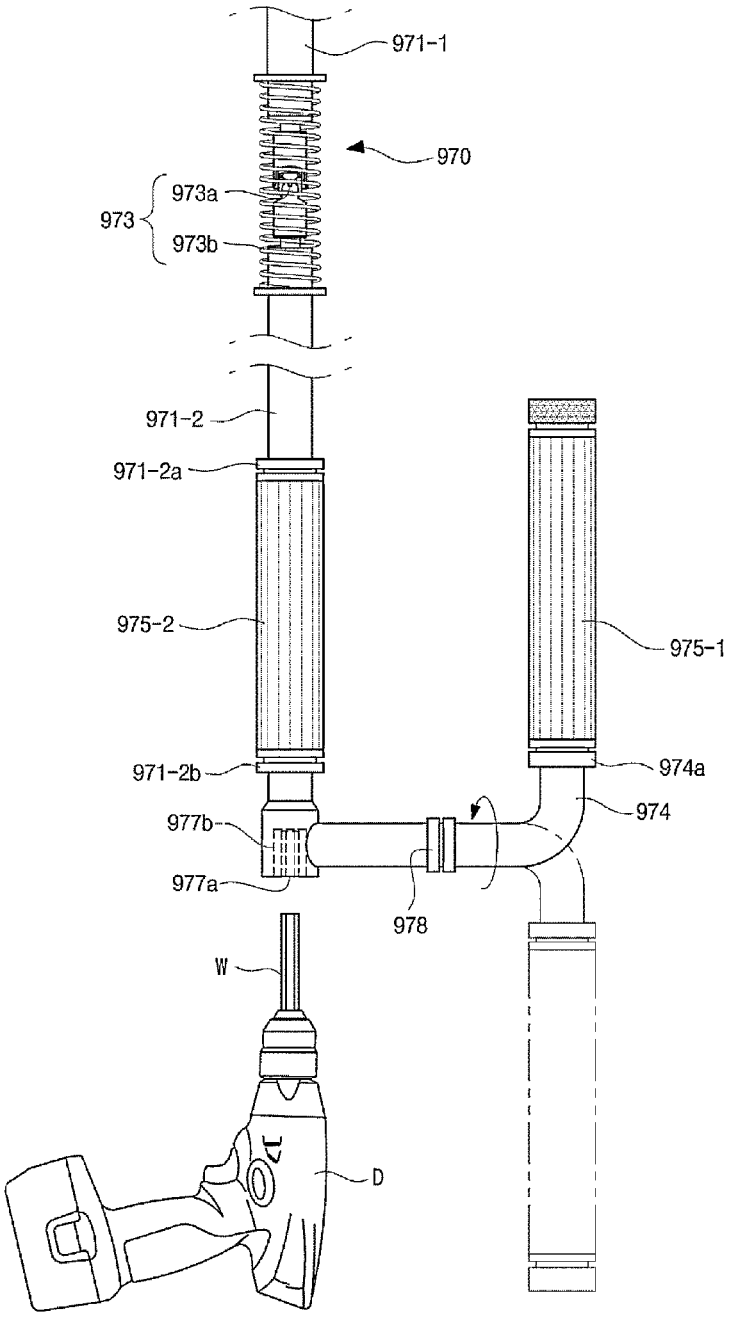
FIG. 45 is a view of a handle unit rotatable by a driver.
Figure 46:
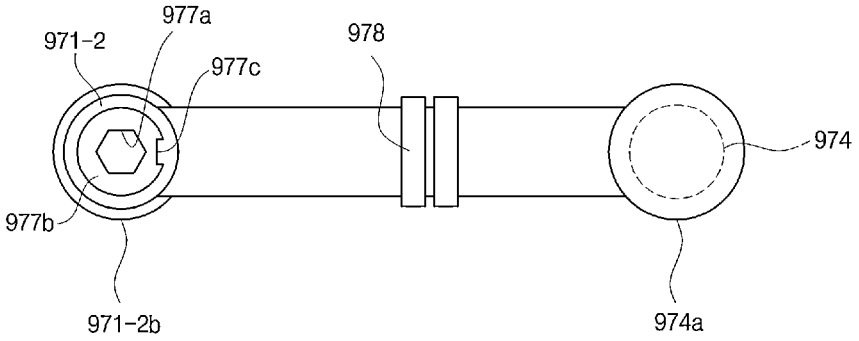
FIG. 46 is a bottom view of the handle unit shown in FIG. 45.

FIG. 45 is a view of the handle unit 970 which is rotatable by a driver D FIG. 46 is a bottom view of the handle unit 970 of FIG. 45.

When the worker directly inputs a rotational force, a maintenance time for inputting power may be short, a rotational speed may be low, and the rotational force may be small. On the other hand, when an additional driver D is used, an input maintenance time is long, a rotational speed is high, and a rotational force is great. A socket 977*a* into which a wrench W of the driver D can be inserted may be provided on a bottom of the second handle bar 971-2. The socket 977*a* has a shape corresponding to an outer surface of the wrench W. For example, when a hexagonal wrench W is used, the socket 977*a* also includes a hexagonal groove.

The socket 977*a* not only may be integrated with the second handle bar 971-2 but also may be formed in an additional socket member 977*b*. The socket member 977*b* may have the sockets 977*a* in various sizes or shapes to correspond to various sizes and shapes of the wrench W and may be detachably coupled with the second handle bar 971-2. Also, to prevent the socket member 977*b* from independently rotating from the second handle bar 971-2 while being inserted into the second handle bar 971-2, a hanging portion 977*c* may be provided on an outer surface of the socket member 977*b*.

Also, although the wrench W is provided on the driver D and the socket 977*a* is formed in the second handle bar 971-2 in the drawing, a socket (not shown) may be provided in the driver D and a wrench (not shown) may protrude from a bottom surface of the second handle bar 971-2.

When the socket 977*a* is formed on the bottom of the second handle bar 971-2, rotational axes are in parallel, thereby preventing rotation of the driver D. Here, according to the rotation of the second handle bar 971-2, the handle 974 connected thereto also rotates together. The handle 974 rotates around the second handle bar 971-2 as a rotational axis. Here, since the handle 974 more protrudes toward the worker than a position of the socket 977*a*, the handle 974 may be a risk to the worker while rotating.

Accordingly, the handle unit 970 according to the embodiment of the present invention may include a rotation portion 978 which is able to rotate the handle 974. The handle 974 may rotate at 180 degrees due to the rotation portion 978 and a position thereof may be shifted to be far from a direction which protrudes toward the worker due to the rotation. Although not shown in the drawings, the rotation portion 978 may include a fixing device which can fix a rotation state. This is to prevent the handle 974 from rotationally moving toward the worker while rotating.

While one or more embodiments of the present invention have been described with reference to the figures, it will be understood by those of ordinary skill in the art that various changes in form and details may be made therein without departing from the spirit and scope of the present invention as defined by the following claims.

The invention claimed is:

1. A trolley comprising:

a body unit which moves along a rail;

a power transfer unit which transfers power for driving or braking of the body unit;

a connection portion connected to the power transfer unit; and a handle unit detachably connected to the connection portion and receiving the power, wherein the power transfer unit comprises an input shaft, an output shaft which receives power of the input shaft and transfers the power to the body unit, and a locking unit which transfers the power from the input shaft to the output shaft but does not transfer power from the output shaft to the input shaft, wherein the handle unit comprises a connection member connected to the connection portion and a handle bar which comprises a bent portion bent by an external force, and wherein when the handle unit is connected to the connection portion, a rotational force of the handle unit is transferred to the input shaft.

2. The trolley of claim 1, wherein the locking unit comprises an active rotating body rotated by the input power and a passive rotating body which is coupled with the active rotating body to rotate in the same direction as a rotational direction of the active rotating body and rotates the output shaft, and wherein the passive rotating body is rotatable due to the rotation of the active rotating body but does not rotate due to the rotation of the output shaft.

3. The trolley of claim 2, wherein the locking unit further comprises a housing which accommodates the passive rotating body therein and a locking member which is disposed between the housing and the passive rotating body, in which an insertion occurs in one rotational direction, wherein when the active rotating body rotates, since the locking member is not inserted, the passive rotating body rotates, and wherein when the power is transferred from the output shaft to the passive rotating body, since the locking member is inserted, the passive rotating body does not rotate.

4. The trolley of claim 3, wherein the locking unit further comprises an unlocking member which is connected to the active rotating body and able to move the locking member due to the rotation of the active rotating body, wherein the active rotating body and the passive rotating body are coupled to generate a space while rotating in such a way that a rotational force of the active rotating body is not transferred to the passive rotating body as the space, and wherein while the active rotating body is rotating as the space, the unlocking member moves the locking member to a place in which an insertion does not occur in such a way that the passive rotating body rotates when the active rotating body passes the space and transfers the rotational force to the passive rotating body.

5. The trolley of claim 4, wherein the locking member is provided two or more to generate insertions in different rotational directions and the unlocking member is provided two or more in response to the locking member in such a way that even when the active rotating body rotates in any direction, the unlocking member moves the locking member to a place in which an insertion does not occur to allow the passive rotating body to rotate.

6. The trolley of claim 3, wherein the locking unit further comprises an elastic member which pushes the locking member to a place in which the insertion occurs.

7. The trolley of claim 2, wherein the locking unit further comprises a stud member formed on one of the active rotating body and the passive rotating body and a stud hole which is formed in the other of the active rotating body and the passive rotating body and accommodates the stud member, and wherein an inner diameter of the stud hole is greater than an outer diameter of the stud member, thereby generating a gap between the stud hole and the stud member.

8. The trolley of claim 1, wherein the power transfer unit comprises an input gear connected to the input shaft and an output gear which gears into the input gear and is connected to the output shaft, and wherein the input shaft and the output shaft are arranged not to be parallel to each other and the input gear and the output gear are coupled to convert a rotational axis direction to transfer the power input below the body unit to the body unit.

9. The trolley of claim 8, wherein the power transfer unit further comprises a case, wherein the case comprises a base portion connected to the body unit, through which the input shaft penetrates, and a cover portion coupled with the base portion to surround the input shaft, the output shaft, and the locking unit, and wherein the base portion is coupled with the body unit to be movable up and down to release a coupling state between the input gear and the output gear.

10. The trolley of claim 1, wherein the connection portion comprises a guide member which guides an end of the handle unit to be easily inserted.

11. The trolley of claim 10, wherein the handle unit comprises a connection member connected to the connection portion and a handle bar gripped by a worker to input a rotational force, wherein when the handle unit is connected to the connection portion, a rotational force of the handle unit is transferred to the input shaft, and wherein the handle unit comprises a handle physically connected to the handle bar which becomes a rotational axis and located separate from a central axis of the handle bar, a first rotation cover which surrounds an outer diameter of the handle and is independently rotatable, and a second rotation cover which surrounds an outer diameter of the handle bar and is independently rotatable.

12. The trolley of claim 1, wherein the handle unit further comprises an elastic member which provides an elastic force to the bent portion to maintain a state of not being bent when the external force which bends the bent portion is removed.

13. The trolley of claim 1, wherein the handle unit further comprises a cover member which exposes or covers the bent portion in such a way that when the cover member covers the bent portion, the handle bar is not bent by the external force.

14. The trolley of claim 13, wherein the handle unit further comprises a cover member fixing portion which is able to fix the cover member while the cover member is exposing the bent portion.

15. The trolley of claim 13, wherein the handle unit comprises an elastic supporting portion which provides an elastic force in a direction in which the cover member covers the bent portion.

16. The trolley of claim 1, wherein the body unit comprises a first supporting plate and a second supporting plate located on both sides of a longitudinal central line of the rail, rolling wheels which roll along a top surface of the rail, and a supporting wheel which rolls along a bottom surface of the rail, and wherein the rolling wheels are coupled with the first supporting plate and the second supporting plate, respectively, the power transfer unit is coupled with the first supporting plate, and the supporting wheel is coupled with the second supporting plate, and wherein the supporting wheel is located facing the rolling wheel based on the longitudinal central line of the rail and supports the moment generated because the power transfer unit and the locking unit are located in one side based on the longitudinal central line of the rail.

17. The trolley of claim 16, wherein the body unit comprises a connection shaft member which penetrates and connects the first and second supporting plates, a first spacer which surrounds an outer diameter of the connection shaft member and is provided between a tightening nut and one of the first supporting plate and the second supporting plate to maintain a certain distance between the tightening nut and one of the first supporting plate and the second supporting plate, a second spacer which surrounds the outer diameter of the connection shaft member and is provided between the first supporting plate and the second supporting plate to maintain a certain distance between the first supporting plate and the second supporting plate, and the tightening nut which fixes the connection shaft member and the first and second supporting plates.

18. The trolley of claim 17, wherein through holes are formed on both ends of the connection shaft member and a slit whose one side is open is formed along an outer diameter of the tightening nut in such a way that when a pin is inserted along the through hole while the tightening nut is coupled with the connection shaft member, rotation and separation of the tightening nut are prevented by the pin.

* * * * *